United States Patent [19]

DeVale et al.

[11] Patent Number: 4,516,781

[45] Date of Patent: May 14, 1985

[54] DART GAME WITH TWO MICROCOMPUTERS

[75] Inventors: Donald P. DeVale, Sycamore; Robert J. Brejcha, St. Charles; Robert W. Van Naarden, Hinkley, all of Ill.

[73] Assignee: Industrial Design Electronic Associates, Inc., Sycamore, Ill.

[21] Appl. No.: 442,356

[22] Filed: Nov. 17, 1982

[51] Int. Cl.[3] ..... F41J 3/00; F41J 3/02

[52] U.S. Cl. ..... 273/373; 273/376; 273/1 ES

[58] Field of Search ..... 273/1 ES, 1 E, 85 G, 273/327, 371-374, 376, DIG. 28

[56] References Cited

U.S. PATENT DOCUMENTS

| | | | |
|---|---|---|---|
| 3,454,276 | 7/1969 | Brenkert et al. | 273/376 |
| 3,727,069 | 4/1973 | Crittenden, Jr. et al. | 250/222.1 |
| 3,807,858 | 4/1974 | Finch | 356/1 |
| 3,972,531 | 8/1976 | Knapp | 273/376 |
| 3,979,117 | 9/1976 | Worsham | 273/408 |
| 4,051,605 | 10/1977 | Toal et al. | 434/201 |
| 4,057,251 | 11/1977 | Jones et al. | 273/376 |
| 4,216,968 | 8/1980 | Yeeda | 273/376 |
| 4,222,564 | 9/1980 | Allen et al. | 273/369 |
| 4,244,583 | 1/1981 | Wood et al. | 273/DIG. 28 |
| 4,314,236 | 2/1982 | Mayer et al. | 273/DIG. 28 |
| 4,415,162 | 11/1983 | Sheppard | 273/371 |

FOREIGN PATENT DOCUMENTS 2030877 4/1980 United Kingdom ..... 273/1 ES

OTHER PUBLICATIONS

Publication by Arachnid Entitled English Mark Darts, English Mark Darts-2 pages.

*Primary Examiner*—Richard C. Pinkham
*Assistant Examiner*—MaryAnn Stoll Lastova
*Attorney, Agent, or Firm*—Hill, Van Santen, Steadman & Simpson

[57] ABSTRACT

A novel dart game which allows one or more players to participate and which has a dart board mounted over a matrix switch and with segments to actuate the matrix switch when struck by a dart thrown by a player and which uses a first microcomputer to scan the matrix switch to detect where the dart struck the dart board and a second microcomputer which performs numerous functions such as totalizing the score for each player, actuating indicators which inform the players of the conditions and score of the game for each player. The novel dart board is formed with movable segments which are guided by guide ribs so as to provide smooth and accurate response of the segments to darts received on the board.

7 Claims, 15 Drawing Figures

FIG. 1
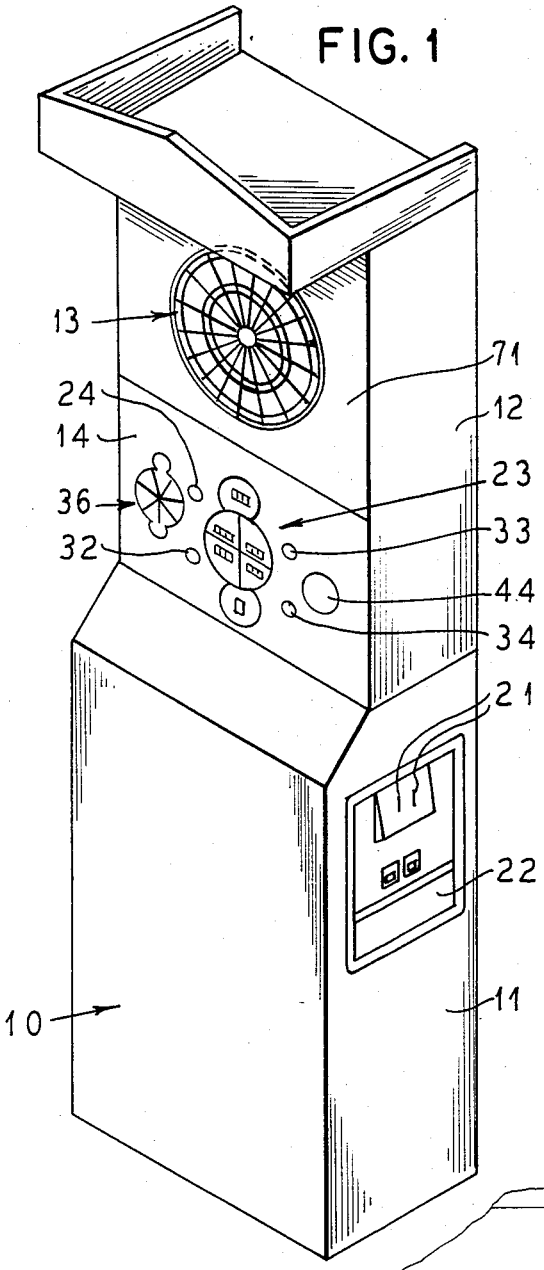
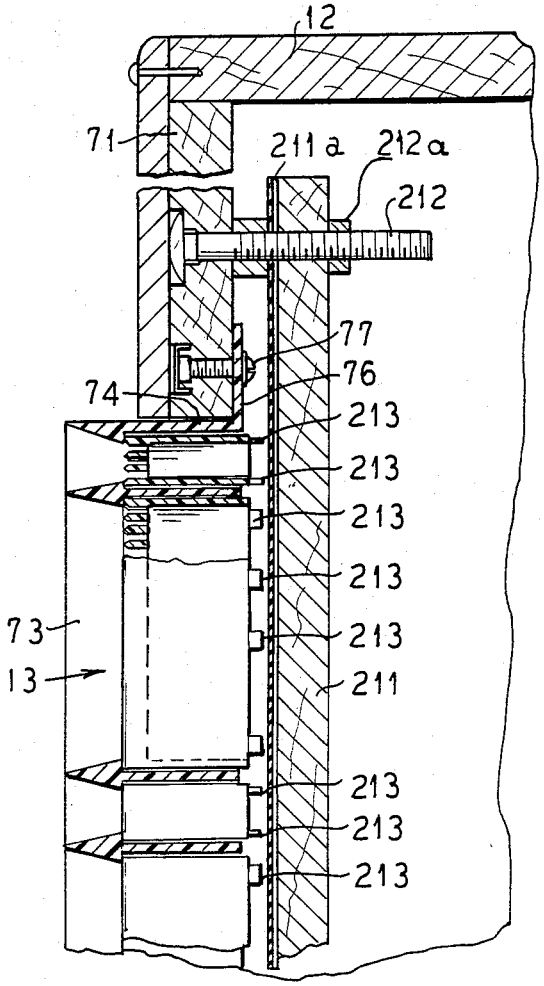
FIG. 8
FIG. 2
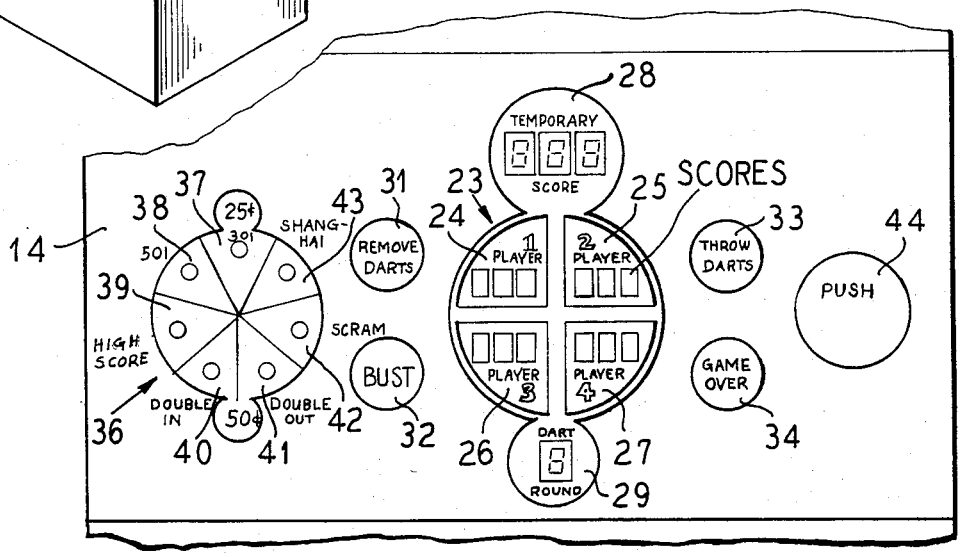

DART GAME WITH TWO MICROCOMPUTERS

BACKGROUND OF THE INVENTION

1. Field of the Invention

This invention relates in general to dart games and in particular to a computerized dart game which has more than one microcomputer and which has a novel dart board.

2. Description of the Prior Art

Electronic dart games are known such as illustrated in U.S. Pat. Nos. 4,057,251, 1,199,564, 2,808,266, 2,818,259, and 3,309,091 in which patents impinge upon a board so as to cause segments of the board to close a switch and wherein such switches are connected to components for registering, totalling and displaying the score of the player.

SUMMARY OF THE INVENTION

The present invention comprises a computerized dart game which has a novel dart board formed with segments that are guided by guide ribs so as to actuate a matrix switch and wherein at least two microcomputers are utilized with one of the microcomputers scanning the matrix switch of the dart board to detect scoring and the other microcomputer controlling various indicator, totallizing and other functions of the game. The use of at least two microcomputers allows the operation of the game to be very rapid and allows many different functions to be provided for the game.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 1 is a perspective view of the dart game of the invention;

FIG. 2 illustrates the indicator and control board of the invention;

FIG. 8 is a sectional view of the dart board;

DESCRIPTION OF THE PREFERRED EMBODIMENTS

Figure 3:
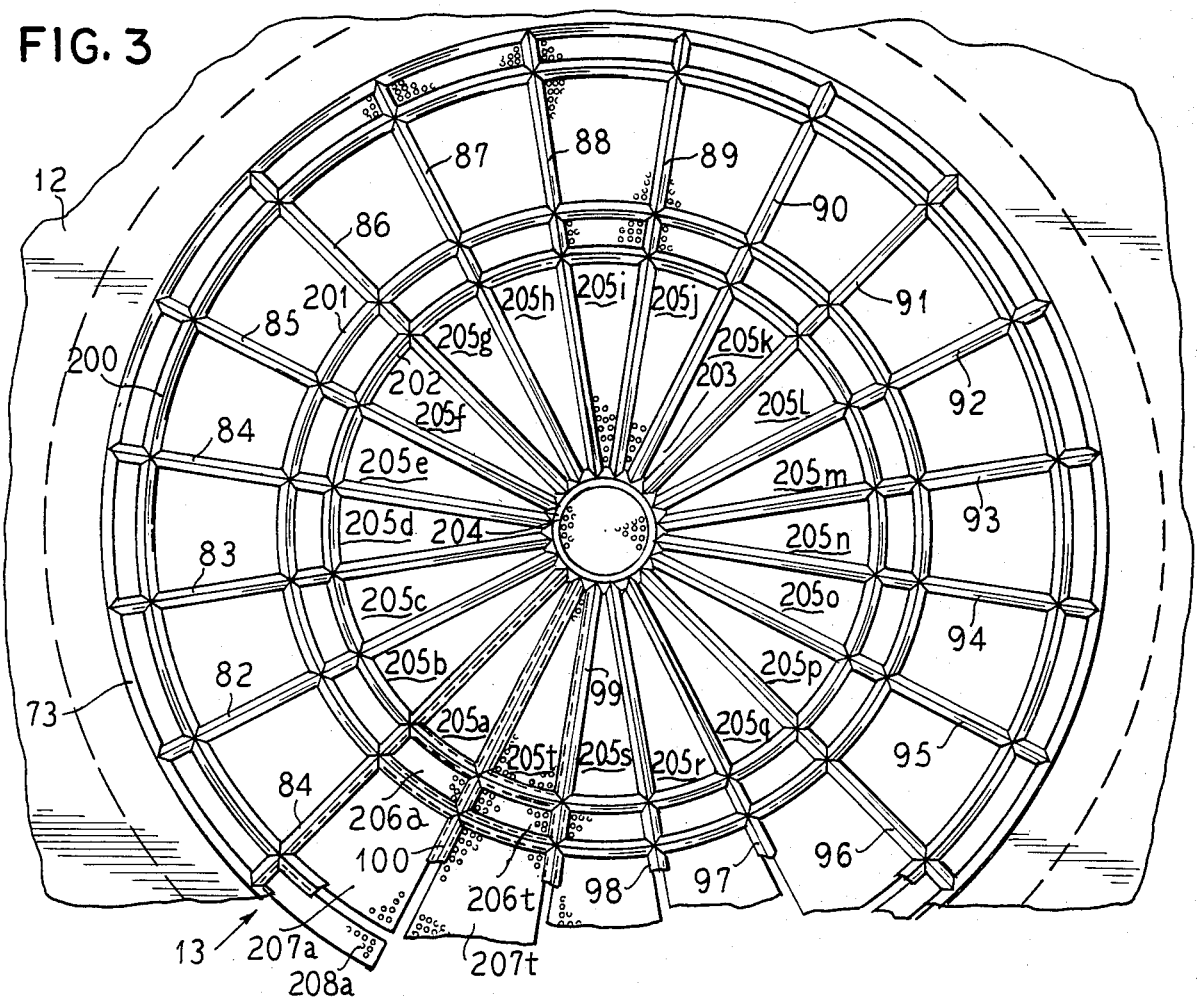
FIG. 3 is a plan view of the dart board of the invention.

FIG. 1 illustrates the dart game 10 of the invention which has a base 11 and a top extending portion 12 which carries the dart board 13. A control panel 14 is illustrated in FIG. 2 in greater detail and comprises a game selector switch 36 which allows for example the selection of five different games with three levels of skill such as high score which can be selectived by depressing a switch 39, 501 which can be selected by depressing a switch 38, 301 which can be selected by depressing a switch 37, shanghai which can be selected by depressing a switch 43, and scram which can be selected by depressing a switch 42. A double in switch segment 40 allows double in to be selected and a double out switch segment 41 can also be selected. It is to be realized, of course, that both double in and double out can be selected upon payment of the appropriate fee by each player. Coin slots 21 are mounted on the side of the game 10 and a coin ejector and return 22 is also mounted on the game 10.

The control board 14 also carries indicator such as remove dart indicator 31, a bust indicator 32, a throw dart indicator 33, a game over indicator 34, a push button 44 and scoring indication 23 which has first, second, third and fourth player indicators 24, 25, 26 and 27, a temporary score 28 and a dart round indicator 29.

FIGS. 3 through 8 illustrate in detail the dart board 13 of the game. The target 13 comprises a plurality of radial ribs 81 through 100 which are spaced equal angularly relative to each other and which are joined at their outer ends by a rim 73 which has its inner edge tapered so as to throw darts into the target. Radial dividers 200, 201, 202 and 203 are also provided in the target and target segments comprise the inner bullseye 204, a plurality of first inner pie-shaped elements 205*a* through *t* are located in the spaces between the ribs 81 through 100 and the ring 202 and 203. Smaller double score elements 206*a* through 206*t* are mounted between rings 201 and 202. Target segments 207*a* through 207*t* are mounted between rings 200 and 201. Smaller triple score segments 208, 208*a* through 208*t* are mounted between rings 73 and 200.

Figure 4:
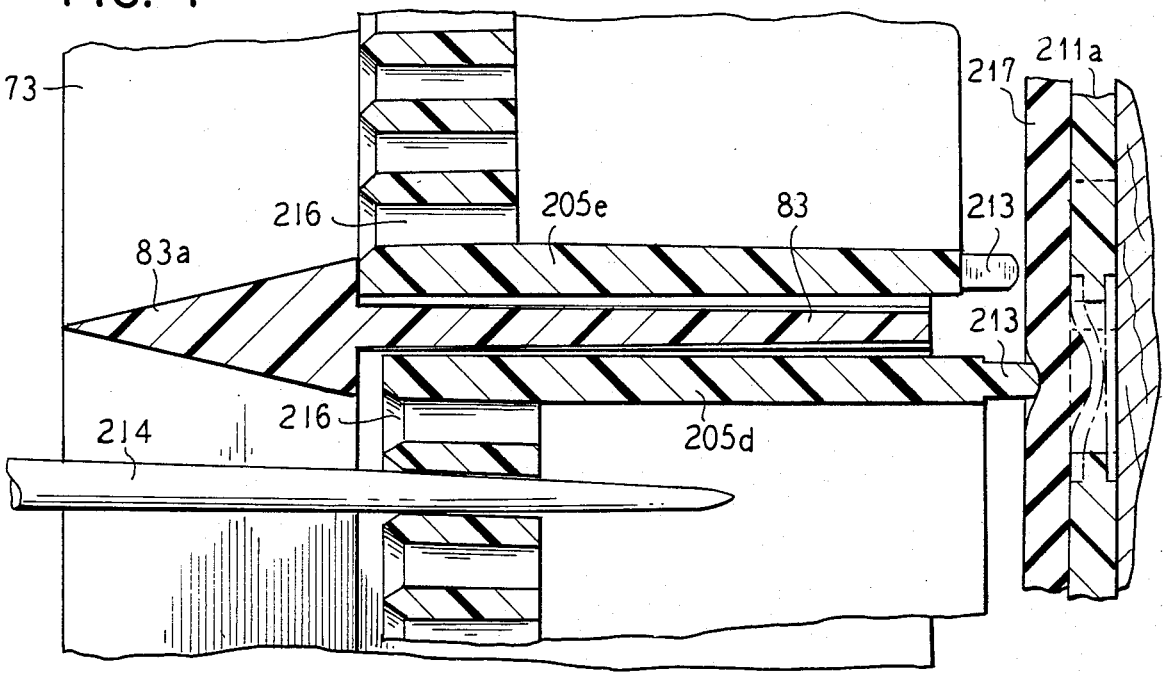
FIG. 4 is a sectional view illustrating the details of the dart board.
Figure 7:
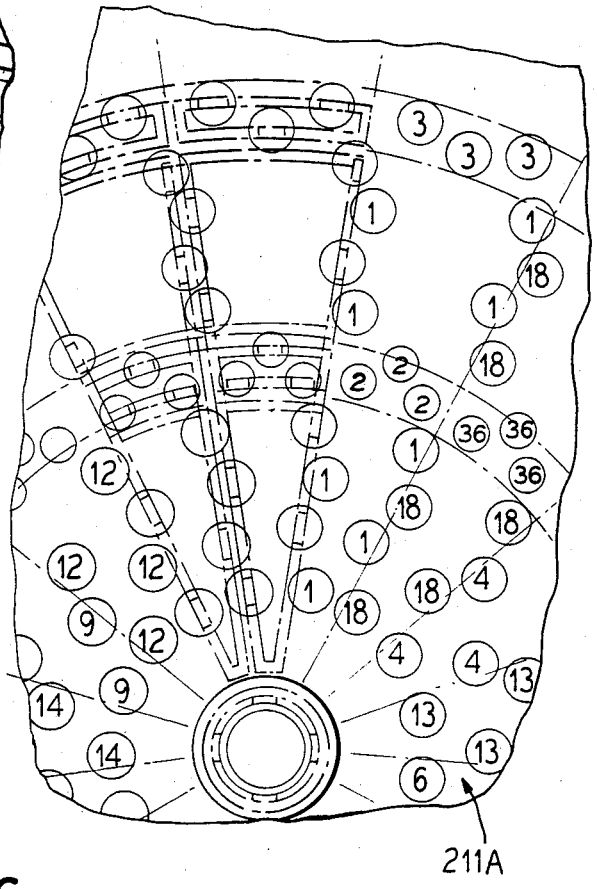
FIG. 7 illustrates the positioning of the switch elements.

As shown in FIG. 8, the target assembly 13 is attached to the front panel 71 of the upper part 12 of the case by a screw 77 and a rim 76. A matrix switch structure 211 is mounted to the upper portion 12 by bolt 212 which is connected to the portion 71 as shown in FIG. 8. Each of the target segments 203 through 208 are formed with feet 213 as is illustrated in FIG. 8 which are mounted so as to engage the pressure switch 211*a* which is mounted on the pressure switch support 211 as illustrated in FIG. 8. As illustrated in FIG. 7, the matrix switch 211 has openings so that the feet 213 can close the switch at locations associated with the feet 213 of the target segments so as to indicate when a dart 214 impinges on a switch segment as illustrated in FIG. 4. Each of the switch segments is formed with a plurality of openings 216 into which the point of the dart 214 can enter and the reaction of the segments such as segment 205*d* when hit by the dart is to cause its associated switch actuated feet 213 to engage a rubber pad 217 which overlies the matrix switch 211*a* and the feet 213 of the target segment 205*d* will close the switches associated with the target segment 205*d* when the target segment is hit with a dart 214.

Figure 5:
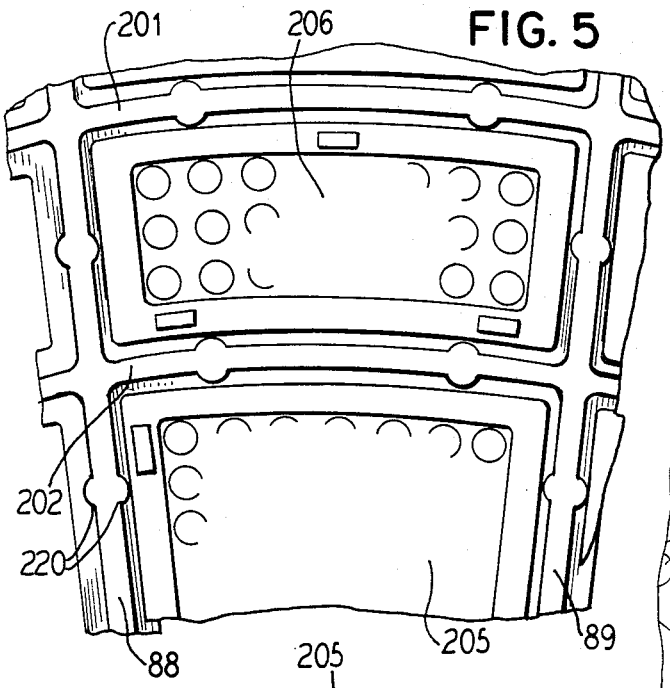
FIG. 5 is a cut-away sectional view illustrating the dart board segments.
Figure 6:
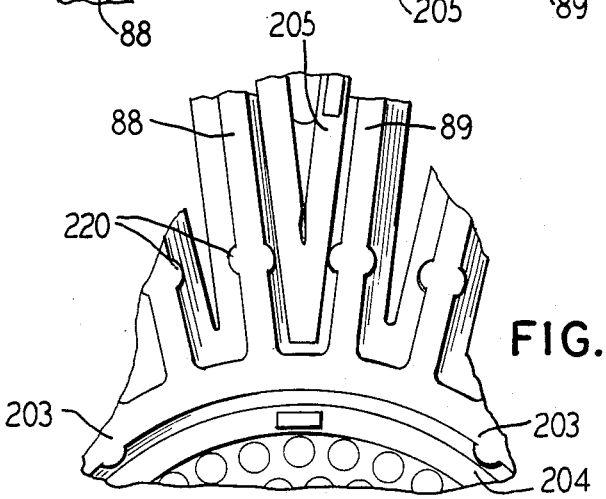
FIG. 6 is another cut-away view of the dart board.
Figure 9:
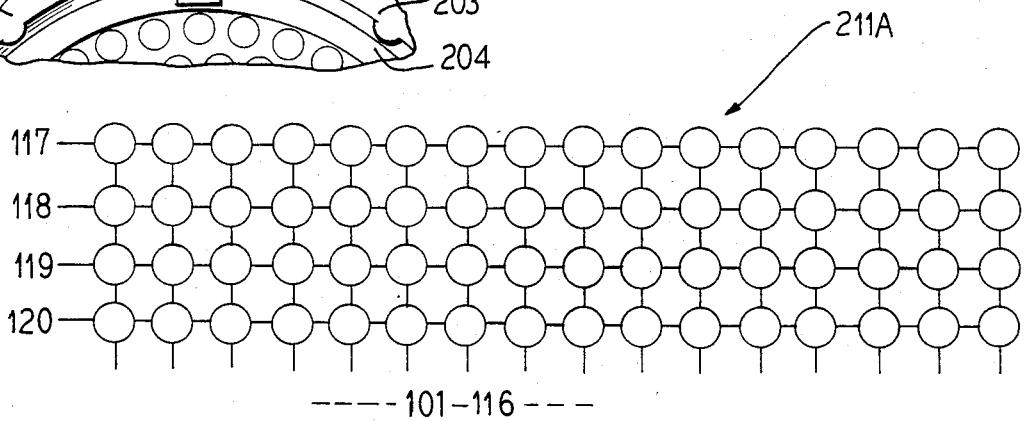
FIG. 9 illustrates the matrix switch of the invention.

As shown in FIGS. 5 and 6, guide ribs 220 are mounted on the ribs 81 through 100 so as to engage and guide the target segments 203 through 208 of the target board.

Figure 10A:
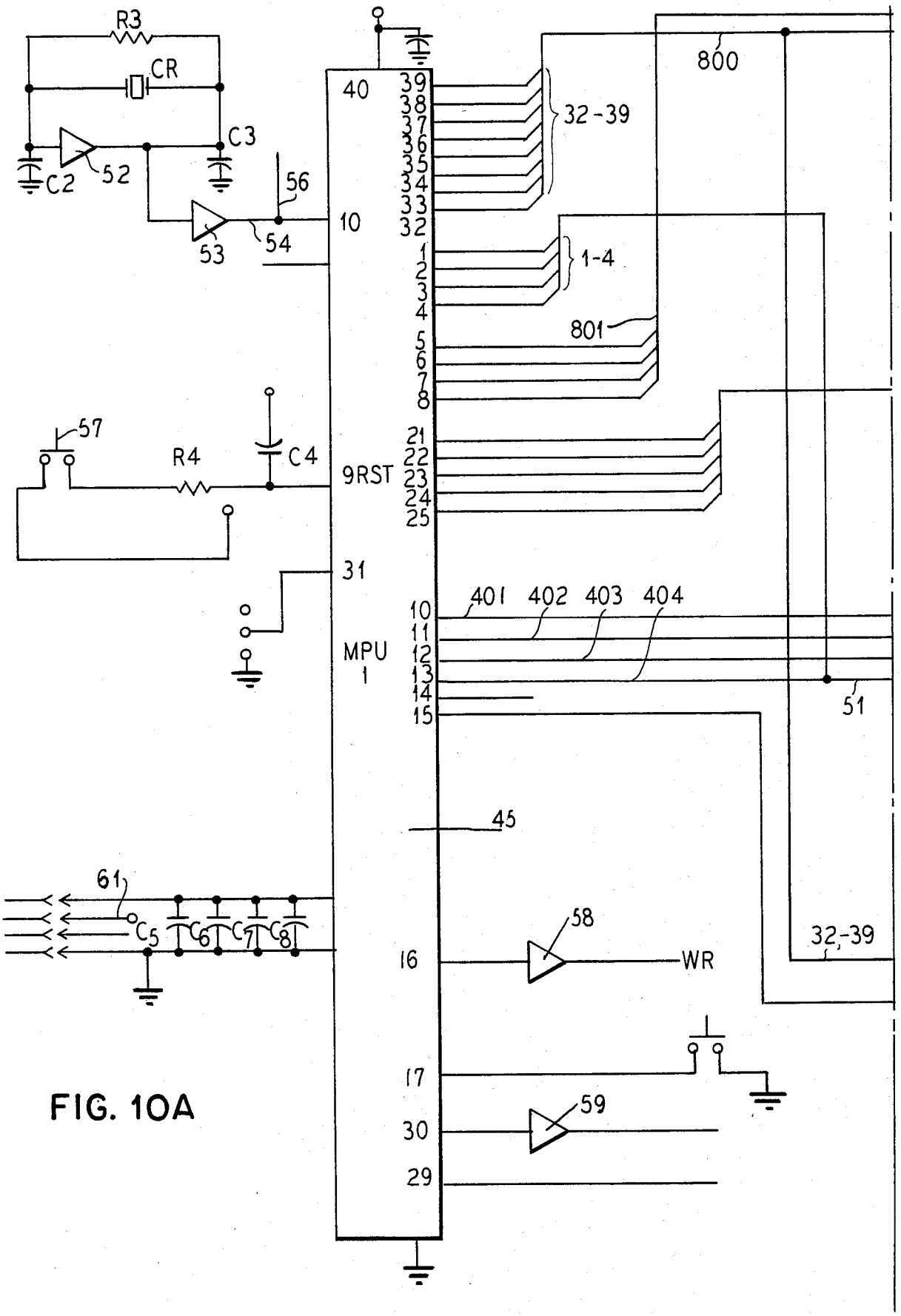
FIGS. 10A and 10B comprise a schematic view of the microcomputer boards.
Figure 10B:
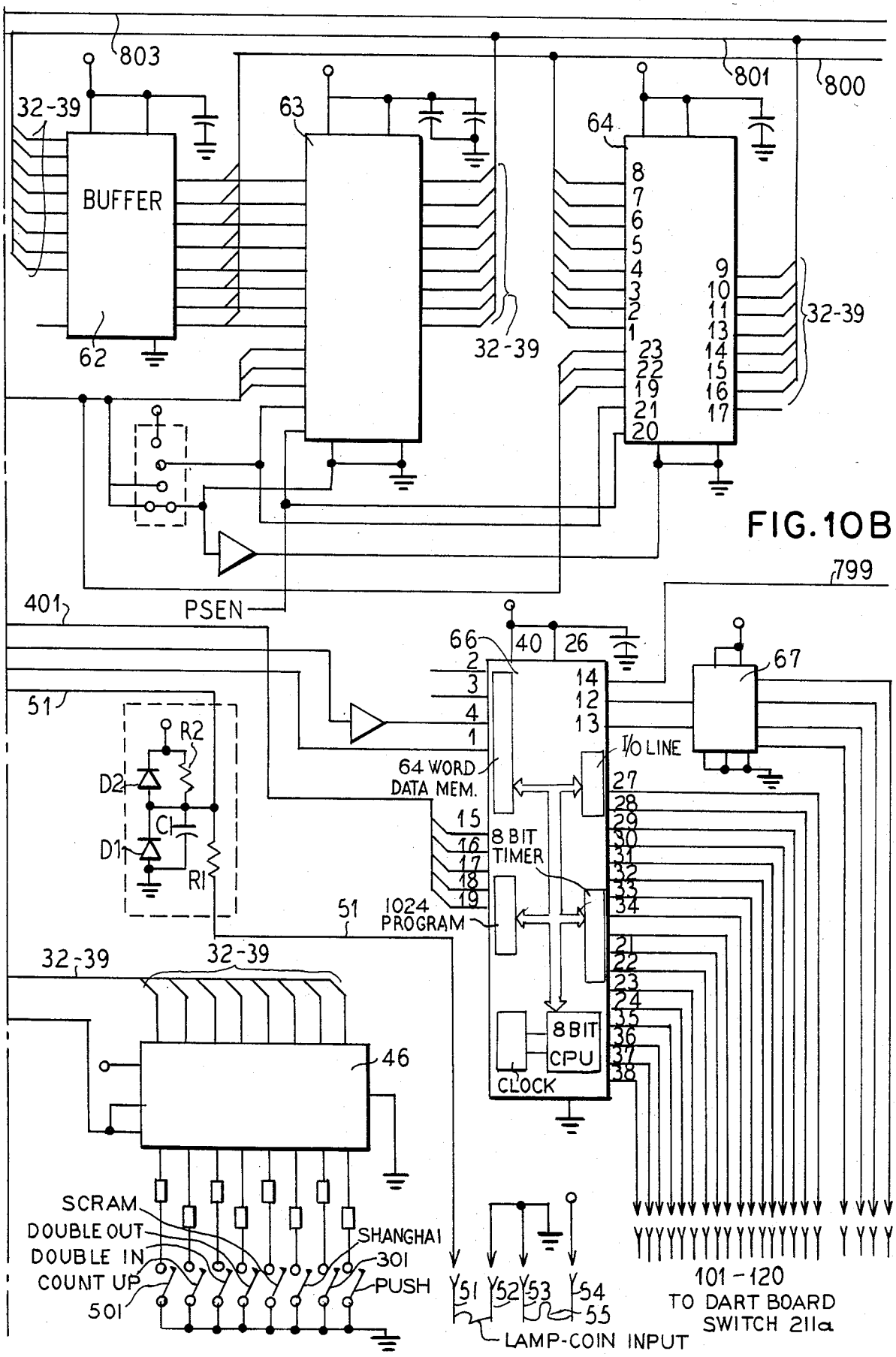

FIGS. 10A and 10B illustrate the leads 101 to 120 which are connected to the dart board switch matrix 211*a* and these leads are connected to a microcomputer 66 which may be an Intel type 8748 which scans the dart board matrix switch to detect when darts strike the target board. The Intel type 8748 includes a clock, an eight bit CPU, a 1024 word program memory, a 64 word data memory, an eight bit timer event counter and 27 input/output lines.

Certain of the leads 101 through 120 are connected to the microcomputer 66 through the unit 67 which may be a type 74LS156. A second microcomputer 45 may be of the type 8031 available from Intel which receives an input from an oscillator on terminal 10 from the crystal CR. The microcomputer 45 can be reset by the reset switch 57 which is connected to terminal 9. Leads 32 through 39 are connected from the microcomputer 45 to a buffer 62 which may be a type 74LS273 and to a unit 63 which may be a type 2716 and to a unit 64 which may be a type 2716. The leads 32 through 39 are also connected to a unit 46 which may be a type 74LS244. The microcomputers 45 and 66 are connected together by leads 401 through 403 as shown.

Figure 11A:
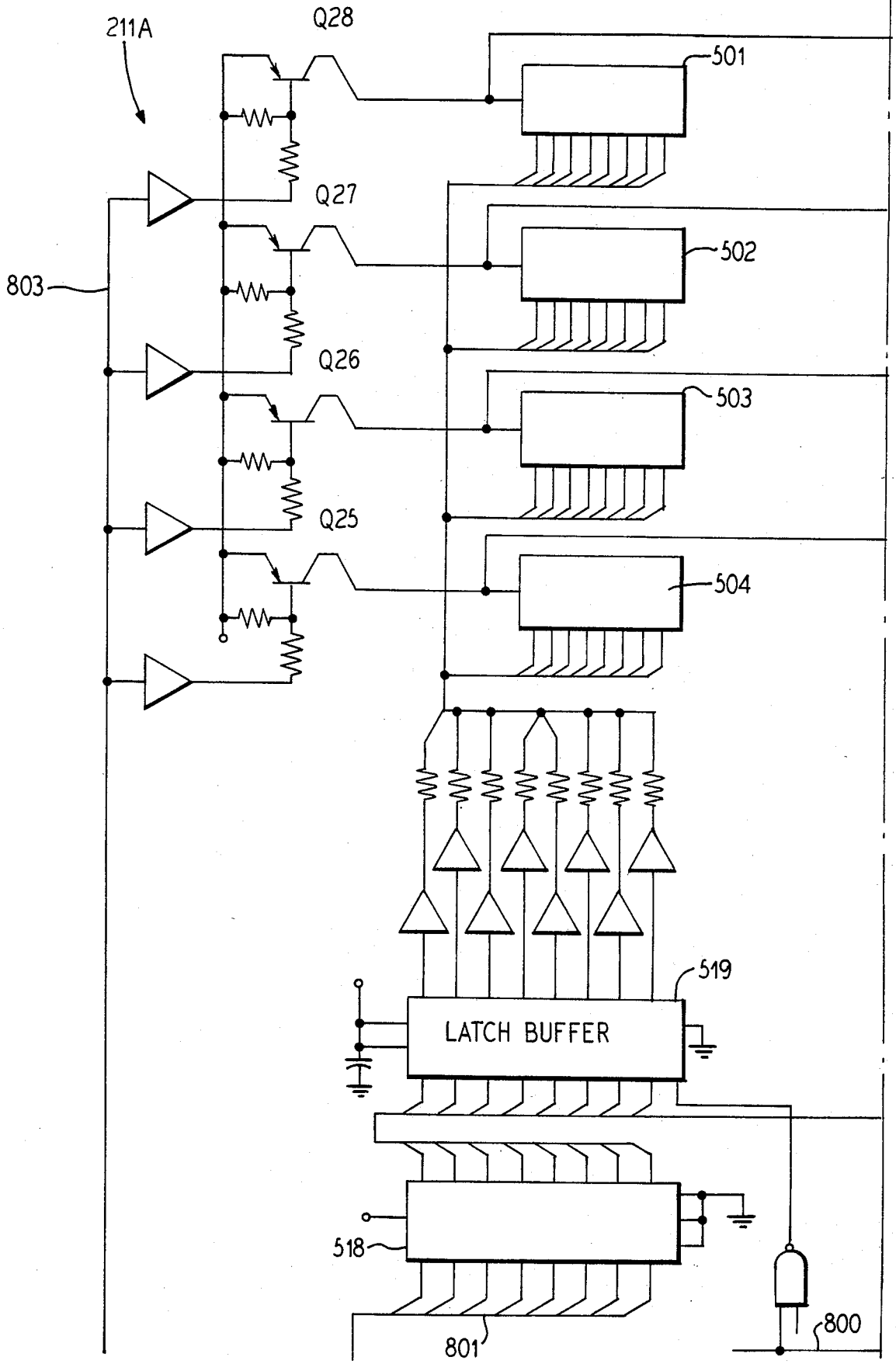
FIGS. 11A, 11B and 11C comprise electrical schematic of the detecting and control boards.
Figure 11B:
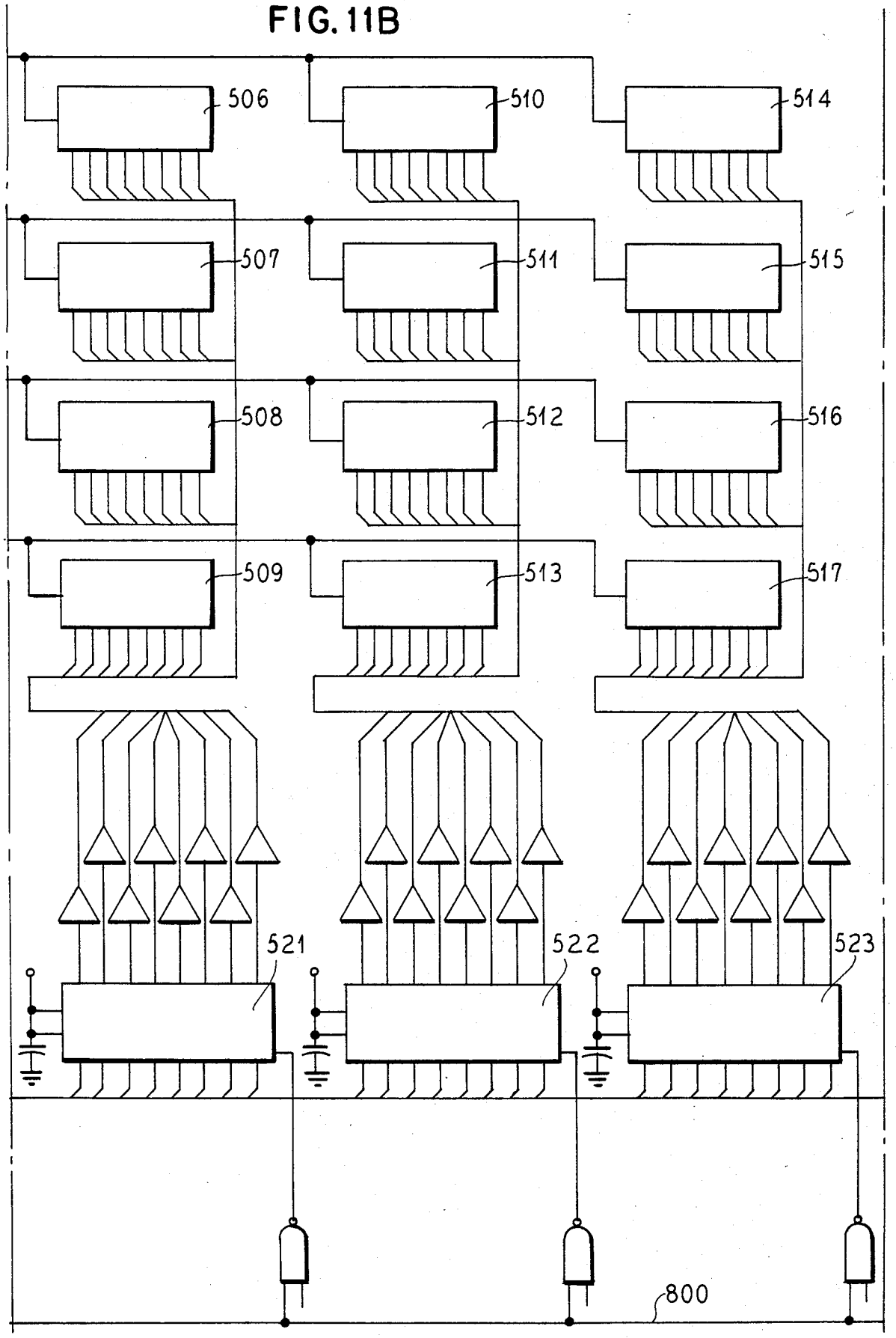
Figure 11C:
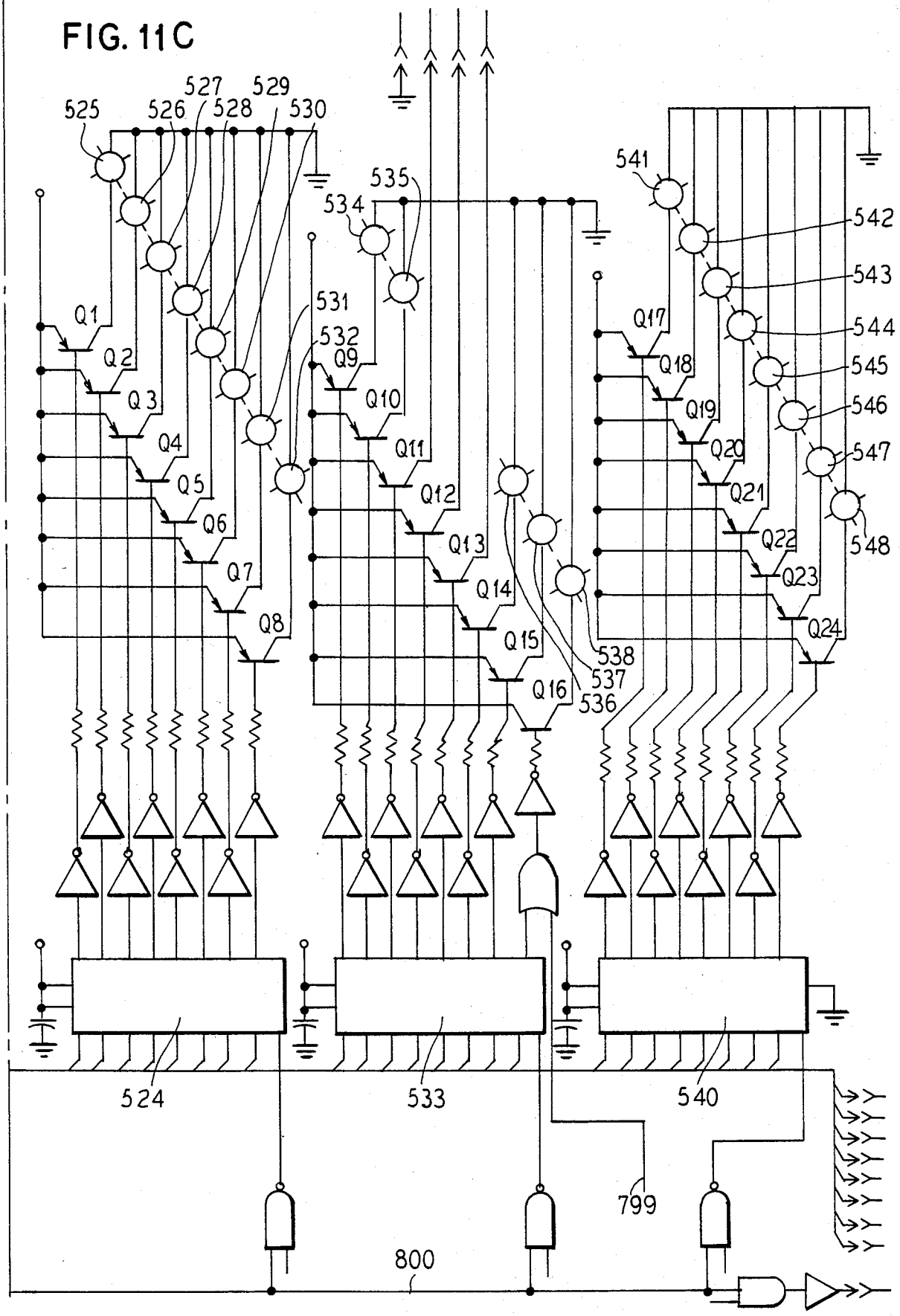

As shown by FIGS. 11A, 11B and 11C, the matrix switch 211 supplies inputs through the transistors Q25, Q26, Q27 and Q28 to displays 501 through 517. Unit 518 is connected to unit 519 and the unit 518 might be a type 74LS244 and the unit 519 may be a latch buffer type 74LS2737 which is connected through suitable driver amplifiers to the displays 501 through 504. The unit 521 is also connected to the unit 518 and might be a type of 74LS273 and drives the displays 506 through 509 through the driver amplifiers illustrated.

The unit 518 is also connected to the unit 522 which might be a type 74LS273 which is connected to the display units 510 through 513. The unit 518 is also connected to unit 523 which might be a type 74LS273 which is connected through suitable drivers to the displays 514 through 517. A unit 524 is connected to unit 518 and might be a type 74LS273 and is connected through suitable drivers to transistors Q1 through Q8 which drive lights 525 through 532 which might be respectively light up the indications which show the temporary score, the throw darts, player number 1, player number 3, player number 4, player number 2, game over, and Push.

A unit 533 is connected to unit 518 and might be a type 74LS273 and is connected through suitable drivers to transistors Q9, Q10, Q14, Q15 and Q16, to drive lamps 534 through 538. Lamp 534 might be "Darts". Lamp 535 might indicate bust, lamp 536 might indicate rounds, and light 538 might indicate remove darts.

The unit 540 which might be a type 74LS173 is connected to unit 518 and is connected through suitable drivers to transistors Q17 through Q24 which drive lights 541 through 548 which might respectively indicate 25 cents, Scram, count-up, 501, 301, shanghai, double-in, and double-out.

The programs for the microcomputers 45 and 66 are attached.

Figure 12:
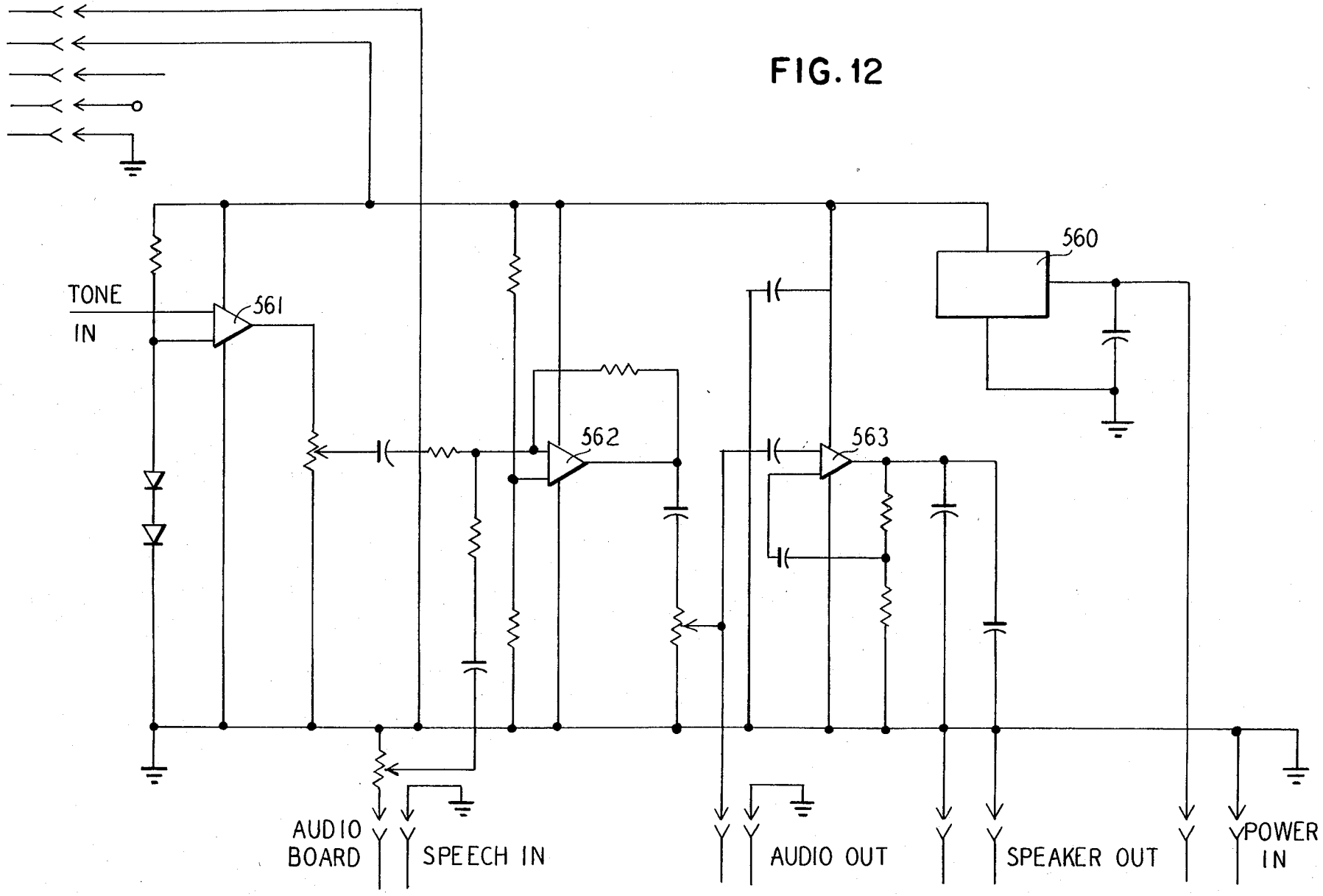
FIG. 12 comprises electrical schematic of the audio board.

FIG. 12 illustrates the audio board and comprises speech in terminals audio out terminals, speaker out terminal and power in terminals and tone-in terminal which are respectively connected to amplifiers 561, 562 and 563. A unit 560 might be a type 7815 is connected as shown and the audio board.

It is to be realized that in use the players deposit coins in the slot 21 and presses the selected switch 36 to choose the game they wish to play. Then the players alternately throw their darts at the target board 13 and the scores are recorded on the scoring indicia 23. As each dart is thrown, if it hits any of the target segments the associated switches in the switch matrix 211*a* will be closed which will be fed to the scanning microcomputer 66 which will then be supplied through the microcomputer 45 to the displays 501 through 517 to indicate the scores of the players.

This continues until the game has ended at which time the game over light 34 will be illuminated and the winner will be indicated.

If points of the darts break off in the target, the matrix 211 can be by taking the nuts 212*a* off of bolts 212 and then the broken points can be pushed through the target.

The software for the microcomputers is such that if a dart is thrown which hits another dart in the board and then is deflected to a second segment only the score in the second segment will result.

The audio board produces an audible sound when a segment is struck.

Although the invention has been described with respect to preferred embodiments, it is not to be so limited as changes and modifications will be made which are within the full intended scope as defined by the appended claims.

PROGRAM FOR MICROPROCESSORS 45 AND 66 FOLLOWS

```
MCS-51 MACRO ASSEMBLER    DRTOS2
1

 ISIS-II MCS-51 MACRO ASSEMBLER V2.0
 OBJECT MODULE PLACED IN :F1:DRTCS2.OBJ
 ASSEMBLER INVOKED BY:  :F4:ASM51 :F1:DRTOS2.REL NOGEN

 LOC  OBJ            LINE     SOURCE

                       1      ;
                       2      ;
                       3      ;       COPYRIGHT 1982 INDUSTRIAL DESIGN ENGINEERING ASSOCIATES, LTD.
                       4      ;                      ALL RIGHTS RESERVED
                       5      ;
                       6      ;*********************************************************************
                       7      ;
                       8      ;       THIS PROGRAM IS FOR THE IDEA DART GAME VERSION 1.0
                       9      ;       START OF PROGRAM 6/15/82 RVN
                      10      ;       FOR USE WITH AN INTEL 8031 CPU W/8K OF CODE PROM
                      11      ;
                      12      ;*************************************************************************
                      13      PUBLIC  INITIALIZE_SYSTEM, INPUT_SWITCHES
                      14      ;
                      15      EXTRN CODE (ALL_LAMPS_OFF, BEEP_BEEP, BIN_TO_DEC, BULL_TONE, BUST)
                      16      EXTRN CODE (CLEAR_DISPLAY, COIN_TONE, DECODE_TABLE, END_TONE, GAME_301)
                      17      EXTRN CODE (GAME_COUNTUP, GAME_SCRAM, GAME_SHANG_HAI, NEXT_TONE, SOUND_GEN)
                      18      EXTRN CODE (STUCK, WIN)
                      19      ;
                      20      ;       INTERNAL RAM EQUATES FOR DISPLAY BUFFERS        (LAST RAM  89 )
                      21      ;       ----------------------------------------
  007F                22      PLYR1_100_BUFR  DATA    127
  007E                23      PLYR2_100_BUFR  DATA    126
  007D                24      PLYR3_100_BUFR  DATA    125
  007C                25      PLYR4_100_BUFR  DATA    124
  007B                26      PLYR1_10_BUFR   DATA    123
  007A                27      PLYR2_10_BUFR   DATA    122
  0079                28      PLYR3_10_BUFR   DATA    121
  0078                29      PLYR4_10_BUFR   DATA    120
  0077                30      PLYR1_1_BUFR    DATA    119
  0076                31      PLYR2_1_BUFR    DATA    118
  0075                32      PLYR3_1_BUFR    DATA    117
  0074                33      PLYR4_1_BUFR    DATA    116
  0073                34      TEMP_100_BUFR   DATA    115
  0072                35      TEMP_1_BUFR     DATA    114
  0071                36      TEMP_10_BUFR    DATA    113
  0070                37      ROUND_DART_BUFR DATA    112
                      38      ;
                      39      $EJECT
```

```
                 40      ;        EQUATES FOR 7-SEGMENT DISPLAY CODE
                 41      ;        ---------------------------------
0001             42      DP       EQU      00000001B
0002             43      XA       EQU      00000010B
0004             44      XB       EQU      00000100B
0008             45      XC       EQU      00001000B
0010             46      XD       EQU      00010000B
0020             47      XE       EQU      00100000B
0040             48      XF       EQU      01000000B
0080             49      XG       EQU      10000000B
                 50      ;
007E             51      ZERO     EQU      XA OR XB OR XC OR XD OR XE OR XF
000C             52      ONE      EQU      XB OR XC
00B6             53      TWO      EQU      XA OR XB OR XD OR XE OR XG
009E             54      THREE    EQU      XA OR XB OR XC OR XD OR XG
00CC             55      FOUR     EQU      XB OR XC OR XF OR XG
00DA             56      FIVE     EQU      XA OR XC OR XD OR XF OR XG
00F8             57      SIX      EQU      XC OR XD OR XE OR XF OR XG
000E             58      SEVEN    EQU      XA OR XB OR XC
00FE             59      EIGHT    EQU      XA OR XB OR XC OR XD OR XE OR XF OR XG
00CE             60      NINE     EQU      XA OR XB OR XC OR XF OR XG
                 61      ;
00EE             62      AA       EQU      XA OR XB OR XC OR XE OR XF OR XG
00FC             63      SD       EQU      XB OR XC OR XD OR XE OR XG
00DA             64      S        EQU      XA OR XC OR XD OR XF OR XG
00B0             65      CC       EQU      XD OR XE OR XG
00A0             66      R        EQU      XE OR XG
00F0             67      TT       EQU      XD OR XF OR XF OR XG
00E6             68      PP       EQU      XA OR XB OR XE OR XF OR XG
00B2             69      E        EQU      XA OR XD OR XE OR XF OR XG
00F8             70      BB       EQU      XC OR XD OR XE OR XF OR XG
0008             71      I        EQU      XC
00A8             72      N        EQU      XC OR XE OR XG
00B8             73      O        EQU      XC OR XD OR XE OR XG
00FC             74      B        EQU      XB OR XC OR XE OR XF OR XG
0070             75      L        EQU      XD OR XE OR XF
0072             76      LC       EQU      XA OR XD OR XE OR XF
007C             77      U        EQU      XB OR XC OR XD OR XE OR XF
                 78      ;
                 79      ;
                 80      $EJECT
                275 ;
00E4 27         276 INITIZ: CLR      A
00E5 B83F       277         MOV      R0,#63
00E7 A0         278 INIT10: MOV      @R0,A
00E8 E8E7       279         DJNZ     R0,INIT10
00EA A0         280         MOV      @R0,A
00EB 23FB       281         MOV      A,#0FBH
00ED 02         282         OUTL     BUS,A
```

```
02FF 0402          283          JMP     HIDIP
                   284 ;
                   285 ;*************************************************************************
                   286 ;
0300               287          ORG     300H
                   288 ;
                   289 ;
0300 44            290          DB      TPL4,0,SGL5,DBL5,SGL20,DBL20,SGL1,DBL1
0301 00
0302 05
0303 25
0304 14
0305 34
0306 01
0307 21
0308 45            291          DB      TPL5,TPL20,TPL1,TPL18,SGL18,DBL18,SGL4,DBL4
0309 54
030A 41
030B 52
030C 12
030D 32
030E 04
030F 24
0310 42            292          DB      TPL2,BE,SGL13,DBL13,SGL6,DBL6,SGL10,DBL10
0311 80
0312 0D
0313 2D
0314 06
0315 26
0316 0A
0317 2A
0318 4D            293          DB      TPL13,TPL6,TPL10,TPL15,SGL15,DBL15,SGL2,DBL2
0319 46
031A 4A
031B 4F
031C 0F
031D 2F
031E 02
031F 22
0320 50            294          DB      TPL16,0,SGL17,DBL17,SGL3,DBL3,SGL19,DBL19
0321 00
0322 11
0323 31
0324 03
0325 23
0326 13
0327 33
0328 51            295          DB      TPL17,TPL3,TPL19,TPL7,SGL7,DBL7,SGL16,DBL16
0329 43
```

```
032A 53
032B 47
032C 07
032D 27
032E 10
032F 30
0330 4C          296        DB      TPL12,0,SGI8,DBL8,SGL11,DBL11,SGL14,DBL14
0331 00
0332 08
0333 28
0334 0B
0335 2B
0336 0E
0337 2E
0338 48          297        DB      TPI8,TPI11,TPI14,TPI9,SGI9,DBL9,SGI12,DBL12
0339 4B
033A 4E
033B 49
033C 09
033D 29
033E 0C
033F 2C
                 298 ;
                 299 ;
0340 434F5059    300        DB      'COPYRIGHT 1982'
0344 52494748
0348 54203139
034C 3832
034E 494E4455    301        DB      'INDUSTRIAL DESIGN ENGINEERING ASSOCIATES, LTD.'
0352 53545249
0356 414C2044
035A 45534947
035E 4E20454E
0362 47494E45
0366 4552494E
036A 47204153
036E 534E4349
0372 41544553
0376 2C204C54
037A 442E
037C 414C4C20    302        DB      'ALL RIGHTS RESERVED'
0380 52494748
0384 54532052
0388 45534552
038C 564544
                 303 ;
                 304        END
```

```
USER SYMBOLS
BE      0080    DBL1    0021    DBL10   002A    DBL11   002B    DBL12   002C    DBL13   002D    DBL14   002E    DBL15   002F
DBL16   0030    DBL17   0031    DBL18   0032    DBL19   0033    DBL2    0022    DBL20   0034    DBL3    0023    DBL4    0024
DBL5    0025    DBL6    0026    DBL7    0027    DBL8    0028    DBL9    0029    DBNC10  0033    DBNC12  003A    DBNC15  003B
DBL16   0030    DBL17   0031    DBL18   0032    DBL19   0033    DBL2    0022    DBL20   0034    DBL3    0023    DBL4    0024
DBL5    0025    DBL6    0026    DBL7    0027    DBL8    0028    DBL9    0029    DBNC10  0033    DBNC12  003A    DBNC15  003B
DBNC20  0040    DEBNC   002E    DEC10   0065    DEC20   0073    DEC30   0075    DECODE  0061    HLDLP   0002    INIT10  00B7
ISIS-II MCS-48/UPI-41 MACRO ASSEMBLER, V4.0              PAGE    8

INITIZ  00E4    LMPOFF  00FB    LMPON   0004    LP1     0006    NUMBER  00FA    QUE     003F    REL00   004C    REL10   004E
REL20   0057    REL30   0058    RELESE  004A    SCAN    000C    SCAN10  0010    SEND    008F    SGL1    0001    SGL10   000A
SGL11   000B    SGL12   000C    SGL13   000D    SGL14   000E    SGL15   000F    SGL16   0010    SGL17   0011    SGL18   0012
SGL19   0013    SGL2    0002    SGL20   0014    SGL3    0003    SGL4    0004    SGL5    0005    SGL6    0006    SGL7    0007
SGL8    0008    SGL9    0009    SND0    0092    SND10   009E    SND20   00A0    SND30   00AC    SNDRET  00AA    STK0    00B5
STK1    00BA    STK10   00C9    STK2    00BB    STK20   00CC    STK30   00DB    STK40   00DD    STKRET  00D6    STUCK   00B0
TIME    0083    TIME00  0085    TIME2   0089    TMIP    008B    TPL1    0041    TPL10   004A    TPL11   004B    TPL12   004C
TPL13   004D    TPL14   004E    TPL15   004F    TPL16   0050    TPL17   0051    TPL18   0052    TPL19   0053    TPL2    0042
TPL20   0054    TPL3    0043    TPL4    0044    TPL5    0045    TPL6    0046    TPL7    0047    TPL8    0048    TPL9    0049
WAIT    0077    WAIT10  0079    WAIT20  007B
ASSEMBLY COMPLETE,   NO ERRORS

LOC  OBJ            LINE     SOURCE

                    1402     ;*****************************************************************************
                    1403     ;
                    1404     ;                          < GAME OF SCRAM >
                    1405     ;
                    1406     GAME_SCRAM:     %SELREG
                    1410     ;
06AD 300003         1411                     JNB     DBL_IN_FLAG,SCRAM0
06B0 020000    F    1412                     JMP     SCRAM1
06B3 300108         1413     SCRAM0:         JNB     DBL_OUT_FLAG,SCRAM2
```

```
                        1414    ;
06B6 E562               1415    SCRAM1:     MOV     A,COIN_COUNT            ;DIVIDE COIN_COUNT BY 2
06B8 75F002             1416                MOV     B,#2
06BB 84                 1417                DIV     AB
06BC F562               1418                MOV     COIN_COUNT,A
                        1419    ;
06BE 7B04               1420    SCRAM2:     MOV     R3,#4                   ;LOAD MAX PLAYERS INTO R3
06C0 78ED               1421                MOV     R0,#PLYR1_SCORE_L       ;INITIALIZE THE PLAYER
06C2 7600               1422    SCRAM10:    MOV     @R0,#0                  ;  DISPLAYS
06C4 18                 1423                DEC     R0
06C5 7600               1424                MOV     @R0,#0
06C7 120000     F       1425                CALL    DISPLAY_SCORE
06CA 055A               1426                INC     PLAYER_COUNT
06CC 18                 1427                DEC     R0
06CD 18                 1428                DEC     R0
06CE D56203             1429                DJNZ    COIN_COUNT,SCRAM15
06D1 020000     F       1430                JMP     SCRAM16
06D4 DBEC               1431    SCRAM15:    DJNZ    R3,SCRAM10
                        1432    ;
06D6 756200             1433    SCRAM16:    MOV     COIN_COUNT,#0
06D9 120000     F       1434                CALL    CLEAR_TEMP
06DC 436501             1435                ORL     BANK1_REG,#TEMP_SCORE_LAMP
06DF 754D01             1436                MOV     ROUND_COUNT,#1
                        1437    ;
06E2 7D01               1438                MOV     R5,#1           ;SET 1 DART IN R5 FOR SETUP
06E4 755600             1439    SCRAM20:    MOV     LAMP_PNTR,#0
06E7 E55A               1440                MOV     A,PLAYER_COUNT          ;DOUBLE THE PLAYER COUNT
06E9 23                 1441                RL      A                       ; AND PUT INTO R7
06EA FF                 1442    SCRAM23:    MOV     R7,A
                        1443    ;
06EB E55A               1444    SCRAM25:    MOV     A,PLAYER_COUNT  ;GET THE NUMBER OF PLAYERS
06ED 20E206             1445                JB      ACC.2,SCRAM26   ;JUMP FOR 4 PLAYERS
06F0 900000     F       1446                MOV     DPTR,#SCRAM_TABLE1
06F3 020000     F       1447                JMP     SCRAM27
                        1448    ;
06F6 900000     F       1449    SCRAM26:    MOV     DPTR,#SCRAM_TABLE2
                        1450    ;
06F9 ED                 1451    SCRAM27:    MOV     A,R5            ;CHECK IF NO DARTS THROWN
06FA 6007               1452                JZ      SCRAM30         ;JUMP FOR ALL DARTS THROWN
06FC 6403               1453                XRL     A,#3
06FE 700C               1454                JNZ     SCRAM50         ;JUMP IF SOME DARTS THROWN
[illegible] 020000      1455                JMP     SCRAM60         ;JUMP FOR PLYR CHNG BUT PUSHED
                        1456    ;
[illegible] 5F80        1457    SCRAM30:    ORL     BANK1_FLASH_REG,#PLYR_CHANGE_LAMP
  0000          F       1458    SCRAM40:    CALL    INPUT_SWITCHES
  2E7FA                 1459                JNB     PLAYER_CHANGE_BUTTON,SCRAM40
                        1460    ;
070C 5365C3             1461    SCRAM50:    ANL     BANK1_REG,#PLAYER_LAMPS_OFF
070F 535F7F             1462                ANL     BANK1_FLASH_REG,#(NOT PLYR_CHANGE_LAMP)
0712 53657D             1463                ANL     BANK1_REG,#NOT(PLYR_CHANGE_LAMP OR THROW_DARTS_LAMP)
```

```
0715 435F80          1464                ORL     BANK2_FLASH_REG,#REMOVE_DARTS_LAMP
0718 F54D            1465                MOV     A,ROUND_COUNT
071A 120000    F     1466                CALL    DISPLAY_DARTS_OR_ROUND
071D 5364FF          1467                ANL     BANK2_REG,#(NOT DARTS_THROWN_LAMP)
0720 436420          1468                ORL     BANK2_REG,#GAME_ROUND_LAMP
                     1469     ;
0723 F556            1470     SCRAM55:   MOV     A,LAMP_PNTR            ;FLASH THE NEXT PLYR'S LAMP
0725 93              1471                MOVC    A,@A+DPTR
0726 425F            1472                ORL     BANK1_FLASH_REG,A
                     1473     ;
                     1474                %WAIT(TEN_SEC)
                     1479     ;
0730 535FC3          1480     SCRAM60:   ANL     BANK1_FLASH_REG,#PLAYER_LAMPS_OFF
0733 5365C3          1481                ANL     BANK1_REG,#PLAYER_LAMPS_OFF
0736 535F7F          1482                ANL     BANK2_FLASH_REG,#(NOT REMOVE_DARTS_LAMP)
0739 53645F          1483                ANL     BANK2_REG,#NOT(REMOVE_DARTS_LAMP OR GAME_ROUND_LAMP)
073C 436401          1484                ORL     BANK2_REG,#DARTS_THROWN_LAMP
073F 436502          1485                ORL     BANK1_REG,#THROW_DARTS_LAMP
                     1486     ;
0742 208C13          1487                %PLAY(NEXT_TONE)
0759 120000    F     1498                CALL    CLEAR_TEMP
                     1499     ;
075C F556            1500     SCRAM65:   MOV     A,LAMP_PNTR            ;TURN ON CURRENT PLAYER LAMP
075E 93              1501                MOVC    A,@A+DPTR
075F 4265            1502                ORL     BANK1_REG,A
                     1503     ;
0761 301729          1504                JNB     SCORE_FLAG,SCRAM66     ;JUMP IF NOT SCORING
0764 0556            1505                INC     LAMP_PNTR
0766 F556            1506                MOV     A,LAMP_PNTR            ;GET CURRENT PLAYER'S SCORE
0768 93              1507                MOVC    A,@A+DPTR              ; POINTER INTO R3
0769 FB              1508                MOV     R3,A
                     1509     ;
076A 0556            1510                INC     LAMP_PNTR              ;PUT SCR ON PLAYERS SCORE LEDS
076C F556            1511                MOV     A,LAMP_PNTR
076E 93              1512                MOVC    A,@A+DPTR
076F F8              1513                MOV     R0,A
0770 76DA            1514                MOV     @R0,#S
0772 24FC            1515                ADD     A,#-4
0774 F8              1516                MOV     R0,A
0775 76B0            1517                MOV     @R0,#CC
0777 24FC            1518                ADD     A,#-4
0779 F8              1519                MOV     R0,A
077A 76A0            1520                MOV     @R0,#R
                     1521     ;
077C 0556            1522                INC     LAMP_PNTR
077E F556            1523                MOV     A,LAMP_PNTR
0780 93              1524                MOVC    A,@A+DPTR
0781 F8              1525                MOV     R0,A
0782 C082            1526                PUSH    DPL                    ;STORE THE DATA POINTER
0784 C083            1527                PUSH    DPH
0786 120000    F     1528                CALL    DISPLAY_SCORE
```

```
0789 D083                 POP     DPH
078B D082                 POP     DPL
                  ;
078D 201719       SCRAM66:  JB      SCORE_FLAG,SCRAM67      ;JUMP IF SCORING
0790 0556                 INC     LAMP_PNTR               ;GET CURRENT STOP REG INTO PNTR
0792 E556                 MOV     A,LAMP_PNTR
0794 93                   MOVC    A,@A+DPTR
0795 F549                 MOV     STOP_PNTR,A
                  ;
0797 0556                 INC     LAMP_PNTR       ;PUT STP ON PLAYERS DISPLAY
0799 E556                 MOV     A,LAMP_PNTR
079B 93                   MOVC    A,@A+DPTR
079C F8                   MOV     R0,A
079D 76DA                 MOV     @R0,#S
079F 24FC                 ADD     A,#-4
07A1 F8                   MOV     R0,A
07A2 76F0                 MOV     @R0,#TT
07A4 24FC                 ADD     A,#-4
07A6 F8                   MOV     R0,A
07A7 76E6                 MOV     @R0,#PP
                  ;
07A9 7D03         SCRAM67:  MOV     R5,#3           ;RESET DART COUNT FOR NE PLAYER
                  ;
                          %SCAN
                  ;
07AD ED           SCRAM70:  MOV     A,R5
07AE 120000    F          CALL    DISPLAY_DARTS_OR_ROUND
                  ;
07C1 120000    F  SCRAM75:  CALL    INPUT_SWITCHES
07C4 30E703               JNB     PLAYER_CHANGE_BUTTON,SCRAM80
07C7 020000    F          JMP     SCRAM95A
                  ;
07CA E559         SCRAM80:  MOV     A,DART_BUFFER
07CC 60F3                 JZ      SCRAM75
07CE B4FF03               CJNE    A,#0FFH,SCRAM90
07D1 120000    F          CALL    STUCK
                  ;
07D4 FE           SCRAM90:  MOV     R6,A    ;TEMP STORE THE DART CODE
07D5 755900               MOV     DART_BUFFER,#0
07D8 301703               JNB     SCORE_FLAG,SCRAM90A     ;JUMP FOR SCORE ROUND
07DB 020000    F          JMP     SCRAM130
                  ;
07DE 900000    F  SCRAM90A: MOV     DPTR,#DECODE_TABLE      ;DISPLAY THE SECTOR CLOSED
07E1 EE                   MOV     A,R6                    ;GET THE DART CODE
07E2 B48003               CJNE    A,#80H,SCRAM91          ;JUMP IF NOT BULL
07E5 020000    F          JMP     SCRAM92                 ;JUMP FOR BULL
07E8 541F         SCRAM91:  ANL     A,#1FH                  ;MASK ALL BUT SECTOR
07EA 120000    F          CALL    BIN_TO_DEC              ;CONVERT TO BCD
07ED E557                 MOV     A,DART_SCORE
```

```
07EF 540F                 ANL     A,#0FH                  ;MASK OUT THE ONES DIGIT
07F1 93                   MOVC    A,@A+DPTR               ;GET 7-SEG CODE
07F2 F572                 MOV     TEMP_1_BUFR,A           ;PUT CODE IN DISPLAY BUFFER
07F4 E557                 MOV     A,DART_SCORE
07F6 54F0                 ANI     A,#0F0H                 ;MASK OUT THE TENS DIGIT
07F8 7005                 JNZ     SCRAM91A
07FA 7400                 MOV     A,#0
07FC 020000    F          JMP     SCRAM91B
07FF C4          SCRAM91A:SWAP    A                       ;SWAP THE NIBBLES FOR LOOKUP
0800 93                   MOVC    A,@A+DPTR               ;GET 7-SEG CODE
0801 F571        SCRAM91B:MOV     TEMP_10_BUFR,A          ;PUT CODE IN DISPLAY BUFFER
0803 020000    F          JMP     SCRAM93
                 ;
0806 7571F8      SCRAM92: MOV     TEMP_10_BUFR,#BB        ;DISPLAY 'B'
0809 7572F2                MOV     TEMP_1_BUFR,#E          ;DISPLAY 'E'
                 ;
080C 120000    F SCRAM93: CALL    CHECK_STOP      ;SET BIT FOR SECTOR IN STOP REG
                 ;
080F DDAC        SCRAM95: DJNZ    R5,SCRAM70      ;DEC DART COUNT AND DISPLAY IT
                 ;
                 SCRAM95A:%STOP_SCAN
                 ;
081E ED                   MOV     A,R5            ;GET DART COUNT AND DISPLAY
081F 120000    F          CALL    DISPLAY_DARTS_OR_ROUND
                 ;
0822 B217                 CPI     SCORE_FLAG
                 ;
0824 208C13               %PLAY(END_TONE)         ;PLAY TONE FOR END OF PLAYERS TURN
                 ;
083B DF1C                 DJNZ    R7,SCRAM105     ;DEC THE PLAYER COUNT JUMP IF NOT
                 ;                                   END OF ROUND
083D 054D                 INC     ROUND_COUNT     ;INC THE ROUND COUNT
083F E54D                 MOV     A,ROUND_COUNT   ;CHECK FOR LAST ROUND
                 ;
0841 300003               JNB     DBL_IN_FLAG,SCRAM96  ;JUMP IF NOT DBL IN
0844 020000    F          JMP     SCRAM97
                 ;
0847 300106      SCRAM96: JNB     DBL_OUT_FLAG,SCRAM98 ;JUMP IF NOT DBL OUT
                 ;
084A B40809      SCRAM97: CJNE    A,#8,SCRAM99  ;CHECK FOR END OF .50 GAME
084D 020000    F          JMP     SCRAM190        ;FIND WINNER IF TRUE
                 ;
0850 B40403      SCRAM98: CJNE    A,#4,SCRAM99  ;CHECK FOR END OF .25 GAME
0853 020000    F          JMP     SCRAM190        ;FIND WINNER IF TRUE
                 ;
0856 020000    F SCRAM99: JMP     SCRAM20         ;RESET PNTRS FOR NEXT ROUND
                 ;
0859 0556        SCRAM105:INC     LAMP_PNTR
085B 020000    F          JMP     SCRAM25         ;LOOP FOR NEXT PLAYER
```

```
                        ;
085F 120000   F         SCRAM130:   CALL    CHECK_STOP          ;CHECK IF SECTOR IS BLOCKED
                        ;
0861 301806                         JNB     STOP_FLAG,SCRAM135      ;JUMP IF SECTOR OPEN
0864 C218                           CLR     STOP_FLAG
0866 D214                           SETB    BUST_FLAG
0868 80A5                           JMP     SCRAM95
                        ;
086A FE                 SCRAM135:   MOV     A,R6                ;GET THE DART CODE
                        ;
086B 30E506                         JNB     DBL_DART,SCRAM140       ;JUMP IF NOT DOUBLE
086E 75F002                         MOV     B,#2
0871 020000   F                     JMP     SCRAM180            ;GET THE DOUBLE SCORE
                        ;
0874 30E606             SCRAM140:   JNB     TPL_DART,SCRAM150       ;JUMP IF NOT TRIPLE
0877 75F003                         MOV     B,#3
087A 020000   F                     JMP     SCRAM180            ;GET THE TRIPLE SCORE
                        ;
087D 30E708             SCRAM150:   JNB     BULLS_EYE,SCRAM160      ;JUMP IF NOT BULLS EYE
0880 D213                           SETB    BULL_FLAG
0882 755732                         MOV     DART_SCORE,#32H         ;SCORE THE BULLS EYE
0885 020000   F                     JMP     SCRAM170
                        ;
0888 541F               SCRAM160:   ANL     A,#1FH                  ;MASK ALL BUT SCORE
088A F557                           MOV     DART_SCORE,A
                        ;
088C E557               SCRAM170:   MOV     A,DART_SCORE
088E 120000   F                     CALL    BIN_TO_DEC
                        ;
0891 7957                           MOV     R1,#DART_SCORE          ;ADD DART SCORE TO TEMP SCORE
0893 786F                           MOV     R0,#TEMP_SCORE_L
0895 120000   F                     CALL    BCD_ADD
0898 120000   F                     CALL    DISPLAY_TEMP
                        ;
089B FB                             MOV     A,R3                ;GET THE PLAYER POINTER
089C F8                             MOV     R0,A                ;  INTO R0
089D 7957                           MOV     R1,#DART_SCORE      ;ADD DART SCORE TO CURRENT PLAYER
089F 120000   F                     CALL    BCD_ADD             ;  SCORE
08A2 120000   F                     CALL    DISPLAY_SCORE
                        ;
08A5 020000   F                     JMP     SCRAM95             ;LOOP FOR NEXT DART OR ROUND
                        ;
08A8 FE                 SCRAM180:   MOV     A,R6                ;GET THE DART CODE
08A9 541F                           ANL     A,#1FH              ;MASK ALL BUT SECTOR NUMBER
08AB A4                             MUL     AB
08AC F557                           MOV     DART_SCORE,A        ;GET TOTAL SCORE
08AE 80DC                           JMP     SCRAM170
                        ;
08B0 786D               SCRAM190:   MOV     R0,#PLYR1_SCORE_L
```

```
08B2 7969                 MOV     R1,#PLYR3_SCORE_L
08B4 1208                 SETB    DOUBLE_BYTE
08B6 120000    F          CALL    BCD_ADD
08B9 78EB                 MOV     R0,#PLYR2_SCORE_L
08BB 7967                 MOV     R1,#PLYR4_SCORE_L
08BD 120000    F          CALL    BCD_ADD
08C0 020000    F          JMP     END_GAME
                 ;-----------------------------------------------------------------------
                 ;
08C3 C01B        CHECK_STOP:  PUSH  B3_REG3
08C5 C01C                   PUSH    B3_REG4
                 ;
08C7 A849                   MOV     R0,STOP_PNTR      ;GET THE STOP REG PNTR INTO R0
08C9 7B00                   MOV     R3,#0             ;INIT THE DART SECTOR CHECK REG
                 ;
08CB 7C01        CHK_STP_10:  MOV    R4,#1             ;RESET THE SECTOR BIT CHECK MASK
                 ;
08CD EE          CHK_STP_15:  MOV    A,R6              ;GET THE DART CODE
08CE 541F                   ANI     A,#1FH            ;MASK ALL BUT SECTOR NUMBER
08D0 B51B13                 CJNE    A,B3_REG3,CHK_STP_30    ;COMPARE SECTOR WITH REG
                 ;
08D3 FC                     MOV     A,R4              ;GET THE BIT CHECK MASK
08D4 30170B                 JNB     SCORE_FLAG,CHK_STP_20   ;JUMP IF SCORING
08D7 56                     ANI     A,@R0             ;CHECK IF BIT SET IN STOP REG
08D8 6007                   JZ      CHK_STP_RET       ;JUMP IF NOT SET
08DA D21B                   SETB    STOP_FLAG         ;SET BIT TO INDICATE STOP SECTOR
08DC 020000    F            JMP     CHK_STP_RET
                 ;
08DF 46          CHK_STP_20:  ORL    A,@R0             ;SET THE BIT FOR STOPPED SECTOR
08E0 F6                     MOV     @R0,A
                 ;
08E1 D01C        CHK_STP_RET: POP    B3_REG4
08E3 D01B                   POP     B3_REG3
08E5 22                     RET
                 ;
08E6 0B          CHK_STP_30:  INC    R3                ;INC THE SECTOR CHECK REG
08E7 BB1502                 CJNE    R3,#LAST_CHECK,CHK_STP_40
08EA 80F5                   JMP     CHK_STP_RET
                 ;
08EC C3          CHK_STP_40:  CLR    C                 ;SHIFT THE BIT CHECK MASK
08ED FC                     MOV     A,R4
08EE 33                     RLC     A
08EF FC                     MOV     R4,A
08F0 50DB                   JNC     CHK_STP_15        ;JUMP IF NOT LAST BIT IN STOP REG
08F2 1E                     DEC     R0                ;INC THE SECTOR CHECK REG
08F3 80D6                   JMP     CHK_STP_10
                 ;
                 ;-----------------------------------------------------------------------
                 ;
```

```
08F5 04          SCRAM_TABLE1:  DB    PLAYER1_LAMP
08F6 45                         DB    STOP_REG2A
08F7 7F                         DB    PLYR1_100_BUFR
                 ;
08F8 20                         DB    PLAYER2_LAMP
08F9 6E                         DB    PLYR2_SCORE_L
08FA 7E                         DB    PLYR2_100_BUFR
08FB 6C                         DB    PLYR1_SCORE_H
                 ;
08FC 20                         DB    PLAYER2_LAMP
08FD 48                         DB    STOP_REG1A
08FE 7E                         DB    PLYR2_100_BUFR
                 ;
08FF 04                         DB    PLAYER1_LAMP
0900 6D                         DB    PLYR1_SCORE_L
0901 7F                         DB    PLYR1_100_BUFR
0902 6A                         DB    PLYR2_SCORE_H
                 ;
0903 04          SCRAM_TABLE2:  DB    PLAYER1_LAMP          ;#1 THROWS STOPS FOR #2
0904 45                         DB    STOP_REG2A
0905 7F                         DB    PLYR1_100_BUFR
                 ;
0906 20                         DB    PLAYER2_LAMP          ;#2 THROWS SCORES
0907 6E                         DB    PLYR2_SCORE_L
0908 7E                         DB    PLYR2_100_BUFR
0909 6C                         DB    PLYR1_SCORE_H
                 ;
090A 08                         DB    PLAYER3_LAMP          ;#3 THROWS STOPS FOR #4
090B 3F                         DB    STOP_REG4A
090C 7D                         DB    PLYR3_100_BUFR
                 ;
090D 10                         DB    PLAYER4_LAMP          ;#4 THROWS SCORES
090E 67                         DB    PLYR4_SCORE_L
090F 7C                         DB    PLYR4_100_BUFR
0910 68                         DB    PLYR3_SCORE_H
                 ;
0911 20                         DB    PLAYER2_LAMP          ;#2 THROWS STOPS FOR #1
0912 48                         DB    STOP_REG1A
0913 7E                         DB    PLYR2_100_BUFR
                 ;
0914 04                         DB    PLAYER1_LAMP          ;#1 THROWS SCORES
0915 6D                         DB    PLYR1_SCORE_L
0916 7F                         DB    PLYR1_100_BUFR
0917 6A                         DB    PLYR2_SCORE_H
                 ;
0918 10                         DB    PLAYER4_LAMP          ;#4 THROWS STOPS FOR #3
0919 42                         DB    STOP_REG3A
091A 7C                         DB    PLYR4_100_BUFR
                 ;
```

```
091B 08                 DB      PLAYER3_LAMP            ;#3 THROWS SCORES
091C 69                 DB      PLYR3_SCORE_L
091D 7D                 DB      PLYR3_100_BUFR
091E 66                 DB      PLYR4_SCORE_H
                ;
                ;*****************************************************************
                $EJECT
                ;*****************************************************************
                ;
091F 5365FD     STUCK:          ANI     BANK1_REG,#(NOT THROW_DARTS_LAMP)
0922 208C13     STUCK0:         %PLAY(STUCK_TONE)
0939 3007FD     STUCK10:        JNB     TONE_FLAG,STUCK10
093C E559                       MOV     A,DART_BUFFER
093E B4FF0A                     CJNE    A,#0FFH,STUCK_RET
0941 755B05                     MOV     TIMER_REG,#05
0944 C204                       CLR     TIMER_FLAG
0946 3004FD     STUCK20:        JNB     TIMER_FLAG,STUCK20
0949 80D7                       JMP     STUCK0
094B 436502     STUCK_RET:      ORL     BANK1_REG,#THROW_DARTS_LAMP
094E 22                         RET
                ;
                ;*****************************************************************
094F 756F00     CLEAR_TEMP:     MOV     TEMP_SCORE_L,#0
0952 756E00                     MOV     TEMP_SCORE_H,#0
0955 120000     F               CALL    DISPLAY_TEMP
0958 22                         RET
                ;
                ;*****************************************************************
                ;
0959 C0E0       SOUND_GEN:      PUSH    ACC
095B C0D0                       PUSH    PSW
095D C082                       PUSH    DPL
095F C083                       PUSH    DPH
                                %SELRB2
0966 201D09                     JB      TEST_TONE,SND_GEN
0969 201A3C                     JB      GEN2,SOUND30
096C 200575                     JB      PAUSE_FLAG,PAUSE10
096F 20070F                     JB      TONE_FLAG,SOUND10
0972 DA04       SND_GEN:        DJNZ    R2,SOUND_RET
0974 AA53                       MOV     R2,IV
0976 B2B4       SOUND0:         CPL     TONE_OUT
                ;
0978 D083       SOUND_RET:      POP     DPH
097A D082                       POP     DPL
097C D0D0                       POP     PSW
097E D0E0                       POP     ACC
0980 32                         RETI
                ;
0981 855182     SOUND10:        MOV     DPL,TUNE_L
```

```
0984 85508B          1866                    MOV     DPH,TUNE_H
0987 E552            1867                    MOV     A,TONE_PTR
0989 93              1868                    MOVC    A,@A+DPTR
098A 603C            1869                    JZ      SOUND_END
098C B4FF03          1870                    CJNE    A,#0FFH,SOUND20
098F 020000    F     1871                    JMP     PAUSE
0992 F58C            1872    SOUND20:        MOV     TH0,A
0994 0552            1873                    INC     TONE_PTR
0996 E552            1874                    MOV     A,TONE_PTR
0998 93              1875                    MOVC    A,@A+DPTR
0999 F553            1876                    MOV     DV,A
099B 0552            1877                    INC     TONE_PTR
099D E552            1878                    MOV     A,TONE_PTR
099F 93              1879                    MOVC    A,@A+DPTR
09A0 F54F            1880                    MOV     TONE_LENGTH,A
09A2 C207            1881                    CLR     TONE_FLAG
09A4 0552            1882                    INC     TONE_PTR
09A6 80D0            1883                    JMP     SOUND_RET
                     1884    ;
09A8 201909          1885    SOUND30:        JB      LOAD,SOUND40
09AB D219            1886                    SETB    LOAD
09AD 7A80            1887    SOUND31:        MOV     R2,#128
09AF 754F01          1888                    MOV     TONE_LENGTH,#1
09B2 C207            1889                    CLR     TONE_FLAG
                     1890    ;
09B4 EA              1891    SOUND40:        MOV     A,R2
09B5 F58C            1892    SOUND41:        MOV     TH0,A
09B7 3007BC          1893                    JNB     TONE_FLAG,SOUND0
09BA 754F01          1894                    MOV     TONE_LENGTH,#1
09BD C207            1895                    CLR     TONE_FLAG
                     1896    ;
09BF EA              1897    SOUND50:        MOV     A,R2
09C0 C3              1898                    CLR     C
09C1 9404            1899                    SUBB    A,#4
09C3 6003            1900                    JZ      SOUND_END
09C5 FA              1901                    MOV     R2,A
09C6 80BD            1902                    JMP     SOUND41
                     1903    ;
09C8 C28C            1904    SOUND_END:      CLR     TR0
09CA D2B4            1905                    SETB    TONE_OUT
09CC 755200          1906                    MOV     TONE_PTR,#0
09CF C219            1907                    CLR     LOAD
09D1 C21A            1908                    CLR     GEN2
09D3 80A3            1909                    JMP     SOUND_RET
                     1910    ;
09D5 D205            1911    PAUSE:          SETB    PAUSE_FLAG
09D7 D2B4            1912                    SETB    TONE_OUT
09D9 0552            1913                    INC     TONE_PTR
09DB 758C01          1914                    MOV     TH0,#01H
```

```
09DE 7F46          1915                    MOV     R3,#70
09E0 7C07          1916                    MOV     R4,#7
09E2 8094          1917                    JMP     SOUND_RET
                   1918     ;
09E4 DF92          1919     PAUSE10:       DJNZ    R3,SOUND_RET
09E6 7F46          1920                    MOV     R3,#70
09E8 DC8E          1921                    DJNZ    R4,SOUND_RET
09EA C205          1922                    CLR     PAUSE_FLAG
09EC 8093          1923                    JMP     SOUND10
                   1924     ;
                   1925     ;*****************************************************************************
                   1926     ;
09EE 11            1927     BUST:          DB      TC,32,15H,0
09EF 20
09F0 15
09F1 00
                   1928     ;
09F2 11            1929     PULL_TONE:     DB      TC,4,1,TF,4,1,TG,4,1,TC,2,2,TC,4,1,TC,2,2,0
09F3 04
0A25 01
0A26 00
                   1942     ;
0A27 26            1943     WIN:           DB      TD,8,1,TDS,8,1,TE,8,1,TC,4,2,TE,8,1,TC,4,2,TE,8,1
0A28 08
0A29 01
0A2A 37
0A2B 08
0A2C 01
0A2D 43
0A2E 08
0A2F 01
0A30 11
0A31 04
0A32 02
0A33 43
0A34 08
0A35 01
0A36 11
0A37 04
0A38 02
0A39 43
0A3A 08
0A3B 01
0A3C 11            1944                    DB      TC,4,06,X,TC,4,1,TD,4,1,TDS,4,1,TE,4,1,TC,4,1,TI,4,1
0A3D 04
0A3E 06
0A3F FF
0A40 11
0A41 04
```

```
0A42 01
0A43 26
0A44 04
0A45 01
0A46 37
0A47 04
0A48 01
0A49 43
0A4A 04
0A4B 01
0A4C 11
0A4D 04
0A4E 01
0A4F 26
0A50 04
0A51 01
0A52 43          1945          DB      TE,4,2,TB,4,1,TD,4,2,TC,4,4,X,TC,4,1,TD,4,1,TF,4,1
0A53 04
0A54 02
0A55 03
0A56 04
0A57 01
0A58 26
0A59 04
0A5A 02
0A5B 11
0A5C 04
0A5D 04
0A5E FF
0A5F 11
0A60 04
0A61 01
0A62 26
0A63 04
0A64 01
0A65 43
0A66 04
0A67 01
0A68 11          1946          DB      TC,4,1,TD,4,1,TE,4,2,TC,4,1,TD,4,1,TC,4,1,TE,4,1
0A69 04
0A6A 01
0A6B 26
0A6C 04
0A6D 01
0A6E 43
0A6F 04
0A70 02
0A71 11
0A72 04
```

```
0A73 01
0A74 26
0A75 04
0A76 01
0A77 11
0A78 04
0A79 01
0A7A 43
0A7B 04
0A7C 01
0A7D 11          1947          DB      TC,4,1,TD,4,1,TF,4,2,TC,4,1,TD,4,1,TC,4,1,TE,4,1
0A7E 04
0A7F 01
0A80 26
0A81 04
0A82 01
0A83 43
0A84 04
0A85 02
0A86 11
0A87 04
0A88 01
0A89 26
0A8A 04
0A8B 01
0A8C 11
0A8D 04
0A8E 01
0A8F 43
0A90 04
0A91 01
0A92 11          1948          DB      TC,4,1,TD,4,1,TF,4,2,TB,4,1,TD,4,2,TC,4,4,0
0A93 04
0A94 01
0A95 26
0A96 04
0A97 01
0A98 43
0A99 04
0A9A 02
0A9B 03
0A9C 04
0A9D 01
0A9E 26
0A9F 04
0AA0 02
0AA1 11
0AA2 04
0AA3 04
0AA4 00
```

```
                        1949    ;
0AA5 434F5059           1950                    DB      'COPYRIGHT 1982'
0AA9 52494748
0AAD 54203139
0AB1 3832
0AB3 494F4455           1951                    DB      'INDUSTRIAL DESIGN ENGINEERING ASSOCIATES LTD.'
0AB7 53545249
0ABB 414C2044
0ABF 45534947
0AC3 4E20454E
0AC7 47494E45
0ACB 4552494E
0ACF 47204153
0AD3 534F4349
0AD7 41544553
0ADB 204C5444
0ADF 2E
0AE0 414C4C20           1952                    DB      'ALL RIGHTS RESERVED'
0AE4 52494748
0AE8 54532052
0AEC 45534552
0AF0 564544
                        1953    ;
                        1954                    END
```

SYMBOL TABLE LISTING
------ ----- -------

| N A M E | T Y P E | V A L U E | | A T T R I B U T E S |
|---|---|---|---|---|
| AA . . . . . | NUMB | 00EEH | A | |
| ACC. . . . . | D ADDR | 00E0H | A | |
| ADD_10 . . . . . | C ADDR | 00E9H | R | SEG=GAME_ROUNTINES |
| ADD_CCIN . . . . . | B ADDR | 0022H.1 | A | |
| ALL_LAMPS_OFF. . . . . | C ADDR | 000DH | R PUB | SEG=GAME_ROUNTINES |
| B. . . . . | D ADDR | 00F0H | A | |
| B3_REG3. . . . . | NUMB | 001BH | A | |
| B3_REG4. . . . . | NUMB | 001CH | A | |
| BANK1_FLASH_REG. . . . | D ADDR | 005FH | A | |
| BANK1_REG. . . . . | D ADDR | 0065H | A | |
| BANK2_FLASH_REG. . . . | D ADDR | 005EH | A | |
| BANK2_REG. . . . . | D ADDR | 0064H | A | |
| BANK3_FLASH_REG. . . . | D ADDR | 005DH | A | |
| BANK3_REG. . . . . | D ADDR | 0063H | A | |
| BB . . . . . | NUMB | 00F8H | A | |
| BCD_ADD. . . . . | C ADDR | 00B6H | R | SEG=GAME_ROUNTINES |
| BCD_ADD10. . . . . | C ADDR | 00C1H | R | SEG=GAME_RCUNTINES |

| | | | | | | |
|---|---|---|---|---|---|---|
| BCD_ADD20. . . . . | C | ADDR | 00C4H | R | | SEG=GAME_ROUNTINES |
| BCD_SUB. . . . . | C | ADDR | 00C8H | R | | SEG=GAME_ROUNTINES |
| BEEP_BEEP. . . . . | C | ADDR | 0A1BH | R | PUB | SEG=GAME_ROUNTINES |
| BIN_TO_DEC . . . . . | C | ADDR | 00D6H | R | PUB | SEG=GAME_ROUNTINES |
| BLANK. . . . . | B | ADDR | 0021H.1 | A | | |
| BULL_FLAG. . . . . | B | ADDR | 0022H.3 | A | | |
| BULL_TONE. . . . . | C | ADDR | 09F2H | R | PUB | SEG=GAME_ROUNTINES |
| BULLS_EYE. . . . . | B | ADDR | 00E0H.7 | A | | |
| BUST_FLAG. . . . . | B | ADDR | 0022H.4 | A | | |
| BUST_LAMP. . . . . | | NUMB | 0002H | A | | |
| BUST . . . . . | C | ADDR | 09EEH | R | PUB | SEG=GAME_ROUNTINES |
| CC . . . . . | | NUMB | 00B0H | A | | |
| CHANGE_PLAYER. . . . . | B | ADDR | 0021B.4 | A | | |
| CHECK_STOP . . . . . | C | ADDR | 08C3H | R | | SEG=GAME_ROUNTINES |
| CHK_STP_10 . . . . . | C | ADDR | 08CBH | R | | SEG=GAME_ROUNTINES |
| CHK_STP_15 . . . . . | C | ADDR | 08CDH | R | | SEG=GAME_ROUNTINES |
| CHK_STP_20 . . . . . | C | ADDR | 08DFH | R | | SEG=GAME_ROUNTINES |
| CHK_STP_30 . . . . . | C | ADDR | 08E6H | R | | SEG=GAME_ROUNTINES |
| CHK_STP_40 . . . . . | C | ADDR | 08ECH | R | | SEG=GAME_ROUNTINES |
| CHK_STP_RET. . . . . | C | ADDR | 08E1H | R | | SEG=GAME_ROUNTINES |
| CLEAR_DISPLAY. . . . . | C | ADDR | 0004H | R | PUB | SEG=GAME_ROUNTINES |
| CLEAR_TEMP . . . . . | C | ADDR | 094FH | R | | SEG=GAME_ROUNTINES |
| CLR_ICOP . . . . . | C | ADDR | 0007H | R | | SEG=GAME_ROUNTINES |
| COIN_COUNT . . . . . | D | ADDR | 0062H | A | | |
| COIN_DEBOUNCE. . . . . | | NUMB | 00FFH | A | | |
| COIN_DROP. . . . . | B | ADDR | 00B0H.2 | A | | |
| COIN_TONE. . . . . | C | ADDR | 0A17H | R | PUB | SEG=GAME_ROUNTINES |
| COIN_UP. . . . . | B | ADDR | 0021H.2 | A | | |
| COUNTUP_00 . . . . . | C | ADDR | 02FBH | R | | SEG=GAME_ROUNTINES |
| COUNTUP_10 . . . . . | C | ADDR | 030DH | R | | SEG=GAME_ROUNTINES |
| COUNTUP_100. . . . . | C | ADDR | 0404H | R | | SEG=GAME_ROUNTINES |
| COUNTUP_11 . . . . . | C | ADDR | 0312H | R | | SEG=GAME_ROUNTINES |
| COUNTUP_110. . . . . | C | ADDR | 041FH | R | | SEG=GAME_ROUNTINES |
| COUNTUP_111. . . . . | C | ADDR | 0437H | R | | SEG=GAME_ROUNTINES |

| NAME | TYPE | VALUE | | | ATTRIBUTES |
|---|---|---|---|---|---|
| COUNTUP_112. . . . . | C | ADDR | 043AH | R | | SEG=GAME_ROUNTINES |
| COUNTUP_12 . . . . . | C | ADDR | 031DH | R | | SEG=GAME_ROUNTINES |
| COUNTUP_120. . . . . | C | ADDR | 0442H | R | | SEG=GAME_ROUNTINES |
| COUNTUP_130. . . . . | C | ADDR | 0449H | R | | SEG=GAME_ROUNTINES |
| COUNTUP_15 . . . . . | C | ADDR | 0324H | R | | SEG=GAME_ROUNTINES |
| COUNTUP_18 . . . . . | C | ADDR | 032EH | R | | SEG=GAME_ROUNTINES |
| COUNTUP_20 . . . . . | C | ADDR | 0331H | R | | SEG=GAME_ROUNTINES |
| COUNTUP_22 . . . . . | C | ADDR | 0337H | R | | SEG=GAME_ROUNTINES |
| COUNTUP_23 . . . . . | C | ADDR | 035EH | R | | SEG=GAME_ROUNTINES |
| COUNTUP_25 . . . . . | C | ADDR | 03A7H | R | | SEG=GAME_ROUNTINES |
| COUNTUP_30 . . . . . | C | ADDR | 03AAH | R | | SEG=GAME_ROUNTINES |

```
COUNTUP_50 . . . . . . .  C ADDR    03BFH    R        SEG=GAME_ROUNTINES
COUNTUP_60 . . . . . . .  C ADDR    03CEH    R        SEG=GAME_ROUNTINES
COUNTUP_70 . . . . . . .  C ADDR    03D7H    R        SEG=GAME_ROUNTINES
COUNTUP_80 . . . . . . .  C ADDR    03F2H    R        SEG=GAME_ROUNTINES
COUNTUP_90 . . . . . . .  C ADDR    03E6H    R        SEG=GAME_ROUNTINES
COUNTUP_BUTTON . . . .    B ADDR    00F0H.1  A
COUNTUP_LAMP . . . . .      NUMB    0004H    A
COUNTUP40. . . . . . .    C ADDR    03B5H    R        SEG=GAME_ROUNTINES
DART_BUFFER. . . . . .    D ADDR    0059H    A
DART_SCAN. . . . . . .    B ADDR    00B0H.0  A
DART_SCORE . . . . . .    D ADDR    0057H    A
DART_THROWN. . . . . .    B ADDR    0020H.3  A
DARTS_THROWN_LAMP. . .      NUMB    0001H    A
DATA_RDY . . . . . . .    B ADDR    00B0H.3  A
DATA_REC . . . . . . .    B ADDR    00B0H.1  A
DBL_DART . . . . . . .    B ADDR    00E0H.5  A
DBL_IN_BUTTON. . . . .    B ADDR    00E0H.2  A
DBL_IN_FLAG. . . . . .    B ADDR    0020H.0  A
DBL_IN_LAMP. . . . . .      NUMB    0040H    A
DBL_OUT_BUTTON . . . .    B ADDR    00F0H.3  A
DBL_OUT_FLAG . . . . .    B ADDR    0020H.1  A
DBL_OUT_LAMP . . . . .      NUMB    0080H    A
DENC_TIME. . . . . . .      NUMB    000AH    A
DEBOUNCE_TIMER . . . .    D ADDR    004BH    A
DECODE_TABLE . . . . .    C ADDR    0068H    R PUB    SEG=GAME_ROUNTINES
DELAY_REG. . . . . . .    D ADDR    004FH    A
DIGIT_COL0 . . . . . .    B ADDR    0090H.4  A
DIGIT_COL1 . . . . . .    B ADDR    0090H.5  A
DIGIT_COL2 . . . . . .    B ADDR    0090H.6  A
DIGIT_COL3 . . . . . .    B ADDR    0090H.7  A
DIGIT_ROW0 . . . . . .    X ADDR    0020H    A
DIGIT_ROW1 . . . . . .    X ADDR    0004H    A
DIGIT_ROW2 . . . . . .    X ADDR    0010H    A
DIGIT_ROW3 . . . . . .    X ADDR    0002H    A
DIS_SCR10. . . . . . .    C ADDR    0028H    R        SEG=GAME_ROUNTINES
DIS_SCR20. . . . . . .    C ADDR    002FH    R        SEG=GAME_ROUNTINES
DIS_SCR30. . . . . . .    C ADDR    0036H    R        SEG=GAME_ROUNTINES
DIS_SCR50. . . . . . .    C ADDR    0037H    R        SEG=GAME_ROUNTINES
DIS_SCR60. . . . . . .    C ADDR    0040H    R        SEG=GAME_ROUNTINES
DIS_SCR70. . . . . . .    C ADDR    0041H    R        SEG=GAME_ROUNTINES
DIS_SCR80. . . . . . .    C ADDR    0057H    R        SEG=GAME_ROUNTINES
DIS_SCR90. . . . . . .    C ADDR    0058H    R        SEG=GAME_ROUNTINES
DIS_TEMP10 . . . . . .    C ADDR    0085H    R        SEG=GAME_ROUNTINES
DIS_TEMP20 . . . . . .    C ADDR    0086H    R        SEG=GAME_ROUNTINES
DIS_TEMP30 . . . . . .    C ADDR    0098H    R        SEG=GAME_ROUNTINES
DIS_TEMP40 . . . . . .    C ADDR    0099H    R        SEG=GAME_ROUNTINES
DISPLAY_DARTS_OR_ROUNI    C ADDR    00A7H    R        SEG=GAME_ROUNTINES
DISPLAY_SCORE. . . . .    C ADDR    0017H    R        SEG=GAME_ROUNTINES
DISPLAY_TEMP . . . . .    C ADDR    0072H    R        SEG=GAME_ROUNTINES
DOUBLE_BYTE. . . . . .    B ADDR    0021H.0  A
```

```
DOUBLE_FLAG. . . . . .  D ADDR    0058H    A
DOUBLE . . . . . . . .  B ADDR    0022H.7  A
DP . . . . . . . . . .    NUMB    0001H    A
DPH. . . . . . . . . .  D ADDR    0083H    A
DPL. . . . . . . . . .  D ADDR    0082H    A
DV . . . . . . . . . .  D ADDR    0053H    A
E. . . . . . . . . . .    NUMB    00F2H    A
EIGHT. . . . . . . . .    NUMB    00FEH    A
END_GAME . . . . . . .  C ADDR    044CH    R        SEG=GAME_ROUNTINES
END_GAME10 . . . . . .  C ADDR    045DH    R        SEG=GAME_ROUNTINES
END_GAME100. . . . . .  C ADDR    04D0H    R        SEG=GAME_ROUNTINES
END_GAME110. . . . . .  C ADDR    04D7H    R        SEG=GAME_ROUNTINES
END_GAME20 . . . . . .  C ADDR    0461H    R        SEG=GAME_ROUNTINES
END_GAME30 . . . . . .  C ADDR    0477H    R        SEG=GAME_ROUNTINES
END_GAME40 . . . . . .  C ADDR    048CH    R        SEG=GAME_ROUNTINES
END_GAME45 . . . . . .  C ADDR    0493H    R        SEG=GAME_ROUNTINES
END_GAME50 . . . . . .  C ADDR    0498H    R        SEG=GAME_ROUNTINES
END_GAME60 . . . . . .  C ADDR    049DH    R        SEG=GAME_ROUNTINES
END_GAME70 . . . . . .  C ADDR    04A2H    R        SEG=GAME_ROUNTINES
END_GAME75 . . . . . .  C ADDR    04AAH    R        SEG=GAME_ROUNTINES
END_GAME80 . . . . . .  C ADDR    04AFH    R        SEG=GAME_ROUNTINES
END_GAME90 . . . . . .  C ADDR    04C2H    R        SEG=GAME_ROUNTINES
END_TONE . . . . . . .  C ADDR    0A10H    R PUB    SEG=GAME_ROUNTINES
EXIT . . . . . . . . .  B ADDR    0023H.4  A
FIFTEEN_SEC. . . . . .    NUMB    0096H    A
FIFTY_CENTS_LAMP . . .    NUMB    0040H    A
FIRST_TIME . . . . . .  B ADDR    0021H.3  A
FIVE_MSEC. . . . . . .    NUMB    0005H    A
FIVE . . . . . . . . .    NUMB    00DAH    A
FLASH_COUNT. . . . . .    NUMB    003FH    A
FLASH_FLAG . . . . . .  B ADDR    0020H.2  A
FLASH_PTR_END. . . . .    NUMB    0004H    A
FLASH_PTR. . . . . . .  D ADDR    0060H    A
FLASH_TIMER. . . . . .  D ADDR    0061H    A
FIG501 . . . . . . . .  B ADDR    0020H.6  A
FOUR . . . . . . . . .    NUMB    00CCH    A
GAME_301 . . . . . . .  C ADDR    00EEH    R PUB    SEG=GAME_ROUNTINES
GAME_COUNTUP . . . . .  C ADDR    02F1H    R PUB    SEG=GAME_ROUNTINES
GAME_LAMPS . . . . . .    NUMB    003EH    A
GAME_OVER_LAMP . . . .    NUMB    0040H    A
GAME_ROUND_LAMP. . . .    NUMB    0020H    A
GAME_ROUNTINES . . . .  C SEG     0AF3H             REL=UNIT
GAME_SCRAM . . . . . .  C ADDR    06A7H    R PUB    SEG=GAME_ROUNTINES
GAME_SELECT_MASK . . .    NUMB    0073H    A
GAME_SHANG_HAI . . . .  C ADDR    04E2H    R PUB    SEG=GAME_ROUNTINES
GAME_START . . . . . .  B ADDR    0022H.0  A
GEN2 . . . . . . . . .  B ADDR    0023H.2  A
GM301_00 . . . . . . .  C ADDR    00FAH    R        SEG=GAME_ROUNTINES
GM301_1. . . . . . . .  C ADDR    0100H    R        SEG=GAME_ROUNTINES
```

| NAME | TYPE | VALUE | | ATTRIBUTES |
|---|---|---|---|---|
| GM301_10 . . . . . | C ADDR | 010BH | R | SEG=GAME_ROUNTINES |
| GM301_100. . . . . | C ADDR | 0294H | R | SEG=GAME_ROUNTINES |
| GM301_110. . . . . | C ADDR | 029CH | R | SEG=GAME_ROUNTINES |
| GM301_115. . . . . | C ADDR | 02A4H | R | SEG=GAME_RCUNTINES |
| GM301_120. . . . . | C ADDR | 02PBH | R | SEG=GAME_ROUNTINES |
| GM301_125. . . . . | C ADDR | 02CCH | R | SEG=GAME_ROUNTINES |
| GM301_130. . . . . | C ADDR | 02D3H | R | SEG=GAME_ROUNTINES |
| GM301_2. . . . . | C ADDR | 0106H | R | SEG=GAME_ROUNTINES |
| GM301_20 . . . . . | C ADDR | 0112H | R | SEG=GAME_ROUNTINES |
| GM301_22 . . . . . | C ADDR | 011CH | R | SEG=GAME_ROUNTINES |
| GM301_23 . . . . . | C ADDR | 011EH | R | SEG=GAME_ROUNTINES |
| GM301_24 . . . . . | C ADDR | 012BH | R | SEG=GAME_ROUNTINES |
| GM301_24A. . . . . | C ADDR | 0130H | R | SEG=GAME_ROUNTINES |
| GM301_25 . . . . . | C ADDR | 013EH | R | SEG=GAME_RCUNTINES |
| GM301_26 . . . . . | C ADDR | 0141H | R | SEG=GAME_ROUNTINES |
| GM301_30 . . . . . | C ADDR | 014BH | R | SEG=GAME_ROUNTINES |
| GM301_31 . . . . . | C ADDR | 014EH | R | SEG=GAME_ROUNTINES |
| GM301_32 . . . . . | C ADDR | 0154H | R | SEG=GAME_ROUNTINES |
| GM301_40 . . . . . | C ADDR | 0173H | R | SEG=GAME_ROUNTINES |
| GM301_43 . . . . . | C ADDR | 017BH | R | SEG=GAME_ROUNTINES |
| GM301_45 . . . . . | C ADDR | 01CDH | R | SEG=GAME_ROUNTINES |
| GM301_50 . . . . . | C ADDR | 01D1H | R | SEG=GAME_ROUNTINES |
| GM301_50A. . . . . | C ADDR | 01DCH | R | SEG=GAME_ROUNTINES |
| GM301_51 . . . . . | C ADDR | 01E6H | R | SEG=GAME_RCUNTINES |
| GM301_60 . . . . . | C ADDR | 01FDH | R | SEG=GAME_ROUNTINES |
| GM301_61 . . . . . | C ADDR | 0207H | R | SEG=GAME_ROUNTINES |
| GM301_62 . . . . . | C ADDR | 0210H | R | SEG=GAME_ROUNTINES |
| GM301_65 . . . . . | C ADDR | 021BH | R | SEG=GAME_ROUNTINES |
| GM301_70 . . . . . | C ADDR | 021FH | R | SEG=GAME_ROUNTINES |
| GM301_73 . . . . . | C ADDR | 0247H | R | SEG=GAME_ROUNTINES |
| GM301_74 . . . . . | C ADDR | 024AH | R | SEG=GAME_ROUNTINES |
| GM301_75 . . . . . | C ADDR | 024FH | R | SEG=GAME_ROUNTINES |
| GM301_80 . . . . . | C ADDR | 024EH | R | SEG=GAME_ROUNTINES |
| GM301_82 . . . . . | C ADDR | 0254H | R | SEG=GAME_RCUNTINES |
| GM301_83 . . . . . | C ADDR | 026FH | R | SEG=GAME_ROUNTINES |
| GM301_85 . . . . . | C ADDR | 027BH | R | SEG=GAME_ROUNTINES |
| GM301_87 . . . . . | C ADDR | 0287H | R | SEG=GAME_ROUNTINES |
| GM301_90 . . . . . | C ADDR | 028AH | R | SEG=GAME_ROUNTINES |
| HALF_SEC . . . . . | NUMB | 0005H | A | |
| HIT_TONE . . . . . | C ADDR | 0A23H | R | SEG=GAME_ROUNTINES |
| INITIALIZE_SYSTEM. . . | C ADDR | ---- | EXT | |
| INPUT_SWITCHES . . . . | C ADDR | ---- | EXT | |
| LAMP_BANK1 . . . . . | X ADDR | 0040H | A | |
| LAMP_BANK2 . . . . . | X ADDR | 0080H | A | |
| LAMP_BANK3 . . . . . | X ADDR | 0001H | A | |
| LAMP_PNTR. . . . . | D ADDR | 0056H | A | |
| LAST_CHECK . . . . . | NUMB | 0015H | A | |

```
LOAD . . . . . . . . . .  B ADDR    0023H.1 A
MSG_PNTR . . . . . . . .  D ADDR    005CH   A
NEXT_TONE. . . . . . . .  C ADDR    0A09H   R PUB   SEG=GAME_ROUNTINES
NINE . . . . . . . . . .    NUMB    00CEH   A
ODD_COIN . . . . . . . .  B ADDR    00E0H.0 A
ONE. . . . . . . . . . .    NUMB    000CH   A
OUTPUT1_LAMP . . . . . .    NUMB    0004H   A
OUTPUT2_LAMP . . . . . .    NUMB    0008H   A
OVER_HEAD_LAMP . . . . .    NUMB    0010H   A
P1 . . . . . . . . . . .  D ADDR    0090H   A
P3 . . . . . . . . . . .  D ADDR    00B0H   A
PAUSE_FLAG . . . . . . .  B ADDR    0020H.5 A
PAUSE. . . . . . . . . .  C ADDR    09D5H   R       SEG=GAME_ROUNTINES
PAUSE10. . . . . . . . .  C ADDR    09E4H   R       SEG=GAME_ROUNTINES
PLAYER_CHANGE_BUTTON . .  B ADDR    00E0H.7 A
PLAYER_COUNT . . . . . .  D ADDR    005AH   A
PLAYER_LAMP_TABLE. . . .  C ADDR    0000H   R       SEG=GAME_ROUNTINES
PLAYER_LAMPS_OFF . . . .    NUMB    00C3H   A
PLAYER_LAMPS . . . . . .    NUMB    003CH   A
PLAYER1_LAMP . . . . . .    NUMB    0004H   A
PLAYER2_LAMP . . . . . .    NUMB    0020H   A
PLAYER3_LAMP . . . . . .    NUMB    0008H   A
PLAYER4_LAMP . . . . . .    NUMB    0010H   A
PLYR_CHANGE_LAMP . . . .    NUMB    0080H   A
PLYR1_1_BUFR . . . . . .  D ADDR    0077H   A
PLYR1_10_BUFR. . . . . .  D ADDR    007BH   A
PLYR1_100_BUFR . . . . .  D ADDR    007FH   A
PLYR1_NEXT . . . . . . .  D ADDR    0049H   A
PLYR1_SCORE_H. . . . . .  D ADDR    006CH   A
PLYR1_SCORE_I. . . . . .  D ADDR    006DH   A
PLYR2_1_BUFR . . . . . .  D ADDR    0076H   A
PLYR2_10_BUFR. . . . . .  D ADDR    007AH   A
PLYR2_100_BUFR . . . . .  D ADDR    007EH   A
PLYR2_NEXT . . . . . . .  D ADDR    0048H   A
PLYR2_SCORE_H. . . . . .  D ADDR    006AH   A
PLYR2_SCORE_I. . . . . .  D ADDR    006EH   A
PLYR3_1_BUFR . . . . . .  D ADDR    0075H   A
PLYR3_10_BUFR. . . . . .  D ADDR    0079H   A
PLYR3_100_BUFR . . . . .  D ADDR    007DH   A
PLYR3_NEXT . . . . . . .  D ADDR    0047H   A
PLYR3_SCORE_H. . . . . .  D ADDR    0068H   A
PLYR3_SCORE_I. . . . . .  D ADDR    0069H   A
PLYR4_1_BUFR . . . . . .  D ADDR    0074H   A
PLYR4_10_BUFR. . . . . .  D ADDR    0078H   A
PLYR4_100_BUFR . . . . .  D ADDR    007CH   A
PLYR4_NEXT . . . . . . .  D ADDR    0046H   A
PLYR4_SCORE_H. . . . . .  D ADDR    0066H   A
PLYR4_SCORE_L. . . . . .  D ADDR    0067H   A
PP . . . . . . . . . . .    NUMB    00E6H   A
```

```
PSW. . . . . .  D ADDR    00D0H    A
R. . . . . . .    NUMB    00A0H    A
REG2 . . . . .    NUMB    0002H    A
REMOVE_DARTS_LAMP. . .    NUMB    0080H    A
ROUND_COUNT. . . . . .  D ADDR    004DH    A
ROUND_DART_BUFR. . . .  D ADDR    0070H    A
S. . . . . . .    NUMB    00DAH    A
SCORE_FLAG . . . . . .  B ADDR    0022H.7  A
SCRAM_BUTTON . . . . .  B ADDR    00F0H.4  A
SCRAM_LAMP . . . . . .    NUMB    0002H    A
SCRAM_TABLE1 . . . . .  C ADDR    08F5H    R        SEG=GAME_ROUNTINES
SCRAM_TABLE2 . . . . .  C ADDR    0903H    R        SEG=GAME_ROUNTINES
SCRAM0 . . . . . . . .  C ADDR    06B3H    R        SEG=GAME_ROUNTINES
SCRAM1 . . . . . . . .  C ADDR    06B6H    R        SEG=GAME_ROUNTINES
SCRAM10. . . . . . . .  C ADDR    06C2H    R        SEG=GAME_ROUNTINES
SCRAM105 . . . . . . .  C ADDR    0859H    R        SEG=GAME_ROUNTINES
SCRAM130 . . . . . . .  C ADDR    085FH    R        SEG=GAME_ROUNTINES
SCRAM135 . . . . . . .  C ADDR    086AH    R        SEG=GAME_ROUNTINES
SCRAM140 . . . . . . .  C ADDR    0874H    R        SEG=GAME_ROUNTINES
SCRAM15. . . . . . . .  C ADDR    06D4H    R        SEG=GAME_ROUNTINES
SCRAM150 . . . . . . .  C ADDR    087DH    R        SEG=GAME_ROUNTINES
SCRAM16. . . . . . . .  C ADDR    06D6H    R        SEG=GAME_ROUNTINES
SCRAM160 . . . . . . .  C ADDR    0888H    R        SEG=GAME_ROUNTINES
SCRAM170 . . . . . . .  C ADDR    088CH    R        SEG=GAME_ROUNTINES
SCRAM180 . . . . . . .  C ADDR    08A8H    R        SEG=GAME_ROUNTINES
SCRAM190 . . . . . . .  C ADDR    08B0H    R        SEG=GAME_ROUNTINES
SCRAM2 . . . . . . . .  C ADDR    06FFH    R        SEG=GAME_ROUNTINES
SCRAM20. . . . . . . .  C ADDR    06F4H    R        SEG=GAME_ROUNTINES
SCRAM23. . . . . . . .  C ADDR    06EAH    R        SEG=GAME_ROUNTINES
SCRAM25. . . . . . . .  C ADDR    06EBH    R        SEG=GAME_ROUNTINES
SCRAM26. . . . . . . .  C ADDR    06F6H    R        SEG=GAME_ROUNTINES
SCRAM27. . . . . . . .  C ADDR    06F9H    R        SEG=GAME_ROUNTINES
SCRAM30. . . . . . . .  C ADDR    0703H    R        SEG=GAME_ROUNTINES
SCRAM40. . . . . . . .  C ADDR    070EH    R        SEG=GAME_ROUNTINES
SCRAM50. . . . . . . .  C ADDR    070CH    R        SEG=GAME_ROUNTINES
SCRAM55. . . . . . . .  C ADDR    0723H    R        SEG=GAME_ROUNTINES
SCRAM60. . . . . . . .  C ADDR    0730H    R        SEG=GAME_ROUNTINES
SCRAM65. . . . . . . .  C ADDR    075CH    R        SEG=GAME_ROUNTINES
SCRAM66. . . . . . . .  C ADDR    078DH    R        SEG=GAME_ROUNTINES
SCRAM67. . . . . . . .  C ADDR    07A9H    R        SEG=GAME_ROUNTINES
SCRAM70. . . . . . . .  C ADDR    07BDH    R        SEG=GAME_ROUNTINES
SCRAM75. . . . . . . .  C ADDR    07C1H    R        SEG=GAME_ROUNTINES
SCRAM80. . . . . . . .  C ADDR    07CAH    R        SEG=GAME_ROUNTINES
SCRAM90. . . . . . . .  C ADDR    07D4H    R        SEG=GAME_ROUNTINES
SCRAM90A . . . . . . .  C ADDR    07DFH    R        SEG=GAME_ROUNTINES
SCRAM91. . . . . . . .  C ADDR    07E8H    R        SEG=GAME_ROUNTINES
SCRAM91A . . . . . . .  C ADDR    07FFH    R        SEG=GAME_ROUNTINES
SCRAM91B . . . . . . .  C ADDR    0801H    R        SEG=GAME_ROUNTINES
SCRAM92. . . . . . . .  C ADDR    0806H    R        SEG=GAME_ROUNTINES
```

```
SCRAM93. . . . . .  C ADDR   080CH   R     SEG=GAME_ROUNTINES
SCRAM95. . . . . .  C ADDR   080FH   R     SEG=GAME_ROUNTINES
SCRAM95A . . . . .  C ADDR   0811H   R     SEG=GAME_ROUNTINES
SCRAM96. . . . . .  C ADDR   0847H   R     SEG=GAME_ROUNTINES
SCRAM97. . . . . .  C ADDR   084AH   R     SEG=GAME_ROUNTINES
SCRAM98. . . . . .  C ADDR   0850H   R     SEG=GAME_ROUNTINES
SCRAM99. . . . . .  C ADDR   0856H   R     SEG=GAME_ROUNTINES
SD . . . . . . . .    NUMB   00BCH   A
SET_WIN_LAMP . . . . .  C ADDR   04DBH   R     SEG=GAME_ROUNTINES
SEVEN. . . . . . .    NUMB   000EH   A
SHANG_B00. . . . . .  C ADDR   04EFH   R     SEG=GAME_ROUNTINES
SHANG_B10. . . . . .  C ADDR   0505H   R     SEG=GAME_ROUNTINES
SHANG_B100 . . . . .  C ADDR   05E8H   R     SEG=GAME_ROUNTINES
SHANG_B110 . . . . .  C ADDR   060DH   R     SEG=GAME_ROUNTINES
SHANG_B120 . . . . .  C ADDR   0619H   R     SEG=GAME_ROUNTINES
SHANG_B130 . . . . .  C ADDR   0624H   R     SEG=GAME_ROUNTINES
SHANG_B140 . . . . .  C ADDR   062AH   R     SEG=GAME_ROUNTINES
SHANG_B145 . . . . .  C ADDR   0643H   R     SEG=GAME_ROUNTINES
SHANG_B15. . . . . .  C ADDR   050AH   R     SEG=GAME_ROUNTINES
SHANG_B150 . . . . .  C ADDR   0648H   R     SEG=GAME_ROUNTINES
09F4 01
09F5 43
09F6 04
09F7 01
09F8 61
09F9 04
09FA 01
09FB 11
09FC 02
09FD 02
09FE 11
09FF 04
0A00 01
0A01 11
0A02 02
0A03 02
0A04 00
                1930    ;
0A05 43         1931    STUCK_TONE:     DB      TE,4,01,0
0A06 04
0A07 01
0A08 00
                1932    ;
0A09 61         1933    NEXT_TONE:      DB      TG,2,1,TC,2,1,0
0A0A 02
0A0B 01
0A0C 11
0A0D 02
0A0E 01
0A0F 00
```

```
                    1934      ;
0A10 11             1935      INI_TONE:        DB      TC,2,1,TG,2,1,0
0A11 02
0A12 01
0A13 61
0A14 02
0A15 01
0A16 00
                    1936      ;
0A17 43             1937      COIN_TONE:       DB      TE,2,01,0
0A18 02
0A19 01
0A1A 00
                    1938      ;
0A1B 11             1939      BEEP_BEEP:       DB      TC,1,1,X,TC,1,1,0
0A1C 01
0A1D 01
0A1E FF
0A1F 11
0A20 01
0A21 01
0A22 00
                    1940      ;
0A23 03             1941      HIT_TONE:        DB      TB,1,1,0
0A24 01
```

| NAME | TYPE | VALUE | | ATTRIBUTES |
|---|---|---|---|---|
| SHANG_H155 . . . . . . | C ADDR | 065AH | R | SEG=GAME_ROUNTINES |
| SHANG_H160 . . . . . . | C ADDR | 067BH | R | SEG=GAME_ROUNTINES |
| SHANG_H170 . . . . . . | C ADDR | 0694H | R | SEG=GAME_ROUNTINES |
| SHANG_H180 . . . . . . | C ADDR | 0697H | R | SEG=GAME_ROUNTINES |
| SHANG_H190 . . . . . . | C ADDR | 069FH | R | SEG=GAME_ROUNTINES |
| SHANG_H20. . . . . . . | C ADDR | 0515H | R | SEG=GAME_ROUNTINES |
| SHANG_H30. . . . . . . | C ADDR | 051FH | R | SEG=GAME_ROUNTINES |
| SHANG_H35. . . . . . . | C ADDR | 0528H | R | SEG=GAME_ROUNTINES |
| SHANG_H40. . . . . . . | C ADDR | 052BH | R | SEG=GAME_ROUNTINES |
| SHANG_H50. . . . . . . | C ADDR | 0531H | R | SEG=GAME_ROUNTINES |
| SHANG_H60. . . . . . . | C ADDR | 0558H | R | SEG=GAME_ROUNTINES |
| SHANG_H70. . . . . . . | C ADDR | 05CFH | R | SEG=GAME_ROUNTINES |
| SHANG_H80. . . . . . . | C ADDR | 05D3H | R | SEG=GAME_ROUNTINES |
| SHANG_H90. . . . . . . | C ADDR | 05DEH | R | SEG=GAME_ROUNTINES |
| SHANG_HAI_BUTTON . . . | B ADDR | 00E0H.5 | A | |
| SHANG_HAI_LAMP . . . . | NUMB | 0020H | A | |
| SINGLE . . . . . . . . | B ADDR | 0022H.6 | A | |
| SIX. . . . . | NUMB | 00F8H | A | |
| SKIP00 . . . . . . . . | C ADDR | 01A6H | R | SEG=GAME_ROUNTINES |
| SKIP01 . . . . . . . . | C ADDR | 026AH | R | SEG=GAME_ROUNTINES |
| SKIP02 . . . . . . . . | C ADDR | 0388H | R | SEG=GAME_ROUNTINES |
| SKIP03 . . . . . . . . | C ADDR | 041DH | R | SEG=GAME_ROUNTINES |

```
SKIP04 . . . . . .  C ADDR   058FH    R        SEG=GAME_ROUNTINES
SKIP05 . . . . . .  C ADDR   05AEH    R        SEG=GAME_ROUNTINES
SKIP06 . . . . . .  C ADDR   060CH    R        SEG=GAME_RCUNTINES
SKIP07 . . . . . .  C ADDR   0674H    R        SEG=GAME_ROUNTINES
SKIP08 . . . . . .  C ADDR   0758H    R        SEG=GAME_RCUNTINES
SKIP09 . . . . . .  C ADDR   083AH    R        SEG=GAME_ROUNTINES
SKIP0A . . . . . .  C ADDR   0938H    R        SEG=GAME_ROUNTINES
SND_GEN. . . . . .  C ADDR   0972H    R        SEG=GAME_ROUNTINES
SOUND_END. . . . .  C ADDR   09C8H    R        SEG=GAME_ROUNTINES
SOUND_GEN. . . . .  C ADDR   0959H    R PUB    SEG=GAME_ROUNTINES
SOUND_RET. . . . .  C ADDR   0978H    R        SEG=GAME_ROUNTINES
SCUND0 . . . . . .  C ADDR   0976H    R        SEG=GAME_RCUNTINES
SOUND10. . . . . .  C ADDR   0981H    R        SEG=GAME_ROUNTINES
SOUND20. . . . . .  C ADDR   0992H    R        SEG=GAME_ROUNTINES
SOUND30. . . . . .  C ADDR   09A8H    R        SEG=GAME_ROUNTINES
SOUND31. . . . . .  C ADDR   09ADH    R        SEG=GAME_ROUNTINES
SOUND40. . . . . .  C ADDR   09B4H    R        SEG=GAME_ROUNTINES
SOUND41. . . . . .  C ADDR   09B5H    R        SEG=GAME_ROUNTINES
SCUND50. . . . . .  C ADDR   09BFH    R        SEG=GAME_ROUNTINES
SPEECH_PORT. . . .  X ADDR   0080H    A
STK_NUM. . . . . .    NUMB   0025H    A
STCP_FLAG. . . . .  B ADDR   0023H.0  A
STOP_PNTR. . . . .  D ADDR   0049H    A
STOP_REG1A . . . .  D ADDR   0048H    A
STOP_REG1B . . . .  D ADDR   0047H    A
STOP_REG1C . . . .  D ADDR   0046H    A
STCP_REG2A . . . .  D ADDR   0045H    A
STOP_REG2B . . . .  D ADDR   0044H    A
STOP_REG2C . . . .  D ADDR   0043H    A
STCP_REG3A . . . .  D ADDR   0042H    A
STOP_REG3B . . . .  D ADDR   0041H    A
STOP_REG3C . . . .  D ADDR   0040H    A
STOP_REG4A . . . .  D ADDR   003FH    A
STOP_REG4B . . . .  D ADDR   003EH    A
STOP_REG4C . . . .  D ADDR   003DH    A
STUCK_RET. . . . .  C ADDR   094BH    R        SEG=GAME_ROUNTINES
STUCK_TCNE . . . .  C ADDR   0A05H    R        SEG=GAME_RCUNTINES
STUCK. . . . . . .  C ADDR   091FH    R PUB    SEG=GAME_ROUNTINES
STUCK0 . . . . . .  C ADDR   0922H    R        SEG=GAME_ROUNTINES
STUCK10. . . . . .  C ADDR   0939H    R        SEG=GAME_ROUNTINES
STUCK20. . . . . .  C ADDR   0946H    R        SEG=GAME_RCUNTINES
SWAP_FIAG. . . . .  B ADDR   0022H.6  A
SWITCB_BUFFER. . .  D ADDR   004CH    A
SWITCB_DEBOUNCE. .    NUMB   00FFH    A
SWITCB_DOWN. . . .  B ADDR   0021H.6  A
SWITCB_ENABLE. . .  B ADDR   0021H.7  A
SWITCB_RELEASE . .  B ADDR   0021H.5  A
SWITCB_TEMP. . . .  D ADDR   004AH    A
TA . . . . . . . .    NUMB   0072H    A
```

```
TAS. . . . . .    NUMB    007AH    A
TB . . . . . .    NUMB    0003H    A
TC . . . . . .    NUMB    0011H    A
TCS. . . . . .    NUMB    0001H    A
TD . . . . . .    NUMB    0026H    A
TDS. . . . . .    NUMB    0037H    A
TE . . . . . .    NUMB    0043H    A
TEMP_1_BUFR. . . . . .  D ADDR    0072H    A
TEMP_10_BUFR . . . . .  D ADDR    0071H    A
TEMP_100_BUFR. . . . .  D ADDR    0073H    A
TEMP_CY. . . . . .      B ADDR    0022H.2  A
TEMP_H . . . . . .      D ADDR    0054H    A
TEMP_L . . . . . .      D ADDR    0055H    A
TEMP_SCORE_H . . . . .  D ADDR    006FH    A
TEMP_SCORE_L . . . . .  D ADDR    006FH    A
TEMP_SCORE_LAMP. . . .    NUMB    0001H    A
TEN_MSEC . . . . . .      NUMB    000AH    A
TEN_SEC. . . . . .        NUMB    0064H    A
TENS_ICOP. . . . . .    C ADDR    00D9H    R        SEG=GAME_ROUTINES
TEST_MODE. . . . . .    B ADDR    00B0H.5  A
TEST_TONE. . . . . .    B ADDR    0023H.5  A
TF . . . . . .            NUMB    004DH    A
TFS. . . . . .            NUMB    0057H    A
TG . . . . . .            NUMB    0061H    A
TGS. . . . . .            NUMB    0065H    A
THØ. . . . . .          D ADDR    008CH    A
THREE_SEC. . . . . .      NUMB    001EH    A
THREE. . . . . .          NUMB    009EH    A
THROW_DARTS_LAMP . . .    NUMB    0002H    A
TIMER_COUNT. . . . . .    NUMB    0064H    A
TIMER_FLAG . . . . . .  B ADDR    0020H.4  A
TIMER_REG. . . . . .    D ADDR    005BH    A
TONE_FLAG. . . . . .    B ADDR    0020H.7  A
TONE_LENGTH. . . . . .  D ADDR    004FH    A
TONE_OUT . . . . . .    B ADDR    00B0H.4  A
TONE_PTR . . . . . .    D ADDR    0052H    A
TPI_DART . . . . . .    B ADDR    00F0H.6  A
TRØ. . . . . .          B ADDR    0088H.4  A
TRIPLE . . . . . .      B ADDR    0023H.0  A
TT . . . . . .            NUMB    00F0H    A
TUNE_H . . . . . .      D ADDR    0050H    A
TUNE_L . . . . . .      D ADDR    0051H    A
TWENTYFIVE_CENTS_LAMP.    NUMB    0001H    A
TWO_SEC. . . . . .        NUMB    0014H    A
TWO. . . . . .            NUMB    00B6H    A
WIN_FLAG . . . . . .    B ADDR    0022H.5  A
WIN. . . . . .          C ADDR    0A27H    R PUB    SEG=GAME_ROUTINES
X. . . . . .              NUMB    00FFH    A
X301_BUTTON. . . . . .  B ADDR    00E0H.6  A
X301_LAMP. . . . . .      NUMB    0010H    A
```

```
X501_BUTTON. . . . . . .  B ADDR    00E0H.0 A
X501_LAMP. . . . . . . .    NUMB    0008H   A
XA . . . . . . . . . . .    NUMB    0002H   A
XB . . . . . . . . . . .    NUMB    0004H   A
XC . . . . . . . . . . .    NUMB    0008H   A
XD . . . . . . . . . . .    NUMB    0010H   A
XE . . . . . . . . . . .    NUMB    0020H   A
XF . . . . . . . . . . .    NUMB    0040H   A
XG . . . . . . . . . . .    NUMB    0080H   A
ZERO_FLAG. . . . . . . .  B ADDR    0023H.3 A
ZERO . . . . . . . . . .    NUMB    007EH   A

REGISTER BANK(S) USED: 0, TARGET MACHINE(S): 8051

ASSEMBLY COMPLETE, NO ERRORS FOUND

ISIS-II MCS-48/UPI-41 MACRO ASSEMBLER, V4.0            PAGE    1

 LOC  OBJ          LINE        SOURCE STATEMENT

                     1 ;
                     2 ;
                     3 ;       COPYRIGHT 1982 INDUSTRIAL DESIGN ENGINEERING ASSOCIATES, LTD.
                     4 ;                        ALL RIGHTS RESERVED
                     5 ;
                     6 ;
                     7 ;  THIS PROGRAM IS FOR THE PISCES PROJECT.
                     8 ;  IT WILL SCAN A DART BOARD AND DECODE THE DART HIT
                     9 ;  THE DART CODE IS THEN SENT IN 2 NIBBLES TO THE 8031.
                    10 ;  THE CODE IS AS FOLLOWS:
                    11 ;
                    12 ;  BITS 0 THRU 4 ---> BCD VALUE OF THE DART SEGMENT
                    13 ;  BIT  5 SET----------> DART IS DOUBLE VALUE
                    14 ;  BIT  6 SET----------> DART IS TRIPLE VALUE
                    15 ;  BIT  7 SET----------> DART IS A BULLS EYE
                    16 ;
                    17 ; THE DART CODES WILL BE SENT THROUGH A 4 BIT BUS
                    18 ; WITH THE LEAST SIGNIFICANT NIBBLE FIRST.
                    19 ;
                    20 ;*************************************************************************
                    21 ;
 003F               22 QUE     EQU     63      ;LAST BUS DATA
 00FA               23 NUMBER  EQU     250     ;NUMBER OF TIMES DART HAS TO BE SEEN
 0004               24 LMPON   EQU     04H
 00FB               25 LMPOFF  EQU     0FBH
                    26 ;
                    27 ;*************************************************************************
```

```
                  ;        DART SEGMENT CODES
                  ;        -----------------
0080              BE       EQU      80H
                  ;
0001              SGI1     EQU      01H
0002              SGL2     EQU      02H
0003              SGL3     EQU      03H
0004              SGL4     EQU      04H
0005              SGL5     EQU      05H
0006              SGL6     EQU      06H
0007              SGL7     EQU      07H
0008              SGL8     EQU      08H
0009              SGI9     EQU      09H
000A              SGL10    EQU      0AH
000B              SGL11    EQU      0BH
000C              SGI12    EQU      0CH
000D              SGI13    EQU      0DH
000E              SGL14    EQU      0EH
000F              SGI15    EQU      0FH
0010              SGI16    EQU      10H
0011              SGI17    EQU      11H
0012              SGL18    EQU      12H
0013              SGL19    EQU      13H
0014              SGI20    EQU      14H
                  ;
0021              DBL1     EQU      21H
0022              DBI2     EQU      22H
0023              DBL3     EQU      23H
0024              DBI4     EQU      24H
0025              DBL5     EQU      25H
0026              DBI6     EQU      26H
0027              DBL7     EQU      27H
0028              DBI8     EQU      28H
0029              DBL9     EQU      29H
002A              DBL10    EQU      2AH
002B              DBL11    EQU      2BH
002C              DBI12    EQU      2CH
002D              DBL13    EQU      2DH
002E              DBL14    EQU      2EH
002F              DBL15    EQU      2FH
0030              DBL16    EQU      30H
0031              DBL17    EQU      31H
0032              DBI18    EQU      32H
0033              DBL19    EQU      33H
0034              DBI20    EQU      34H
                  ;
0041              TPL1     EQU      41H
0042              TPI2     EQU      42H
0043              TPI3     EQU      43H
0044              TPL4     EQU      44H
```

```
0045                TPL5    EQU     45H
0046                TPL6    EQU     46H
0047                TPL7    EQU     47H
0048                TPL8    EQU     48H
0049                TPL9    EQU     49H
004A                TPL10   EQU     4AH
004B                TPL11   EQU     4BH
004C                TPL12   EQU     4CH
004D                TPL13   EQU     4DH
004E                TPL14   EQU     4EH
004F                TPL15   EQU     4FH
0050                TPL16   EQU     50H
0051                TPL17   EQU     51H
0052                TPL18   EQU     52H
0053                TPL19   EQU     53H
0054                TPL20   EQU     54H
                    ;
                    ;*****************************************************************
                    ;
                    ;           START OF PROGRAM
                    ;           ----------------
0000 04E4           JMP     INITIZ
                    ;
0002 2602           HLDLP:  JNT0    HLILP
0004 BC32           MOV     R4,#50
0006 1483           IP1:    CALL    TIME
0008 EC06           DJNZ    R4,IP1
000A 2602           JNT0    HLDLP
                    ;
000C BA00           SCAN:   MOV     R2,#0           ;RESET THE STROBE REGISTER
000E BB00           MOV     R3,#0           ;RESET THE TABLE POINTER
                    ;
0010 A5             SCAN10: CLR     F1              ;CLEAR THE PORT SELECT FLAG
0011 08             INS     A,BUS
0012 53FC           ANL     A,#0FCH
0014 4A             ORL     A,R2
0015 02             OUTL    BUS,A
0016 00             NOP
                    ;
0017 09             IN      A,P1            ;READ THE FIRST PORT
0018 37             CPL     A
0019 962E           JNZ     DEBNC           ;JUMP IF KEY DOWN
                    ;
001B FB             MOV     A,R3            ;ADD OFFSET TO TABLE POINTER
001C 0308           ADD     A,#8
001E AB             MOV     R3,A
                    ;
001F B5             CPL     F1              ;SET THE PORT SELECT FLAG
0020 0A             IN      A,P2            ;READ THE SECOND PORT
0021 37             CPL     A
```

```
0022 962F        128          JNZ     DEBNC          ;JUMP IF KEY DOWN
                 129 ;
0024 FB          130          MOV     A,R3           ;ADD OFFSET TO TABLE POINTER
0025 0308        131          ADD     A,#8
0027 AB          132          MOV     R3,A
                 133 ;
0028 1A          134          INC     R2             ;INC FOR NEXT STROBE
0029 FA          135          MOV     A,R2           ;CHECK IF LAST STROBE
002A 520C        136          JB2     SCAN           ;JUMP IF TRUE, RESET POINTERS
002C 0410        137          JMP     SCAN10         ;LOOP FOR NEXT STROBE
                 138 ;
002E AE          139 DEBNC:   MOV     R6,A           ;TEMP STORE THE DART DATA
002F BF64        140          MOV     R7,#100        ;SET THE LOOK COUNTER
0031 BD00        141          MOV     R5,#0
0033 1489        142 DBNC10:  CALL    TIME2          ;DELAY FOR 100 USEC
0035 763A        143          JF1     DBNC12         ;JUMP IF PORT SELECT FLAG SET
0037 09          144          IN      A,P1           ;READ THE FIRST PORT
0038 043F        145          JMP     DBNC15         ;JUMP FOR RELEASE
003A 0A          146 DBNC12:  IN      A,P2           ;READ THE DART DATA
003B 37          147 DBNC15:  CPL     A
003C DE          148          XRL     A,R6           ;CHECK IF STILL THERE
003D 9640        149          JNZ     DBNC20         ;JUMP IF NOT THERE
003F 1D          150          INC     R5             ;INC HIT COUNTER
0040 EF33        151 DBNC20:  DJNZ    R7,DBNC10      ;LOOP FOR NEXT LOOK
                 152 ;
0042 97          153          CLR     C              ;CHECK IF GOOD HIT
0043 FD          154          MOV     A,R5
0044 03FA        155          ADD     A,#NUMBER
0046 F64A        156          JC      RELESE         ;JUMP IF GOOD HIT
0048 040C        157          JMP     SCAN           ;JUMP FOR NOISE
                 158 ;
004A BD64        159 RELESE:  MOV     R5,#100        ;RESET RELEASE TIMING REGISTERS
004C BF64        160 REL00:   MOV     R7,#100
004E 1483        161 REL10:   CALL    TIME           ;DELAY FOR 100 USEC
0050 8804        162          ORL     BUS,#LMPON     ;TURN ON LAMP
0052 7657        163          JF1     REL20
0054 09          164          IN      A,P1
0055 045B        165          JMP     REL30
0057 0A          166 REL20:   IN      A,P2           ;READ THE DART CODE
0058 37          167 REL30:   CPL     A
0059 C661        168          JZ      DECODE         ;JUMP IF DART RELEASED
005B EF4E        169          DJNZ    R7,REL10       ;LOOP AND KEEP LOOKING
005D ED4C        170          DJNZ    R5,REL00
005F 14B0        171          CALL    STUCK          ;JUMP FOR A STUCK DART
                 172 ;
0061 98FB        173 DECODE:  ANL     BUS,#LMPOFF    ;TURN OFF LAMP
0063 BC01        174          MOV     R4,#01         ;RESET THE COLUMN CHECK MASK
0065 FE          175 DEC10:   MOV     A,R6           ;GET THE DART DATA
0066 5C          176          ANL     A,R4           ;CHECK IF DART THIS COLUMN
```

```
0067 9673          JNZ     DEC20          ;JUMP IF THIS COLUMN
0069 97            CLR     C
006A FC            MOV     A,R4           ;SHIFT THE COLUMN CHECK MASK
006B F7            RLC     A
006C AC            MOV     R4,A
006D 1B            INC     R3             ;INC THE TABLE POINTER
006E E665          JNC     DEC10          ;JUMP IF NOT LAST COLUMN
0070 CB            DEC     R3             ;DEC THE TABLE POINTER
0071 040C          JMP     SCAN           ;JUMP IF NO DART
0073 FB            MOV     A,R3           ;GET THE TABLE POINTER
0074 E3            MOVP3   A,@A           ;LOOK UP DART CODE
0075 148F          CALL    SEND           ;SEND THE DART CODE
                   ;
0077 BD64          MOV     R5,#100        ;300 MSEC DELAY
0079 BF1E          MOV     R7,#30
007B 1483          CALL    TIME
007D EF7B          DJNZ    R7,WAIT20
007F ED79          DJNZ    R5,WAIT10
                   ;
0081 040C          JMP     SCAN           ;SENT THE DART CODE TO THE MASTER
                   ;
                   ;
0083 230D          MOV     A,#13          ;DELAY FOR 100 USEC
0085 07            DEC     A
0086 9685          JNZ     TIME00
0088 83            RET
                   ;
0089 2302          MOV     A,#2
008B 07            DEC     A
008C 968B          JNZ     TMLP
008E 83            RET
                   ;
008F 85            CLR     F0             ;CLEAR THE DATA FLAG
0090 AA            MOV     R2,A           ;TEMP STORE THE DART CODE
0091 47            SWAP    A              ;GET LOWER NIBBLE IN BITS 6--3
0092 77            RR      A
0093 5378          ANL     A,#78H         ;MASK OFF ALL OTHER DATA
0095 AC            MOV     R4,A           ;TEMP STORE THE CODE TO SEND
0096 08            INS     A,BUS          ;READ THE LAST BUS DATA
0097 5387          ANL     A,#87H         ;CLEAR ONLY THE TRANSMIT BITS 6--3
0099 4C            ORL     A,R4           ;GET SEND DATA INTO TRANSMIT BITS
009A 02            OUTL    BUS,A          ;PUT DATA ON BUS
009B 00            NOP
                   ;
009C 987F          ANL     BUS,#7FH       ;TAKE THE DATA RDY LINE LOW
009E 369E          JT0     SND10          ;WAIT FOR DART REC'D LINE TO GO LOW
00A0 26A0          JNT0    SND20          ;WAIT FOR DATA REC'D TO GO HIGH
00A2 8880          ORL     BUS,#80H       ;BRING THE DATA RDY LINE BACK HIGH
00A4 B6AA          JF0     SNDRET         ;JUMP IF END OF TRANSMISSION
00A6 95            CPL     F0             ;SET THE DATA FLAG
```

```
00A7 FA          227          MOV     A,R2          ;GET THE DART CODE FROM TEMP STORE
00A8 0492        228          JMP     SND0          ;LOOP FOR NEXT NIBBLE TRANSMISSION
00AA 85          229 SNDRET:  CLR     F0
00AB 83          230          RET
                 231 ;
00AC 95          232 SND30:   CPL     F0
00AD FA          233          MOV     A,R2
00AE 0492        234          JMP     SND0
                 235 ;
00B0 85          236 STUCK:   CLR     F0
00B1 23FF        237          MOV     A,#0FFH       ;SEND THE STUCK CODE TO GAME CPU
00B3 148F        238          CALL    SEND
                 239 ;
00B5 76BA        240 STK0:    JF1     STK1
00B7 09          241          IN      A,P1
00B8 04BB        242          JMP     STK2
00BA 0A          243 STK1:    IN      A,P2
00BB 37          244 STK2:    CPL     A
00BC C6D6        245          JZ      STKRET
                 246 ;
00BE BD64        247          MOV     R5,#100
00C0 BF32        248          MOV     R7,#50
00C2 B6C9        249          JF0     STK10
                 250 ;
00C4 98FB        251          ANL     BUS,#0FBH     ;TURN OFF THE REMOVE DARTS LAMP
00C6 95          252          CPL     F0
00C7 04CC        253          JMP     STK20
                 254 ;
00C9 8804        255 STK10:   ORL     BUS,#04H      ;TURN ON THE REMOVE DATS LAMP
00CB 95          256          CPL     F0
                 257 ;
00CC 1483        258 STK20:   CALL    TIME          ;DELAY AND LOOP FOR NEXT LOOK
00CE EFCC        259          DJNZ    R7,STK20
00D0 BF32        260          MOV     R7,#50
00D2 EDCC        261          DJNZ    R5,STK20
00D4 04B5        262          JMP     STK0
                 263 ;
00D6 8804        264 STKRET:  ORL     BUS,#04H
00D8 85          265          CLR     F0
00D9 BDC8        266          MOV     R5,#200
00DB BF64        267 STK30:   MOV     R7,#100
00DD 1483        268 STK40:   CALL    TIME
00DF EFDD        269          DJNZ    R7,STK40
00E1 EDDB        270          DJNZ    R5,STK30
00E3 83          271          RET
                 272 ;
                 273 ;*****************************************************************
                 274 ;
```

```
MCS-51 MACRO ASSEMBLER    DRTOS2
6

 NAME                 TYPE  VALUE      ATTRIBUTES

 SEL_GM75. . . . . . . C ADDR   01ACH   R      SEG=SYSTEM_ROUTINES
 SEL_GM80. . . . . . . C ADDR   01B0H   R      SEG=SYSTEM_ROUTINES
 SEL_GM81. . . . . . . C ADDR   01B9H   R      SEG=SYSTEM_ROUTINES
 SELECT_GAME . . . . . C ADDR   00B0H   R      SEG=SYSTEM_ROUTINES
 SEVEN . . . . . . . .   NUMB   000EH   A
 SHANG_HAI_BUTTON. . . B ADDR   00E0H.5 A
 SHANG_HAI_LAMP. . . .   NUMB   0020H   A
 SINGLE. . . . . . . . B ADDR   0022H.6 A
 SIX . . . . . . . . .   NUMB   00F8H   A
 SKIP00. . . . . . . . C ADDR   02B8H   R      SEG=SYSTEM_ROUTINES
 SKIP01. . . . . . . . C ADDR   036EH   R      SEG=SYSTEM_ROUTINES
 SKIP02. . . . . . . . C ADDR   038DH   R      SEG=SYSTEM_ROUTINES
 SKIP03. . . . . . . . C ADDR   03ACH   R      SEG=SYSTEM_ROUTINES
 SND_JMP . . . . . . . C ADDR   0508H   R      SEG=SYSTEM_ROUTINES
 SOUND_GEN . . . . . . C ADDR   ----      EXT
 SP. . . . . . . . . . D ADDR   0081H   A
 SPEECH_PORT . . . . . X ADDR   0080H   A
 START . . . . . . . . C ADDR   005AH   R      SEG=SYSTEM_ROUTINES
 START10 . . . . . . . C ADDR   006AH   R      SEG=SYSTEM_ROUTINES
 START11 . . . . . . . C ADDR   0070H   R      SEG=SYSTEM_ROUTINES
 START20 . . . . . . . C ADDR   007BH   R      SEG=SYSTEM_ROUTINES
 START30 . . . . . . . C ADDR   008AH   R      SEG=SYSTEM_ROUTINES
 STK_NUM . . . . . . .   NUMB   0025H   A
 STOP_FLAG . . . . . . B ADDR   0023H.0 A
 STOP_PNTR . . . . . . I ADDR   0049H   A
 STOP_REG1A. . . . . . D ADDR   0048H   A
 STOP_REG1B. . . . . . D ADDR   0047H   A
 STOP_REG1C. . . . . . D ADDR   0046H   A
 STOP_REG2A. . . . . . D ADDR   0045H   A
 STOP_REG2B. . . . . . D ADDR   0044H   A
 STOP_REG2C. . . . . . D ADDR   0043H   A
 STOP_REG3A. . . . . . D ADDR   0042H   A
 STOP_REG3B. . . . . . I ADDR   0041H   A
 STOP_REG3C. . . . . . D ADDR   0040H   A
 STOP_REG4A. . . . . . D ADDR   003FH   A
 STOP_REG4B. . . . . . I ADDR   003EH   A
 STOP_REG4C. . . . . . I ADDR   003DH   A
 STUCK . . . . . . . . C ADDR   ----      EXT
 SW_TEST0. . . . . . . C ADDR   058DH   R      SEG=SYSTEM_ROUTINES
 SW_TEST1. . . . . . . C ADDR   0590H   R      SEG=SYSTEM_ROUTINES
 SW_TEST10 . . . . . . C ADDR   05A3H   R      SEG=SYSTEM_ROUTINES
 SW_TEST20 . . . . . . C ADDR   05A6H   R      SEG=SYSTEM_ROUTINES
 SW_TEST30 . . . . . . C ADDR   05B6H   R      SEG=SYSTEM_ROUTINES
```

```
SW_TEST40 . . . . . .  C ADDR    05B8H    R      SEG=SYSTEM_ROUTINES
SWAP_FLAG . . . . . .  B ADDR    0022H.6  A
SWITCH_BUFFER . . . .  D ADDR    004CH    A
SWITCH_DEBOUNCE . . .    NUMB    00FFH    A
SWITCH_DOWN . . . . .  B ADDR    0021H.6  A
SWITCH_ENABLE . . . .  B ADDR    0021H.7  A
SWITCH_RELEASE. . . .  B ADDR    0021H.5  A
SWITCH_TEMP . . . . .  D ADDR    004AH    A
SWITCH_TEST_TABLE . .  C ADDR    06B4H    R      SEG=SYSTEM_ROUTINES
SWITCH_TEST . . . . .  C ADDR    057DH    R      SEG=SYSTEM_ROUTINES
SWITCH. . . . . . . .  C ADDR    043DH    R      SEG=SYSTEM_ROUTINES
SWITCH10. . . . . . .  C ADDR    0444H    R      SEG=SYSTEM_ROUTINES
SWITCH20. . . . . . .  C ADDR    044FH    R      SEG=SYSTEM_ROUTINES
SWITCH30. . . . . . .  C ADDR    0454H    R      SEG=SYSTEM_ROUTINES
SWITCH40. . . . . . .  C ADDR    0466H    R      SEG=SYSTEM_ROUTINES
SWITCH50. . . . . . .  C ADDR    046BH    R      SEG=SYSTEM_ROUTINES
SWITCH60. . . . . . .  C ADDR    0474H    R      SEG=SYSTEM_ROUTINES
SYSTEM_ROUTINES . . .  C SEG     06FDH           REL=UNIT
TA. . . . . . . . . .    NUMB    0072H    A
TAS . . . . . . . . .    NUMB    007AH    A
TB. . . . . . . . . .    NUMB    0003H    A
TC. . . . . . . . . .    NUMB    0011H    A
TCON. . . . . . . . .  D ADDR    0088H    A
TCS . . . . . . . . .    NUMB    0001H    A
TD. . . . . . . . . .    NUMB    0026H    A
TDS . . . . . . . . .    NUMB    0037H    A
TE. . . . . . . . . .    NUMB    0043H    A
TEMP_1_BUFR . . . . .  D ADDR    0072H    A
TEMP_10_BUFR. . . . .  D ADDR    0071H    A
TEMP_100_BUFR . . . .  D ADDR    0073H    A
TEMP_CY . . . . . . .  B ADDR    0022H.2  A
TEMP_H. . . . . . . .  D ADDR    0054H    A
TEMP_L. . . . . . . .  D ADDR    0055H    A
TEMP_SCORE_H. . . . .  D ADDR    006EH    A
TEMP_SCORE_L. . . . .  D ADDR    006FH    A
TEMP_SCORE_LAMP . . .    NUMB    0001H    A
TEN_MSEC. . . . . . .    NUMB    000AH    A
TEN_SEC . . . . . . .    NUMB    0064H    A
TEST_A. . . . . . . .  C ADDR    04C7H    R      SEG=SYSTEM_ROUTINES
TEST_MODE . . . . . .  B ADDR    00B0H.5  A
TEST_TONE . . . . . .  B ADDR    0023H.5  A
TEST. . . . . . . . .  C ADDR    04B6H    R      SEG=SYSTEM_ROUTINES
TEST0 . . . . . . . .  C ADDR    04D4H    R      SEG=SYSTEM_ROUTINES
TEST1 . . . . . . . .  C ADDR    04E0H    R      SEG=SYSTEM_ROUTINES
TF. . . . . . . . . .    NUMB    004DH    A
TFS . . . . . . . . .    NUMB    0057H    A
TG. . . . . . . . . .    NUMB    0061H    A
TGS . . . . . . . . .    NUMB    0065H    A
TH0 . . . . . . . . .  D ADDR    008CH    A
```

```
TH1 . . . . . . . . . .  D ADDR    008DH    A
THREE_SEC . . . . . .      NUMB    001EH    A
THREE . . . . . . . . .    NUMB    009EH    A
THROW_PARTS_LAMP. . .      NUMB    0002H    A
TIMER_COUNT . . . . .      NUMB    0064H    A
TIMER_FLAG. . . . . .  B ADDR    0020H.4  A
TIMER_INTR. . . . . .  C ADDR    02C3H    R        SEG=SYSTEM_ROUTINES
TIMER_INTR10. . . . .  C ADDR    0305H    R        SEG=SYSTEM_ROUTINES
TIMER_INTR20. . . . .  C ADDR    030FH    R        SEG=SYSTEM_ROUTINES
TIMER_INTR22. . . . .  C ADDR    0325H    R        SEG=SYSTEM_ROUTINES
TIMER_INTR24. . . . .  C ADDR    0328H    R        SEG=SYSTEM_ROUTINES
TIMER_INTR25. . . . .  C ADDR    0338H    R        SEG=SYSTEM_ROUTINES
TIMER_INTR26. . . . .  C ADDR    0344H    R        SEG=SYSTEM_ROUTINES
TIMER_INTR27. . . . .  C ADDR    0350H    R        SEG=SYSTEM_ROUTINES
TIMER_INTR28. . . . .  C ADDR    0372H    R        SEG=SYSTEM_ROUTINES
TIMER_INTR29. . . . .  C ADDR    0391H    R        SEG=SYSTEM_ROUTINES
TIMER_INTR30. . . . .  C ADDR    03ADH    R        SEG=SYSTEM_ROUTINES
TIMER_INTR40. . . . .  C ADDR    03C7H    R        SEG=SYSTEM_ROUTINES
TIMER_INTR5 . . . . .  C ADDR    02EEH    R        SEG=SYSTEM_ROUTINES
TIMER_INTR50. . . . .  C ADDR    03CDH    R        SEG=SYSTEM_ROUTINES
TIMER_INTR60. . . . .  C ADDR    03D3H    R        SEG=SYSTEM_ROUTINES
TIMER_INTR65. . . . .  C ADDR    03E7H    R        SEG=SYSTEM_ROUTINES
TIMER_INTR70. . . . .  C ADDR    03FEH    R        SEG=SYSTEM_ROUTINES
TIMER_INTR72. . . . .  C ADDR    040AH    R        SEG=SYSTEM_ROUTINES
TIMER_INTR73. . . . .  C ADDR    040EH    R        SEG=SYSTEM_ROUTINES
TIMER_INTR80. . . . .  C ADDR    041DH    R        SEG=SYSTEM_ROUTINES
TIMER_REG . . . . . .  D ADDR    005BH    A
TL1 . . . . . . . . . .  D ADDR    008BH    A
TMOD. . . . . . . . . .  D ADDR    0089H    A
TONE_FLAG . . . . . .  B ADDR    0020H.7  A
TONE_LENGTH . . . . .  D ADDR    004FH    A
TONE_OUT. . . . . . .  B ADDR    00B0H.4  A
TONE_PTR. . . . . . .  D ADDR    0052H    A
TONE_TEST . . . . . .  C ADDR    0640H    R        SEG=SYSTEM_ROUTINES
TONE_TEST10 . . . . .  C ADDR    064AH    R        SEG=SYSTEM_ROUTINES
TOUCH_FLAG. . . . . .  B ADDR    0021H.3  A
TOUCH_REG1. . . . . .  D ADDR    0044H    A
TOUCH_REG2. . . . . .  D ADDR    0043H    A
TPI_PART. . . . . . .  B ADDR    00E0H.6  A
TR0 . . . . . . . . . .  B ADDR    0088H.4  A
TR1 . . . . . . . . . .  B ADDR    0088H.6  A
TRIPLE. . . . . . . .  B ADDR    0023H.0  A
TT. . . . . . . . . . .    NUMB    00F0H    A
TUNE_H. . . . . . . .  D ADDR    0050H    A
TUNE_I. . . . . . . .  D ADDR    0051H    A
TWENTYFIVE_CENTS_LAMP      NUMB    0001H    A
TWO_SEC . . . . . . .      NUMB    0014H    A
TWO . . . . . . . . . .    NUMB    00B6H    A
U . . . . . . . . . . .    NUMB    007CH    A
```

```
USER_FLAG . . . . . . .  B ADDR    0020H.3 A
WIN_FLAG. . . . . . . .  B ADDR    0022H.5 A
WIN . . . . . . . . . .  C ADDR    ----      EXT
X . . . . . . . . . . .    NUMB    00FFH   A
X301_BUTTON . . . . . .  B ADDR    00E0H.6 A
X301_LAMP . . . . . . .    NUMB    0010H   A
X501_BUTTON . . . . . .  B ADDR    00E0H.0 A
X501_LAMP . . . . . . .    NUMB    0008H   A
XA. . . . . . . . . . .    NUMB    0002H   A
XB. . . . . . . . . . .    NUMB    0004H   A
XC. . . . . . . . . . .    NUMB    0008H   A
XD. . . . . . . . . . .    NUMB    0010H   A
XE. . . . . . . . . . .    NUMB    0020H   A
XF. . . . . . . . . . .    NUMB    0040H   A
XG. . . . . . . . . . .    NUMB    0080H   A
ZERO_FLAG . . . . . . .  B ADDR    0023H.3 A
ZERO. . . . . . . . . .    NUMB    007EH   A

REGISTER BANK(S) USED: 0, TARGET MACHINE(S): 8051

ASSEMBLY COMPLETE, NO ERRORS FOUND


MCS-51 MACRO ASSEMBLER    GAMES2
1


 ISIS-II MCS-51 MACRO ASSEMBLER V2.0
 OBJECT MODULE PLACED IN :F1:GAMES2.OBJ
 ASSEMBLER INVOKED BY:  :F4:ASM51 :F1:GAMES2.REL NOGEN


 LOC  OBJ            LINE     SOURCE

                        1     ;*********************************************************************
                        2     ;
                        3     ;       THIS PROGRAM IS FOR THE IDEA DART GAME VERSION 1.0
                        4     ;       START OF PROGRAM 6/15/82 RVN
                        5     ;       FOR USE WITH AN INTEL 8031 CPU W/16K OF CODE PROM
                        6     ;
                        7     ;*********************************************************************
                        8     PUBLIC  ALL_LAMPS_OFF, BEEP_BEEP, BIN_TO_DEC, BULL_TONE, BUST, CLEAR_DISPLAY
                        9     PUBLIC  COIN_TONE, DECODE_TABLE, END_TONE, GAME_301, GAME_COUNTUP, GAME_SCRAM
                       10     PUBLIC  GAME_SHANG_HAI, NEXT_TONE, SOUND_GEN, STUCK, WIN
                       11     ;
                       12     EXTRN CODE (INITIALIZE_SYSTEM, INPUT_SWITCHES)
                       13     ;
                       14
```

```
                 15   ;        INTERNAL RAM EQUATES FOR DISPLAY BUFFERS        (LAST RAM  89 )
                 16   ;        ----------------------------------------
007F             17   PLYR1_100_BUFR  DATA    127
007E             18   PLYR2_100_BUFR  DATA    126
007D             19   PLYR3_100_BUFR  DATA    125
007C             20   PLYR4_100_BUFR  DATA    124
007B             21   PLYR1_10_BUFR   DATA    123
007A             22   PLYR2_10_BUFR   DATA    122
0079             23   PLYR3_10_BUFR   DATA    121
0078             24   PLYR4_10_BUFR   DATA    120
0077             25   PLYR1_1_BUFR    DATA    119
0076             26   PLYR2_1_BUFR    DATA    118
0075             27   PLYR3_1_BUFR    DATA    117
0074             28   PLYR4_1_BUFR    DATA    116
0073             29   TEMP_100_BUFR   DATA    115
0072             30   TEMP_1_BUFR     DATA    114
0071             31   TEMP_10_BUFR    DATA    113
0070             32   ROUND_DART_BUFR DATA    112
                 33   ;
                 34   $EJECT
                 35   ;        EQUATES FOR 7-SEGMENT DISPLAY CODE
                 36   ;        ----------------------------------
0001             37   DP       EQU     00000001B
0002             38   XA       EQU     00000010B
0004             39   XB       EQU     00000100B
0008             40   XC       EQU     00001000B
0010             41   XD       EQU     00010000B
0020             42   XE       EQU     00100000B
0040             43   XF       EQU     01000000B
0080             44   XG       EQU     10000000B
                 45   ;
007E             46   ZERO     EQU     XA OR XB OR XC OR XD OR XE OR XF
000C             47   ONE      EQU     XB OR XC
00B6             48   TWO      EQU     XA OR XB OR XD OR XE OR XG
009E             49   THREE    EQU     XA OR XB OR XC OR XD OR XG
00CC             50   FOUR     EQU     XB OR XC OR XF OR XG
00DA             51   FIVE     EQU     XA OR XC OR XD OR XF OR XG
00F8             52   SIX      EQU     XC OR XD OR XE OR XF OR XG
000F             53   SEVEN    EQU     XA OR XB OR XC
00FE             54   EIGHT    EQU     XA OR XB OR XC OR XD OR XE OR XF OR XG
00CE             55   NINE     EQU     XA OR XB OR XC OR XF OR XG
                 56   ;
00EE             57   AA       EQU     XA OR XB OR XC OR XE OR XF OR XG
00FC             58   SD       EQU     XB OR XC OR XD OR XE OR XG
00DA             59   S        EQU     XA OR XC OR XD OR XF OR XG
00E0             60   CC       EQU     XD OR XE OR XG
00A0             61   R        EQU     XE OR XG
00F0             62   TT       EQU     XD OR XE OR XF OR XG
00F6             63   PP       EQU     XA OR XB OR XE OR XF OR XG
00F2             64   E        EQU     XA OR XD OR XE OR XF OR XG
```

```
00FE    PB      EQU     XC OR XD OR XE OR XF OR XG
        ;
        $EJECT
        ;       EQUATES FOR TONE GENERATION
        ;       ---------------------------
0072    TA      EQU     72H
007A    TAS     EQU     7AH
0003    TB      EQU     03H
0011    TC      EQU     11H
0001    TCS     EQU     01H
0026    TD      EQU     26H
0037    TDS     EQU     37H
0043    TE      EQU     43H
004D    TF      EQU     4DH
0057    TFS     EQU     57H
0061    TG      EQU     61H
0065    TGS     EQU     65H
00FF    X       EQU     0FFH
        ;
        $EJECT
        ;       INTERNAL RAM EQUATES FOR GAME SCORING
        ;       -------------------------------------
006F    TEMP_SCORE_L    DATA    111
006E    TEMP_SCORE_H    DATA    110
006D    PLYR1_SCORE_L   DATA    109
006C    PLYR1_SCORE_H   DATA    108
006B    PLYR2_SCORE_L   DATA    107
006A    PLYR2_SCORE_H   DATA    106
0069    PLYR3_SCORE_L   DATA    105
0068    PLYR3_SCORE_H   DATA    104
0067    PLYR4_SCORE_L   DATA    103
0066    PLYR4_SCORE_H   DATA    102
        ;
        ;       INTERNAL RAM ADDRESS FOR LAMP BANK REGISTERS
        ;       --------------------------------------------
0065    BANK1_REG       DATA    101
0064    BANK2_REG       DATA    100
0063    BANK3_REG       DATA    99
005F    BANK1_FLASH_REG DATA    95
005E    BANK2_FLASH_REG DATA    94
005D    BANK3_FLASH_REG DATA    93
        ;
        ;       INTERNAL RAM EQUATES (GENERAL PURPOSE REGISTERS)
        ;       ------------------------------------------------
0062    COIN_COUNT      DATA    98      ;BIT SET FOR EACH COIN DROP
0061    FLASH_TIMER     DATA    97      ;USED TO TIME FLASHING LAMPS
0060    FLASH_PTR       DATA    96      ;POINTER USED TO ACCESS LAMP TABLES
005C    MSG_PNTR        DATA    92      ;USED FOR POINTER TO MESSAGE
005B    TIMER_REG       DATA    91      ;USED FOR 100 MSEC BASE TIMER
```

```
005A   PLAYER_COUNT     DATA    90    ;NUMBER OF PLAYERS PLAYING
0059   DART_BUFFER      DATA    89    ;HOLDS CODE FOR DART THROWN
0058   DOUBLE_FLAG      DATA    88    ;USED FOR DOUBLE IN GAMES
0057   DART_SCORE       DATA    87    ;BCD OF DART VALUE
0056   LAMP_PNTR        DATA    86    ;USED TO DISPLAY PLAYER LAMPS
0055   TEMP_L           DATA    85    ;TEMP STORE FOR PLAYERS SCORE LOW BYTE
0054   TEMP_H           DATA    84    ;  "    "    "    "    "    HIGH  "
0053   DV               DATA    83
0052   TONE_PTR         DATA    82    ;USED FOR TONE GENERATION (TABLE PNTR)
0051   TUNE_L           DATA    81
0050   TUNE_H           DATA    80
004F   TONE_LENGTH      DATA    79    ;USED FOR LENGTH OF TONE TIMER
004E   DELAY_REG        DATA    78    ;USED IN 1 MSEC BASED DELAY ROUTINE
004D   ROUND_COUNT      DATA    77    ;USED FOR COUNTING ROUNDS DURING GAME
004C   SWITCH_BUFFER    DATA    76    ;USED FOR READING SWITCHES
004B   DEBOUNCE_TIMER   DATA    75
004A   SWITCH_TEMP      DATA    74
0049   PLYR1_NEXT       DATA    73    ;USED IN SHANG HAI
0048   PLYR2_NEXT       DATA    72    ;  "    "    "    "
0047   PLYR3_NEXT       DATA    71    ;  "    "    "    "
0046   PLYR4_NEXT       DATA    70    ;  "    "    "    "
0049   STOP_PNTR        DATA    73    ;USED IN SCRAM FOR STOP REG PNTR
0048   STOP_REG1A       DATA    72    ;THREE LOCATIONS FOR STOP REG 1ST TEAM
0047   STOP_REG1B       DATA    71
0046   STOP_REG1C       DATA    70
0045   STOP_REG2A       DATA    69    ;THREE LOCATIONS FOR STOP REG 2ND TEAM
0044   STOP_REG2B       DATA    68
0043   STOP_REG2C       DATA    67
0042   STOP_REG3A       DATA    66
0041   STOP_REG3B       DATA    65
0040   STOP_REG3C       DATA    64
003F   STOP_REG4A       DATA    63
003E   STOP_REG4B       DATA    62
003D   STOP_REG4C       DATA    61
       ;
       ;        EXTERNAL RAM ADDRESS FOR DISPLAY ROW DATA BUFFERS
       ;        ------------------------------------------------
       ;
0020   DIGIT_ROW0       XDATA   20H
0004   DIGIT_ROW1       XDATA   04H
0010   DIGIT_ROW2       XDATA   10H
0002   DIGIT_ROW3       XDATA   02H
       ;
       ;        EXTERNAL RAM ADDRESS FOR LAMP DRIVER BUFFERS
       ;        --------------------------------------------
0040   LAMP_BANK1       XDATA   40H
0080   LAMP_BANK2       XDATA   80H
0001   LAMP_BANK3       XDATA   01H
       ;
```

```
                ;       EXTERNAL RAM LOCATION FOR SPEECH BOARD COMMUNICATION
                ;       ----------------------------------------------------
0080            SPEECH_PORT     XDATA   80H
                ;
                ;       DISPLAY STROBE PORT LOCATIONS
                ;       -----------------------------
0094            DIGIT_COL0      BIT     P1.4
0095            DIGIT_COL1      BIT     P1.5
0096            DIGIT_COL2      BIT     P1.6
0097            DIGIT_COL3      BIT     P1.7
                ;
                ;       SYMBOL EQUATES FOR CONTROL CONSTANTS
                ;       ------------------------------------
0025            STK_NUM                 EQU     37
00FF            COIN_DEBOUNCE           EQU     0FFH
00FF            SWITCH_DEBOUNCE         EQU     0FFH
0073            GAME_SELECT_MASK        EQU     01110011B
0002            REG2                    EQU     02H
0004            FLASH_PTR_END           EQU     04H
003E            GAME_LAMPS              EQU     00111110B
003F            FLASH_COUNT             EQU     03FH
00E4            TIMER_COUNT             EQU     100
00E4            TEN_SEC                 EQU     100
001E            THREE_SEC               EQU     30
0014            TWO_SEC                 EQU     20
0005            HALF_SEC                EQU     5
00C3            PLAYER_LAMPS_OFF        EQU     11000011B
003C            PLAYER_LAMPS            EQU     00111100B
0096            FIFTEEN_SEC             EQU     150
000A            TEN_MSEC                EQU     10
0005            FIVE_MSEC               EQU     05
000A            DBNC_TIME               EQU     10
0015            LAST_CHECK              EQU     21
001B            B3_REG3                 EQU     27
001C            B3_REG4                 EQU     28
                ;
                ;               LAMP BANK1 EQUATES
                ;               ------------------
0001            TEMP_SCORE_LAMP         EQU     01H
0002            THROW_DARTS_LAMP        EQU     02H
0004            PLAYER1_LAMP            EQU     04H
0008            PLAYER3_LAMP            EQU     08H
0010            PLAYER4_LAMP            EQU     10H
0020            PLAYER2_LAMP            EQU     20H
0040            GAME_OVER_LAMP          EQU     40H
0080            PLYR_CHANGE_LAMP        EQU     80H
                ;
                ;               LAMP BANK2 EQUATES
                ;               ------------------
```

```
0001          DARTS_THROWN_LAMP      EQU     01H
0002          BUST_LAMP              EQU     02H
0004          OUTPUT1_LAMP           EQU     04H
0008          OUTPUT2_LAMP           EQU     08H
0010          OVER_HEAD_LAMP         EQU     10H
0020          GAME_ROUND_LAMP        EQU     20H
0040          FIFTY_CENTS_LAMP       EQU     40H
0080          REMOVE_DARTS_LAMP      EQU     80H
              ;
              ;                LAMP BANK3 EQUATES
              ;                ------------------
0001          TWENTYFIVE_CENTS_LAMP  EQU     01H
0004          COUNTUP_LAMP           EQU     04H
0002          SCRAM_LAMP             EQU     02H
0008          X501_LAMP              EQU     08H
0010          X301_LAMP              EQU     10H
0020          SHANG_HAI_LAMP         EQU     20H
0040          DBI_IN_LAMP            EQU     40H
0080          DBI_OUT_LAMP           EQU     80H
              ;
              ;        BIT EQUATES FOR SOFTWARE FLAGS
              ;        ------------------------------
0000          DBI_IN_FLAG     BIT    00      ;SET WHEN DOUBLE IN BUTTON PUSHED
0001          DBL_OUT_FLAG    BIT    01      ;SET WHEN DOUBLE OUT BUTTON PUSHED
0002          FLASH_FLAG      BIT    02      ;USED WHEN FLASHING GAME SELECT LAMPS
0003          DART_THROWN     BIT    03      ;SET WHEN FIRST DART IS THROWN
0004          TIMER_FLAG      BIT    04      ;SET WHEN 100 MSEC BASE TIMER TIMES OUT
0005          PAUSE_FLAG      BIT    05      ;USED FOR TONE GENERATION PAUSES
0006          FLG501          BIT    06      ;SET WHEN PLAYING 501
0007          TONE_FLAG       BIT    07      ;SET WHEN PLAYING TONES
              ;
0008          DOUBLE_BYTE     BIT    08      ;SET WHEN ADDING DOUBLE BYTE NUMBERS
0009          BLANK           BIT    09      ;SET WHEN HUNDS DIGIT IS BLANK
000A          COIN_UP         BIT    10      ;SET WHEN GAME STARTS
000B          FIRST_TIME      BIT    11      ;SET WHEN FIRST ENTERING GAME ROUTINE
000C          CHANGE_PLAYER   BIT    12      ;SET WHEN PLAYER CHANGE PUSHED
000D          SWITCH_RELEASE  BIT    13      ;SET WHEN WAITING FOR SWITCH TO RELEASE
000E          SWITCH_DOWN     BIT    14      ;SET WHEN SWITCH PUSHED
000F          SWITCH_ENABLE   BIT    15      ;SET WHEN READING SWITCHES
              ;
0010          GAME_START      BIT    16      ;SET WHEN COIN DROPS, CLEARED AFTER GAME
0011          ADD_COIN        BIT    17
0012          TEMP_CY         BIT    18      ;USED TO TEMP STORE THE CARRY BIT
0013          BULL_FLAG       BIT    19      ;SET TO PLAY BULLS EYE TONE
0014          BUST_FLAG       BIT    20      ;  "    "  "    BUST TONE
0015          WIN_FLAG        BIT    21      ;  "    "  "    WIN SONG
0016          SINGLE          BIT    22      ;USED DURING SHANG HAI GAME
0017          DOUBLE          BIT    23      ;  "       "      "    "
0016          SWAP_FLAG       BIT    22      ;USED FOR SCRAM
0017          SCORE_FLAG      BIT    23      ;  "    "
```

```
                ;
0018            TRIPLE          BIT     24      ; "     "       "     "     "
0018            STOP_FLAG       BIT     24      ; "     "       "
0019            LOAD            BIT     25
001A            GEN2            BIT     26
001B            ZERO_FLAG       BIT     27      ;USED IN BCD MATH
001C            EXIT            BIT     28
001D            TEST_TONE       BIT     29
                ;
                ;       BIT EQUATES FOR SWITCHES
                ;       ------------------------
00E6            X301_BUTTON             BIT     ACC.6
00E0            X501_BUTTON             BIT     ACC.0
00E1            COUNTUP_BUTTON          BIT     ACC.1
00E5            SHANG_HAI_BUTTON        BIT     ACC.5
00E4            SCRAM_BUTTON            BIT     ACC.4
00E2            DBI_IN_BUTTON           BIT     ACC.2
00E3            DBI_OUT_BUTTON          BIT     ACC.3
00E7            PLAYER_CHANGE_BUTTON    BIT     ACC.7
                ;
                ;       BIT EQUATES FOR DART CODE
                ;       -------------------------
00E5            DBL_DART        BIT     ACC.5
00E6            TPL_DART        BIT     ACC.6
00E7            BULLS_EYE       BIT     ACC.7
                ;
00E0            ODD_COIN        BIT     ACC.0
                ;
                ;       PORT 3 BIT ASSIGNMENTS
                ;       ----------------------
00B0            DART_SCAN               BIT     P3.0
00B1            DATA_REC                BIT     P3.1
00B2            COIN_DROP               BIT     P3.2
00B3            DATA_RDY                BIT     P3.3
00B4            TONE_OUT                BIT     P3.4
00B5            TEST_MODE               BIT     P3.5
                ;
                ;*************************************************************
                $EJECT
                ;*************************************************************
                ;       MACRO DEFINITIONS
                ;       -----------------
                ;
                        %*DEFINE(SELRB0)(
                                ANI     PSW,#0E7H
                        )
                ;
                        %*DEFINE(SELRB1)(
                                ANI     PSW,#0E7H
```

```
                SETB    PSW.3
            )
308     ;
309         %*DEFINE(SELRB2)(
                ANL     PSW,#0E7H
                SETB    PSW.4
            )
310     ;
311         %*DEFINE(SELRB3)(
                ANL     PSW,#0E7H
                ORL     PSW,#18H
            )
312     ;
313         %*DEFINE(READ_SWITCH)(
                MOVX    A,@R0
                CPL     A
            )
314     ;
315         %*DEFINE(PLAY(TUN))LOCAL SKIP
            (   JB      TR0,%SKIP
                PUSH    DPH
                PUSH    DPL
                MOV     DPTR,#%TUN
                MOV     TUNE_L,DPL
                MOV     TUNE_H,DPH
                POP     DPL
                POP     DPH
                SETB    TR0
            %SKIP:  NOP
        )
316     ;
317         %*DEFINE(DELAY(TIME))(
                MOV     DELAY_REG,#%TIME
                MOV     A,DELAY_REG
                JNZ     $-2
            )
318     ;
319         %*DEFINE(WAIT(TIME2))(
                MOV     TIMER_REG,#%TIME2
                CLR     TIMER_FLAG
                JNB     TIMER_FLAG,$
            )
320     ;
321         %*DEFINE(SCAN)(
                MOV     DART_BUFFER,#0
                SETB    DART_SCAN
                CLR     DATA_REC
                %DELAY(FIVE_MSEC)
                CLR     DART_SCAN
```

```
                                SETB    DATA_REC
                        )
                ;
                        %*DEFINE(STOP_SCAN)(
                                SETB    DART_SCAN
                                CLR     DATA_REC
                                %DELAY(FIVE_MSEC)
                                CLR     DART_SCAN
                        )
                ;
                $EJECT
                ;*************************************************************************
                GAME_ROUNTINES SEGMENT CODE
----                    RSEG    GAME_ROUNTINES
                ;
                ;       START OF GAME FILE
                ;       ------------------
                ;
                ;       PLAYER LAMPS DRIVE FROM LAMP BANK1
                ;
0000 04         PLAYER_LAMP_TABLE:      DB      PLAYER1_LAMP
0001 20                                 DB      PLAYER2_LAMP
0002 08                                 DB      PLAYER3_LAMP
0003 10                                 DB      PLAYER4_LAMP
                ;
                ;*************************************************************************
                ;
0004 787F       CLEAR_DISPLAY:  MOV     R0,#PLYR1_100_BUFR
0006 E4                         CLR     A
0007 F6         CLR_LOOP:       MOV     @R0,A
0008 18                         DEC     R0
0009 B870FB                     CJNE    R0,#ROUND_DART_BUFR,CLR_LOOP
000C 22                         RET
                ;
                ;*************************************************************************
                ;
000D 756500     ALL_LAMPS_OFF:  MOV     BANK1_REG,#0
0010 756300                     MOV     BANK3_REG,#0
0013 536410                     ANL     BANK2_REG,#OVER_HEAD_LAMP
0016 22                         RET
                ;
                ;*************************************************************************
                ;
0017 C083       DISPLAY_SCORE:  PUSH    DPH
0019 C082                       PUSH    DPL
001B C209                       CLR     BLANK           ;CLEAR THE BLANK FLAG
001D 900000   F                 MOV     DPTR,#DECODE_TABLE
                ;
0020 797F                       MOV     R1,#PLYR1_100_BUFR      ;CHECK IF PLYR1
```

```
0022 B86C03          CJNE   R0,#PLYR1_SCORE_H,DIS_SCR10
0025 020000    F     JMP    DIS_SCR50
                     ;
0028 19              DIS_SCR10:  DEC    R1                      ;CHECK IF PLAYER 2
0029 B86A03          CJNE   R0,#PLYR2_SCORE_H,DIS_SCR20
002C 020000    F     JMP    DIS_SCR50
                     ;
002F 19              DIS_SCR20:  DEC    R1                      ;CHECK IF PLAYER 3
0030 B86803          CJNE   R0,#PLYR3_SCORE_H,DIS_SCR30
0033 020000    F     JMP    DIS_SCR50
                     ;
0036 19              DIS_SCR30:  DEC    R1                      ;CHECK IF PLAYER 4
                     ;
0037 E6              DIS_SCR50:  MOV    A,@R0            ;GET THE HUNDS DIGIT
0038 7006            JNZ    DIS_SCR60
003A E4              CLR    A                ;BLANK THE DIGIT
003B D209            SETB   BLANK            ;SET THE BLANK FLAG
003D 020000    F     JMP    DIS_SCR70
0040 93              DIS_SCR60:  MOVC   A,@A+DPTR        ;LOOK UP 7_SEG CODE
0041 F7              DIS_SCR70:  MOV    @R1,A
                     ;
0042 08                          INC    R0               ;DEC TO THE SCORE LOW BYTE
                     ;
0043 F9                          MOV    A,R1             ;SUB OFFSET FROM BUFFER POINTER
0044 C3                          CLR    C
0045 9404                        SUBB   A,#4
0047 F9                          MOV    R1,A
                     ;
0048 E6                          MOV    A,@R0            ;GET THE TENS DIGIT
0049 54F0                        ANI    A,#0F0H          ;MASK OUT THE ONES
004B C4                          SWAP   A
004C 300908                      JNB    BLANK,DIS_SCR80
004F 7006                        JNZ    DIS_SCR80
0051 E4                          CLR    A
0052 C209                        CLR    BLANK
0054 020000    F                 JMP    DIS_SCR90
0057 93              DIS_SCR80:  MOVC   A,@A+DPTR        ;LOOK UP 7-SEG CODE
0058 F7              DIS_SCR90:  MOV    @R1,A
                     ;
0059 F9                          MOV    A,R1             ;SUB OFFSET FROM BUFFER POINTER
005A C3                          CLR    C
005B 9404                        SUBB   A,#04
005D F9                          MOV    R1,A
                     ;
005E E6                          MOV    A,@R0            ;GET THE ONES DIGIT
005F 540F                        ANI    A,#0FH
0061 93                          MOVC   A,@A+DPTR        ;LOOK UP 7-SEG CODE
0062 F7                          MOV    @R1,A
0063 D082                        POP    DPL
```

```
0065 D083                 POP     DPH
0067 22                   RET
                  ;
                  ;
0068 7E           DECODE_TABLE:   DB      ZERO
0069 0C                   DB      ONE
006A B6                   DB      TWO
006B 9E                   DB      THREE
006C CC                   DB      FOUR
006D DA                   DB      FIVE
006E F8                   DB      SIX
006F 0E                   DB      SEVEN
0070 FE                   DB      EIGHT
0071 CE                   DB      NINE
                  ;
                  ;*****************************************************************
0072 C083         DISPLAY_TEMP:   PUSH    DPH
0074 C082                 PUSH    DPL
0076 C209                 CLR     BLANK   ;CLEAR THE BLANKING FLAG
0078 E56E                 MOV     A,TEMP_SCORE_H
007A 900000   F           MOV     DPTR,#DECODE_TABLE
007D 7006                 JNZ     DIS_TEMP10
007F E4                   CLR     A
0080 D209                 SETB    BLANK
0082 020000   F           JMP     DIS_TEMP20
0085 93           DIS_TEMP10:     MOVC    A,@A+DPTR
0086 F573         DIS_TEMP20:     MOV     TEMP_100_BUFR,A
                  ;
0088 E56F                 MOV     A,TEMP_SCORE_L
008A 54F0                 ANI     A,#0F0H
008C C4                   SWAP    A
008D 300908               JNB     BLANK,DIS_TEMP30
0090 7006                 JNZ     DIS_TEMP30
0092 E4                   CLR     A
0093 C209                 CLR     BLANK
0095 020000   F           JMP     DIS_TEMP40
0098 93           DIS_TEMP30:     MOVC    A,@A+DPTR
0099 F571         DIS_TEMP40:     MOV     TEMP_10_BUFR,A
                  ;
009B E56F                 MOV     A,TEMP_SCORE_L
009D 540F                 ANI     A,#0FH
009F 93                   MOVC    A,@A+DPTR
00A0 F572                 MOV     TEMP_1_BUFR,A
                  ;
00A2 D082                 POP     DPL
00A4 D083                 POP     DPH
00A6 22                   RET
                  ;
                  ;*****************************************************************
                  ;
```

```
00A7 C082                DISPLAY_DARTS_OR_ROUND: PUSH    DPL
00A9 C083                                        PUSH    DPH
00AB 900000    F                                 MOV     DPTR,#DECODE_TABLE
00AE 93                                          MOVC    A,@A+DPTR
00AF F570                                        MOV     ROUND_DART_BUFR,A
00B1 D083                                        POP     DPH
00B3 D082                                        POP     DPL
00B5 22                                          RET
                         ;
                         ;*****************************************************************************
                         ;
                         ;       R0 POINTS TO THE LOWER BYTE OF THE FIRST NUMBER TO BE ADDED OR
                         ;       SUBTRACTED.  R1 POINTS TO THE LOWER BYTE OF THE SECOND NUMBER
                         ;       TO BE ADDED.  THE RESULT IS PLACED AT THE R1 POINTER.
                         ;
                         ;
00B6 E6                  BCD_ADD:        MOV     A,@R0
00B7 27                                  ADD     A,@R1
00B8 D4                                  DA      A
00B9 F6                                  MOV     @R0,A
00BA 18                                  DEC     R0
00BB E6                                  MOV     A,@R0
00BC 200805                              JB      DOUBLE_BYTE,BCD_ADD20
00BF 3400                                ADDC    A,#0
00C1 D4                  BCD_ADD10:      DA      A
00C2 F6                                  MOV     @R0,A
00C3 22                                  RET
00C4 19                  BCD_ADD20:      DEC     R1
00C5 37                                  ADDC    A,@R1
00C6 80F9                                JMP     BCD_ADD10
                         ;
                         ;
00C8 C3                  BCD_SUB:        CLR     C
00C9 749A                                MOV     A,#9AH
00CB 97                                  SUBB    A,@R1
00CC 26                                  ADD     A,@R0
00CD D4                                  DA      A
00CE F6                                  MOV     @R0,A
00CF 18                                  DEC     R0
00D0 7499                                MOV     A,#99H
00D2 36                                  ADDC    A,@R0
00D3 D4                                  DA      A
00D4 F6                                  MOV     @R0,A
00D5 22                                  RET
                         ;
                         ;
00D6 755700              BIN_TO_DEC:     MOV     DART_SCORE,#0
00D9 24F6                TENS_LOOP:      ADD     A,#-10
00DB 500C                                JNC     ADD_10
00DD C0E0                                PUSH    ACC
```

```
00DF E557                 MOV     A,DART_SCORE
00E1 2410                 ADD     A,#10H
00E3 F557                 MOV     DART_SCORE,A
00E5 D0E0                 POP     ACC
00E7 80F0                 JMP     TENS_LOOP
00E9 240A       ADD_10:   ADD     A,#10
00EB 4257                 ORL     DART_SCORE,A
00ED 22                   RET
                ;
                ;*****************************************************************
                ;
                ;                         < GAME OF 301 >
                ;
                GAME_301:         %SELRB3
                ;
00F4 200009                       JB      DBL_IN_FLAG,GM301_1
00F7 300111                       JNB     DBL_OUT_FLAG,GM301_10
                ;
00FA 75F002     GM301_00:         MOV     B,#2
00FD 020000   F                   JMP     GM301_2
                ;
0100 3001F7     GM301_1:          JNB     DBL_OUT_FLAG,GM301_00
0103 75F003                       MOV     B,#3
                ;
0106 E562       GM301_2:          MOV     A,COIN_COUNT
0108 84                           DIV     AB
0109 F562                         MOV     COIN_COUNT,A
                ;
010B 786D       GM301_10:         MOV     R0,#PLYR1_SCORE_L
010D 75580F                       MOV     DOUBLE_FLAG,#0FH  ;SET UP DOUBLE IN FLAGS FOR PLYRS
0110 7C04                         MOV     R4,#4             ;SET UP MAX PLAYERS
                ;
0112 7601       GM301_20:         MOV     @R0,#01          ;WRITE 301 TO PLAYERS PLAYING
0114 18                           DEC     R0
0115 300604                       JNB     FLG501,GM301_22 ;JUMP IF NOT 501 GAME
0118 7605                         MOV     @R0,#05
011A 8002                         SJMP    GM301_23
011C 7603       GM301_22:         MOV     @R0,#03
011F 120000   F GM301_23:         CALL    DISPLAY_SCORE
0121 055A                         INC     PLAYER_COUNT
0123 18                           DEC     R0
0124 18                           DEC     R0
0125 D56203                       DJNZ    COIN_COUNT,GM301_24
0128 020000   F                   JMP     GM301_24A
012B DCE5       GM301_24:         DJNZ    R4,GM301_20
                ;
012D 756200                       MOV     COIN_COUNT,#0
0130 120000   F GM301_24A:        CALL    CLEAR_TEMP
                ;
```

```
0133 754D01          565                    MOV     ROUND_COUNT,#1
                     566     ;
0136 7D01            567                    MOV     R5,#1
0138 755600          568     GM301_25:      MOV     LAMP_PNTR,#0
013B 7B6D            569                    MOV     R3,#PLYR1_SCORE_L
013D 7C01            570                    MOV     R4,#01
013F AF5A            571                    MOV     R7,PLAYER_COUNT
                     572     ;
0141 EE              573     GM301_26:      MOV     A,R5
0142 6007            574                    JZ      GM301_30
0144 6403            575                    XRL     A,#3
0146 700C            576                    JNZ     GM301_32
0148 100C30          577                    JBC     CHANGE_PLAYER,GM301_43
                     578     ;
014B 435F80          579     GM301_30:      ORL     BANK1_FLASH_REG,#PLYR_CHANGE_LAMP  ;WAIT FOR PLYR CHNG
014E 120000    F     580     GM301_31:      CALL    INPUT_SWITCHES
0151 30E7FA          581                    JNB     PLAYER_CHANGE_BUTTON,GM301_31
0154 5365C3          582     GM301_32:      ANL     BANK1_REG,#PLAYER_LAMPS_OFF
                     583     ;
0157 535F7F          584                    ANL     BANK1_FLASH_REG,#(NOT PLYR_CHANGE_LAMP)
015A 53657D          585                    ANL     BANK1_REG,#NOT(PLYR_CHANGE_LAMP OR THROW_DARTS_LAMP)
015D 435F80          586                    ORL     BANK2_FLASH_REG,#REMOVE_DARTS_LAMP
                     587     ;
0160 900000    F     588                    MOV     DPTR,#PLAYER_LAMP_TABLE          ;FLASH THE NEXT
0163 E556            589                    MOV     A,LAMP_PNTR                      ;  PLAYERS LAMP
0165 93              590                    MOVC    A,@A+DPTR
0166 425F            591                    ORL     BANK1_FLASH_REG,A
                     592     ;
0168 F54D            593                    MOV     A,ROUND_COUNT
016A 120000    F     594                    CALL    DISPLAY_DARTS_OR_ROUND
016D 5364FE          595                    ANL     BANK2_REG,#NOT DARTS_THROWN_LAMP
0170 436420          596                    ORL     BANK2_REG,#GAME_ROUND_LAMP
                     597     ;
                     598     GM301_40:      %WAIT(TEN_SEC)
                     603     ;
017B 535FC3          604     GM301_43:      ANL     BANK1_FLASH_REG,#PLAYER_LAMPS_OFF
017E 5365C3          605                    ANL     BANK1_REG,#PLAYER_LAMPS_OFF
0181 535F7F          606                    ANL     BANK2_FLASH_REG,#(NOT REMOVE_DARTS_LAMP)
0184 53647F          607                    ANL     BANK2_REG,#(NOT REMOVE_DARTS_LAMP)
0187 436503          608                    ORL     BANK1_REG,#(THROW_DARTS_LAMP OR TEMP_SCORE_LAMP)
018A 5364DF          609                    ANL     BANK2_REG,#NOT GAME_ROUND_LAMP
018D 436401          610                    ORL     BANK2_REG,#DARTS_THROWN_LAMP
                     611     ;
0190 20EC13          612                    %PLAY(NEXT_TONE)
01A7 120000    F     623                    CALL    CLEAR_TEMP
                     624     ;
01AA 900000    F     625                    MOV     DPTR,#PLAYER_LAMP_TABLE
01AD E556            626                    MOV     A,LAMP_PNTR      ;TURN ON CURRENT PLAYER'S LAMP
01AF 93              627                    MOVC    A,@A+DPTR
```

```
01B0 4265                 ORI     BANK1_REG,A
                    ;
01B2 FB                   MOV     A,R3            ;TEMP STORE THE CURRENT PLYR'S SCORE
01B3 F8                   MOV     R0,A
01B4 8655                 MOV     TEMP_L,@R0
01B6 18                   DEC     R0
01B7 8654                 MOV     TEMP_H,@R0
                    ;
01B9 7D03                 MOV     R5,#3           ;RESET THE DART COUNT
                    ;
                          %SCAN
                    ;
01CD FD             GM301_45:     MOV     A,R5
01CE 120000    F            CALL    DISPLAY_DARTS_OR_ROUND
                    ;
                    ;
01D1 120000    F    GM301_50:     CALL    INPUT_SWITCHES
01D4 30E705                JNB     PLAYER_CHANGE_BUTTON,GM301_50A
01D7 D20C                  SETB    CHANGE_PLAYER
01D9 020000    F           JMP     GM301_83
01DC E559           GM301_50A:    MOV     A,DART_BUFFER   ;WAIT FOR A DART
01DE 60F1                  JZ      GM301_50
01E0 B4FF03                CJNE    A,#0FFH,GM301_51
01E3 120000    F           CALL    STUCK
01E6 FE             GM301_51:     MOV     R6,A            ;TEMP STORE DART CODE
01E7 1D                    DEC     R5              ;DECREMENT THE DART COUNT
01E8 755900                MOV     DART_BUFFER,#0
                    ;
01EB 30000F                JNB     DBL_IN_FLAG,GM301_60    ;CHECK IF DBL IN GAME
                    ;
01EE E558                  MOV     A,DOUBLE_FLAG           ;CURRENT PLYR DOUBLED IN ?
01F0 5C                    ANL     A,R4
01F1 600A                  JZ      GM301_60        ;JUMP IF TRUE
                    ;
01F3 FE                    MOV     A,R6            ;CHECK IF DART IS DBL OR BULL
01F4 54A0                  ANL     A,#0A0H
01F6 6056                  JZ      GM301_80        ;JUMP IF NOT TRUE
                    ;
01F8 E558                  MOV     A,DOUBLE_FLAG   ;CLEAR CURRENT PLYR'S DBL IN BIT
01FA 6C                    XRL     A,R4
01FB F558                  MOV     DOUBLE_FLAG,A
                    ;
01FD FE             GM301_60:     MOV     A,R6                    ;CHECK THE DART CODES
                    ;
01FE 30E506                JNB     DBL_DART,GM301_61       ;JUMP IF NOT DOUBLE
0201 75F002                MOV     B,#2
0204 020000    F           JMP     GM301_100
                    ;
0207 30E606         GM301_61:     JNB     TPL_DART,GM301_62       ;JUMP IF NOT TRIPLE
```

```
020A 75F003          688                 MOV     B,#3
020D 020000    F     689                 JMP     GM301_100
                     690     ;
0210 30E708          691     GM301_62:   JNB     BULLS_EYE,GM301_65      ;JUMP IF NOT BULLS EYE
0213 D213            692                 SETB    BULL_FLAG
0215 755732          693                 MOV     DART_SCORE,#32H         ;HEX SCORE FOR BULL
0218 020000    F     694                 JMP     GM301_70
                     695     ;
021B 541F            696     GM301_65:   ANL     A,#1FH
021D F557            697                 MOV     DART_SCORE,A
021F E557            698     GM301_70:   MOV     A,DART_SCORE            ;MASK ALL BUT DART VALUE
0221 120000    F     699                 CALL    BIN_TO_DEC      ;CONVERT DART SCORE TO PACKED BCD
                     700     ;
0224 7957            701                 MOV     R1,#DART_SCORE  ;ADD THE DART SCORE TO TEMP SCORE
0226 786F            702                 MOV     R0,#TEMP_SCORE_L
0228 120000    F     703                 CALL    BCD_ADD
022B 120000    F     704                 CALL    DISPLAY_TEMP    ;DISPLAY THE TEMP SCORE
                     705     ;
022E EB              706                 MOV     A,R3            ;GET THE PLYR'S SCORE_L PNTR INTO R0
022F F8              707                 MOV     R0,A
0230 7957            708                 MOV     R1,#DART_SCORE  ;SUBTRACT DART SCORE FROM PLYR'S
0232 120000    F     709                 CALL    BCD_SUB         ;SCORE
0235 5065            710                 JNC     GM301_110       ;JUMP IF SCORE LESS THAN ZERO
                     711     ;
0237 E6              712                 MOV     A,@R0           ;CHECK IF SCORE = 0
0238 7011            713                 JNZ     GM301_75        ;JUMP IF NOT
023A 08              714                 INC     R0
023B E6              715                 MOV     A,@R0
023C 6009            716                 JZ      GM301_73        ;JUMP IF PLYR SCORE = 0
023E 300109          717                 JNB     IBL_OUT_FLAG,GM301_74   ;JUMP IF NOT IBL OUT GAME
0241 B40106          718                 CJNE    A,#01,GM301_74  ;JUMP IF SCORE NOT 1 POINT
0244 020000    F     719                 JMP     GM301_110       ;BUST FOR SCORE OF 1 POINT
0247 020000    F     720     GM301_73:   JMP     GM301_125
                     721     ;
024A 18              722     GM301_74:   DEC     R0
024B 120000    F     723     GM301_75:   CALL    DISPLAY_SCORE   ;DISPLAY PLAYER'S SCORE
                     724     ;
024E EC              725     GM301_80:   MOV     A,R5            ;CHECK IF LAST DART
024F 6003            726                 JZ      GM301_82        ;LOOP FOR NEXT DART THROW
0251 020000    F     727                 JMP     GM301_45
0254 208C13          728     GM301_82:   %PLAY(END_TONE)
026B 120000    F     739                 CALL    DISPLAY_DARTS_OR_ROUND
                     740     ;
                     741     GM301_83:   %STOP_SCAN      ;STOP THE DART SCAN CPU
                     751     ;
027B DF0D            752     GM301_85:   DJNZ    R7,GM301_90     ;DEC THE PLYR CNT AND CHECK LAST PLYR
027D 054D            753                 INC     ROUND_COUNT
027F E54D            754                 MOV     A,ROUND_COUNT   ;CHECK IF ROUND > 9
0281 B40A03          755                 CJNE    A,#0AH,GM301_87
```

```
0284 754100                 MOV     ROUND_COUNT,#0
0287 020000    F    GM301_87:   JMP     GM301_25          ;JUMP AND RESET PNTRS IF TRUE
                    ;
028A 1B             GM301_90:   DEC     R3                ;CHANGE THE PLYR'S SCORE PNTR TO
028B 1B                         DEC     R3                ;  NEXT PLYR
                    ;
028C EC                         MOV     A,R4              ;SHIFT THE DBL IN CHECK BIT MASK
028D 23                         RL      A
028E FC                         MOV     R4,A
                    ;
028F 0556                       INC     LAMP_PNTR         ;INC THE PLYR LAMP PNTR
0291 020000    F                JMP     GM301_26          ;LOOP FOR NEXT PLYR
                    ;
0294 FF             GM301_100:  MOV     A,R6              ;MASK ALL BUT SCORE
0295 541F                       ANL     A,#1FH
0297 A4                         MUL     AB
0298 F557                       MOV     DART_SCORE,A
029A 8083                       JMP     GM301_70
                    ;
029C C213           GM301_110:  CLR     BULL_FLAG
029E C20C                       CLR     CHANGE_PLAYER
02A0 D21A                       SETB    GEN2
02A2 D28C                       SETB    TR0
02A4 201AFD         GM301_115:  JB      GEN2,GM301_115
                    ;
02A7 435F02                     ORL     BANK2_FLASH_REG,#BUST_LAMP      ;FLASH THE BUST LAMP
02AA 755B1E                     MOV     TIMER_REG,#THREE_SEC    ;START TIMER FOR THREE SECONDS
02AD C204                       CLR     TIMER_FLAG
                    ;
02AF D214                       SETB    BUST_FLAG
                    ;
02B1 FF                         MOV     A,R3              ;GET THE CURRENT PLYR'S SCORE PNTR
02B2 F8                         MOV     R0,A              ;RESTORE THE LAST SCORE TEMP STORED
02B3 A655                       MOV     @R0,TEMP_L
02B5 18                         DEC     R0
02B6 A654                       MOV     @R0,TEMP_H
02B8 120000    F                CALL    DISPLAY_SCORE
                    ;
02BB 3004FD         GM301_120:  JNB     TIMER_FLAG,GM301_120    ;WAIT FOR TIMER
                    ;
02BE 120000    F                CALL    CLEAR_TEMP
02C1 535FFD                     ANL     BANK2_FLASH_REG,#(NOT BUST_LAMP)
02C4 5364FD                     ANL     BANK2_REG,#(NOT BUST_LAMP)
02C7 E4                         CLR     A       ;CLEAR A TO DISPLAY 0 DARTS
02C8 7503                       MOV     R5,#3   ;RESET THE DART COUNT
02CA 8088                       JMP     GM301_82
                    ;
02CC 300104         GM301_125:  JNB     DBL_OUT_FLAG,GM301_130
02CF FF                         MOV     A,R6
```

```
02D0 30E5C9          805                    JNB     DBL_DART,GM301_110
                     806    ;
02D3 18              807    GM301_130:      DEC     R0       ;DEC TO LOW BYTE PLYR SCORE PNTR
02D4 120000    F     808                    CALL    DISPLAY_SCORE
02D7 F556            809                    MOV     A,LAMP_PNTR      ;FLASH THE WINNER'S LAMP
02D9 900000    F     810                    MOV     DPTR,#PLAYER_LAMP_TABLE
02DC 93              811                    MOVC    A,@A+DPTR
02DD 425F            812                    ORL     BANK1_FLASH_REG,A
                     813    ;
02DF D215            814                    SETB    WIN_FLAG
                     815    ;
                     816                    %WAIT(FIFTEEN_SEC)
                     821    ;
                     822                    %SELRB0
02EC C210            825                    CLR     GAME_START
02EE 020000    F     826                    JMP     INITIALIZE_SYSTEM
                     827    ;
                     828    $EJECT
                     829    ;*****************************************************************
                     830    ;
                     831    GAME_COUNTUP:   %SELRB3
02F7 78ED            835                    MOV     R0,#PLYR1_SCORE_L
02F9 7C04            836                    MOV     R4,#4
                     837    ;
02FB 7600            838    COUNTUP_00:     MOV     @R0,#0           ;SET UP PLAYER DISPLAYS
02FD 18              839                    DEC     R0
02FE 7600            840                    MOV     @R0,#0
0300 120000    F     841                    CALL    DISPLAY_SCORE
0303 055A            842                    INC     PLAYER_COUNT
0305 18              843                    DEC     R0
0306 18              844                    DEC     R0
0307 D56203          845                    DJNZ    COIN_COUNT,COUNTUP_10
030A 020000    F     846                    JMP     COUNTUP_11
030D DCEC            847    COUNTUP_10:     DJNZ    R4,COUNTUP_00
030F 756200          848                    MOV     COIN_COUNT,#0
                     849    ;
0312 120000    F     850    COUNTUP_11:     CALL    CLEAR_TEMP
0315 436501          851                    ORL     BANK1_REG,#TEMP_SCORE_LAMP
0318 754D01          852                    MOV     ROUND_COUNT,#1   ;INITIALIZE THE ROUND COUNTER
                     853    ;
031B 7D01            854                    MOV     R5,#1
031D 755600          855    COUNTUP_12:     MOV     LAMP_PNTR,#0     ;INITIALIZE FOR NEW ROUND
0320 7B6D            856                    MOV     R3,#PLYR1_SCORE_L
0322 AF5A            857                    MOV     R7,PLAYER_COUNT
                     858    ;
0324 ED              859    COUNTUP_15:     MOV     A,R5
0325 6007            860                    JZ      COUNTUP_18
0327 6403            861                    XRL     A,#3
0329 700C            862                    JNZ     COUNTUP_22
```

```
032B 100C30          863                    JBC     CHANGE_PLAYER,COUNTUP_23
032E 435F80          864    COUNTUP_18:     ORL     BANK1_FLASH_REG,#PLYR_CHANGE_LAMP
0331 120000    F     865    COUNTUP_20:     CALL    INPUT_SWITCHES
0334 30E7FA          866                    JNB     PLAYER_CHANGE_BUTTON,COUNTUP_20
                     867    ;
0337 E556            868    COUNTUP_22:     MOV     A,LAMP_PNTR              ;FLASH THE NEXT PLAYERS LAMP
0339 900000    F     869                    MOV     DPTR,#PLAYER_LAMP_TABLE
033C 93              870                    MOVC    A,@A+DPTR
033D 425F            871                    ORL     BANK1_FLASH_REG,A
                     872    ;
033F 5365C3          873                    ANL     BANK1_REG,#PLAYER_LAMPS_OFF
0342 535F7F          874                    ANL     BANK1_FLASH_REG,#(NOT PLYR_CHANGE_LAMP)
0345 53657D          875                    ANL     BANK1_REG,#NOT(PLYR_CHANGE_LAMP OR THROW_DARTS_LAMP)
0348 435F80          876                    ORL     BANK2_FLASH_REG,#REMOVE_DARTS_LAMP
034B E54D            877                    MOV     A,ROUND_COUNT
034D 120000    F     878                    CALL    DISPLAY_DARTS_OR_ROUND
0350 5364FE          879                    ANL     BANK2_REG,#(NOT DARTS_THROWN_LAMP)
0353 436420          880                    ORL     BANK2_REG,#GAME_ROUND_LAMP
                     881    ;
                     882                    %WAIT(TEN_SEC)
                     887    ;
035E 535FC3          888    COUNTUP_23:     ANL     BANK1_FLASH_REG,#PLAYER_LAMPS_OFF
0361 5365C3          889                    ANL     BANK1_REG,#PLAYER_LAMPS_OFF
0364 535F7F          890                    ANL     BANK2_FLASH_REG,#(NOT REMOVE_DARTS_LAMP)
0367 53645F          891                    ANL     BANK2_REG,#NOT(REMOVE_DARTS_LAMP OR GAME_ROUND_LAMP)
036A 436401          892                    ORL     BANK2_REG,#DARTS_THROWN_LAMP
036D 436502          893                    ORL     BANK1_REG,#THROW_DARTS_LAMP
                     894    ;
0370 7D03            895                    MOV     R5,#3            ;RESET THE DART COUNT
                     896    ;
0372 208C13          897                    %PLAY(NEXT_TONE)
0389 120000    F     908                    CALL    CLEAR_TEMP
                     909    ;
038C 900000    F     910                    MOV     DPTR,#PLAYER_LAMP_TABLE  ;TURN ON CURRENT PLAYERS LAMP
038F E556            911                    MOV     A,LAMP_PNTR
0391 93              912                    MOVC    A,@A+DPTR
0392 4265            913                    ORL     BANK1_REG,A
                     914    ;
                     915                    %SCAN            ;START SCANNING THE DART BOARD
                     927    ;
03A6 ED              928                    MOV     A,R5     ;DISPLAY THE DART COUNT
03A7 120000    F     929    COUNTUP_25:     CALL    DISPLAY_DARTS_OR_ROUND
                     930    ;
03AA 120000    F     931    COUNTUP_30:     CALL    INPUT_SWITCHES
03AD 30E705          932                    JNB     PLAYER_CHANGE_BUTTON,COUNTUP40
03B0 D20C            933                    SETB    CHANGE_PLAYER
03B2 020000    F     934                    JMP     COUNTUP_110
                     935    ;
03B5 E559            936    COUNTUP40:      MOV     A,DART_BUFFER
```

```
03B7 60B1                JZ      COUNTUP_30
03B9 B4FF03              CJNE    A,#0FFH,COUNTUP_50
03BC 120000    F         CALL    STUCK
                         ;
03BF FE          COUNTUP_50:     MOV     R6,A
03C0 1D                          DEC     R5      ;DECREMENT THE DART COUNT
03C1 755900                      MOV     DART_BUFFER,#0
                         ;
03C4 EE                          MOV     A,R6
                         ;
03C5 30E506                      JNB     DBL_DART,COUNTUP_60
03C8 75F002                      MOV     B,#2
03CB 020000    F                 JMP     COUNTUP_112
                         ;
03CE 30E606      COUNTUP_60:     JNB     TPL_DART,COUNTUP_70
03D1 75F003                      MOV     B,#3
03D4 020000    F                 JMP     COUNTUP_112
                         ;
03D7 30E708      COUNTUP_70:     JNB     BULLS_EYE,COUNTUP_80
03DA D213                        SETB    BULL_FLAG
03DC 755732                      MOV     DART_SCORE,#32H
03DF 020000    F                 JMP     COUNTUP_90
                         ;
03E2 541F        COUNTUP_80:     ANL     A,#1FH          ;MASK ALL BUT SCORE
03E4 F557                        MOV     DART_SCORE,A
                         ;
03E6 E557        COUNTUP_90:     MOV     A,DART_SCORE
03E8 120000    F                 CALL    BIN_TO_DEC
                         ;
03EB 7957                        MOV     R1,#DART_SCORE
03ED 786F                        MOV     R0,#TEMP_SCORE_L
03EF 120000    F                 CALL    BCD_ADD
03F2 120000    F                 CALL    DISPLAY_TEMP
                         ;
03F5 EB                          MOV     A,R3
03F6 F8                          MOV     R0,A
03F7 7957                        MOV     R1,#DART_SCORE
03F9 120000    F                 CALL    BCD_ADD
03FC 120000    F                 CALL    DISPLAY_SCORE
                         ;
03FF ED                          MOV     A,R5
0400 6002                        JZ      COUNTUP_100
0402 80A3                        JMP     COUNTUP_25
                         ;
0404 120000    F         COUNTUP_100:    CALL    DISPLAY_DARTS_OR_ROUND
0407 208C13                      %PLAY(END_TONE)
                         ;
                         COUNTUP_110:    %STOP_SCAN
042B DF15                        DJNZ    R7,COUNTUP_120
```

```
042D 054D          1005                    INC     ROUND_COUNT
042F E54D          1006                    MOV     A,ROUND_COUNT
0431 B40803        1007                    CJNE    A,#8,COUNTUP_111
0434 020000    F   1008                    JMP     COUNTUP_130
0437 020000    F   1009    COUNTUP_111:    JMP     COUNTUP_12
                   1010    ;
043A FF            1011    COUNTUP_112:    MOV     A,R6
043B 541F          1012                    ANL     A,#1FH
043D A4            1013                    MUL     AB
043E F557          1014                    MOV     DART_SCORE,A
0440 80A4          1015                    JMP     COUNTUP_90
                   1016    ;
0442 1B            1017    COUNTUP_120:    DEC     R3      ;DEC TO NEXT PLAYER SCORE POINTER
0443 1B            1018                    DEC     R3
                   1019    ;
0444 0556          1020                    INC     LAMP_PNTR
0446 020000    F   1021                    JMP     COUNTUP_15      ;LOOP FOR NEXT PLAYER
                   1022    ;
0449 020000    F   1023    COUNTUP_130:    JMP     END_GAME
                   1024    ;
                   1025    ;*****************************************************************
                   1026    $EJECT
                   1027    ;*****************************************************************
                   1028    ;
044C 7D00          1029    END_GAME:       MOV     R5,#0
044E 7E00          1030                    MOV     R6,#0           ;CLEAR THE LAMP POINTERS
0450 7F01          1031                    MOV     R7,#01
0452 AC5A          1032                    MOV     R4,PLAYER_COUNT ;CHECK IF ONLY ONE PLAYER PLAYING
0454 1C            1033                    DEC     R4
0455 EC            1034                    MOV     A,R4
0456 7005          1035                    JNZ     END_GAME10      ;JUMP FOR MORE THAN 1 PLAYER
0458 7404          1036                    MOV     A,#PLAYER1_LAMP ;FLASH PLAYER1 LAMP FOR WIN
045A 020000    F   1037                    JMP     END_GAME80
                   1038    ;
045D 7A6D          1039    END_GAME10:     MOV     R2,#PLYR1_SCORE_L       ;INITIALIZE PNTRS
045F 7B6A          1040                    MOV     R3,#PLYR2_SCORE_H
                   1041    ;
0461 7954          1042    END_GAME20:     MOV     R1,#TEMP_H      ;GET PLAYER SCORE INTO TEMP
0463 FF            1043                    MOV     A,R3            ;FROM THE R3 PNTR
0464 F8            1044                    MOV     R0,A
0465 E6            1045                    MOV     A,@R0
0466 F7            1046                    MOV     @R1,A
0467 08            1047                    INC     R0
0468 09            1048                    INC     R1
0469 E6            1049                    MOV     A,@R0
046A F7            1050                    MOV     @R1,A
046B EA            1051                    MOV     A,R2
046C F8            1052                    MOV     R0,A
                   1053    ;
```

```
046D C3                 CLR     C                   ;2 BYTE BCD SUBTRACT
046E 749A               MOV     A,#9AH
0470 97                 SUBB    A,@R1
0471 26                 ADD     A,@R0
0472 D4                 DA      A
0473 7002               JNZ     END_GAME30          ;JUMP IF NOT ZERO
0475 D21F               SETB    ZERO_FLAG           ;SET THE ZERO FLAG
0477 18         END_GAME30:     DEC     R0          ;DEC THE POINTERS
0478 19                 DEC     R1
0479 7499               MOV     A,#99H
047B 9212               MOV     TEMP_CY,C           ;TEMP STORE THE CY BIT
047D C3                 CLR     C
047E 97                 SUBB    A,@R1
047F A212               MOV     C,TEMP_CY
0481 36                 ADDC    A,@R0
0482 D4                 DA      A
                ;
0483 700F               JNZ     END_GAME45                  ;JUMP IF NOT ZERO
0485 301B0B             JNB     ZERO_FLAG,END_GAME45        ;JUMP IF FIRST BYTE NOT ZERO
0488 FE                 MOV     A,R6                        ;GET 1ST PLYR'S LAMP PNTR
0489 120000     F       CALL    SET_WIN_LAMP                ;SET A WIN LAMP FOR 1ST PLYR
048C FF         END_GAME40:     MOV     A,R7                ;GET 2ND PLYR'S LAMP PNTR
048D 120000     F       CALL    SET_WIN_LAMP                ;SET WIN LAMP FOR THE 2ND PLYR
0490 020000     F       JMP     END_GAME60
                ;
0493 7100       END_GAME45:     MOV     R5,#0               ;CLEAR THE WIN LAMP REG
0495 50F5               JNC     END_GAME40                  ;JUMP IF @R1>@R0
0497 FE                 MOV     A,R6                        ;GET 1ST PLYR'S LAMP PNTR
0498 120000     F       CALL    SET_WIN_LAMP                ;SET THE WIN LAMP IN R5
049B 4005       END_GAME50:     JC      END_GAME70
                ;
049D FB         END_GAME60:     MOV     A,R3                ;GET THE R3 PNTR INTO R2
049E FA                 MOV     R2,A
049F 0A                 INC     R2
                ;
04A0 FF                 MOV     A,R7                        ;SWAP THE LAMP PNTRS
04A1 FE                 MOV     R6,A
                ;
04A2 0F         END_GAME70:     INC     R7
04A3 1B                 DEC     R3                  ;DEC R3 TO NEXT PLAYER
04A4 1B                 DEC     R3
04A5 DCBA               DJNZ    R4,END_GAME20
                ;
04A7 200818             JB      DOUBLE_BYTE,END_GAME90      ;SET WHEN PLAYING SCRAM
04AA ED         END_GAME75:     MOV     A,R5
04AB 5365C1     END_GAME80:     ANI     BANK1_REG,#NOT(PLAYER_LAMPS OR THROW_DARTS_LAMP)
04AE 425F               ORI     BANK1_FLASH_REG,A
                ;
04B0 D215               SETB    WIN FLAG
```

```
                        %WAIT(FIFTEEN_SEC)
                        %SELRB0
04BD C210               CLR     GAME_START
04BF 020000   F         JMP     INITIALIZE_SYSTEM
                ;
04C2 E55A       END_GAME90:     MOV     A,PLAYER_COUNT  ;CHECK IF MORE THAN TWO PLAYERS
04C4 14                         DEC     A
04C5 14                         DEC     A
04C6 60F2                       JZ      END_GAME75      ;JUMP FOR ONLY 2 PLAYERS
                ;
04C8 FD                         MOV     A,R5                    ;GET THE WIN_LAMP_REG
04C9 B4040A                     CJNE    A,#PLAYER1_LAMP,END_GAME100 ;CHECK IF PLYR 1 WINS
04CC 4408                       ORL     A,#PLAYER3_LAMP         ;ALSO TURN ON PLYR #3 LAMP
04CE 80DB                       JMP     END_GAME80              ;1 & 3 WINS TEAM
                ;
04D0 B42004     END_GAME100:    CJNE    A,#PLAYER2_LAMP,END_GAME110  ;2 & 4 WINS TEAM
04D3 4410                       ORL     A,#PLAYER4_LAMP
04D5 80D4                       JMP     END_GAME80
                ;
04D7 743C       END_GAME110:    MOV     A,#PLAYER_LAMPS
04D9 80D0                       JMP     END_GAME80
                ;
                ;-----------------------------------------------------------------
04DB 900000   F SET_WIN_LAMP:   MOV     DPTR,#PLAYER_LAMP_TABLE
04DE 93                         MOVC    A,@A+DPTR
04DF 4D                         ORL     A,R5
04E0 FD                         MOV     R5,A
04E1 22                         RET
                ;
                ;*****************************************************************
                ;
                ;               < GAME OF SHANG-HAI>
                ;
                GAME_SHANG_HAI: %SELRB3
04E8 786D                       MOV     R0,#PLYR1_SCORE_L
04EA 7C49                       MOV     R4,#PLYR1_NEXT
04EC 7B04                       MOV     R3,#4
                ;
04EE 7600       SHANG_H00:      MOV     @R0,#0          ;SET UP PLAYER'S DISPLAYS
04F0 18                         DEC     R0              ;  FOR THE NUMBER OF COINS
04F1 7600                       MOV     @R0,#0
04F3 120000   F                 CALL    DISPLAY_SCORE
04F6 EC                         MOV     A,R4
04F7 F9                         MOV     R1,A
04F8 7701                       MOV     @R1,#1          ;SET UP NEXT THROW REG
04FA 05EA                       INC     PLAYER_COUNT
04FC 18                         DEC     R0
04FD 18                         DEC     R0
04FE 1C                         DEC     R4
```

```
04FF D56203          1161                    DJNZ    COIN_COUNT,SHANG_H10
0502 020000    F     1162                    JMP     SHANG_H15
0505 DBE7            1163    SHANG_H10:      DJNZ    R3,SHANG_H00
0507 756200          1164                    MOV     COIN_COUNT,#0
                     1165    ;
050A 120000    F     1166    SHANG_H15:      CALL    CLEAR_TEMP
050D 436501          1167                    ORL     BANK1_REG,#TEMP_SCORE_LAMP
0510 754D01          1168                    MOV     ROUND_COUNT,#1
                     1169    ;
0513 7D01            1170                    MOV     R5,#1
0515 755600          1171    SHANG_H20:      MOV     LAMP_PNTR,#0     ;INITIALIZE FOR NEW ROUND
0518 7C49            1172                    MOV     R4,#PLYR1_NEXT
051A 7B6D            1173                    MOV     R3,#PLYR1_SCORE_L
051C AF5A            1174                    MOV     R7,PLAYER_COUNT
                     1175    ;
051E ED              1176    SHANG_H30:      MOV     A,R5             ;GET THE DART COUNT
051F 6007            1177                    JZ      SHANG_H35        ;JUMP FOR ALL DARTS THROWN
0521 6403            1178                    XRL     A,#3             ;CHECK IF NO DARTS THROWN
0523 700C            1179                    JNZ     SHANG_H50        ;JUMP IF NOT TRUE
0525 100C30          1180                    JBC     CHANGE_PLAYER,SHANG_H60 ;JUMP IF PLAYER CHANGE PUSHED
0528 435F80          1181    SHANG_H35:      ORL     BANK1_FLASH_REG,#PLYR_CHANGE_LAMP
                     1182    ;
052B 120000    F     1183    SHANG_H40:      CALL    INPUT_SWITCHES
052E 30E7FA          1184                    JNB     PLAYER_CHANGE_BUTTON,SHANG_H40
                     1185    ;
0531 E556            1186    SHANG_H50:      MOV     A,LAMP_PNTR
0533 900000    F     1187                    MOV     DPTR,#PLAYER_LAMP_TABLE
0536 93              1188                    MOVC    A,@A+DPTR
0537 425F            1189                    ORL     BANK1_FLASH_REG,A
                     1190    ;
0539 5365C3          1191                    ANL     BANK1_REG,#PLAYER_LAMPS_OFF
053C 535F7F          1192                    ANL     BANK1_FLASH_REG,#NOT(PLYR_CHANGE_LAMP)
053F 53657D          1193                    ANL     BANK1_REG,#NOT(PLYR_CHANGE_LAMP OR THROW_DARTS_LAMP)
0542 435F80          1194                    ORL     BANK2_FLASH_REG,#REMOVE_DARTS_LAMP
0545 F54D            1195                    MOV     A,ROUND_COUNT
0547 120000    F     1196                    CALL    DISPLAY_DARTS_OR_ROUND
054A 5364FE          1197                    ANL     BANK2_REG,#(NOT DARTS_THROWN_LAMP)
054D 436420          1198                    ORL     BANK2_REG,#GAME_ROUND_LAMP
                     1199    ;
                     1200                    %WAIT(TEN_SEC)
                     1205    ;
0550 535FC3          1206    SHANG_H60:      ANL     BANK1_FLASH_REG,#PLAYER_LAMPS_OFF
0553 5365C3          1207                    ANL     BANK1_REG,#PLAYER_LAMPS_OFF
0556 535F7F          1208                    ANL     BANK2_FLASH_REG,#(NOT REMOVE_DARTS_LAMP)
0559 53647F          1209                    ANL     BANK2_REG,#(NOT REMOVE_DARTS_LAMP)
                     1210    ;
055C 900000    F     1211                    MOV     DPTR,#PLAYER_LAMP_TABLE ;TURN ON CURRENT PLAYER'S LAMP
055F E556            1212                    MOV     A,LAMP_PNTR
0561 93              1213                    MOVC    A,@A+DPTR
```

```
056A 4265                ORL     BANK1_REG,A
                   ;                                        ;FLASH NEXT THROW NUMBER
056C EC                  MOV     A,R4                     ; ON TEMP DISPLAY
056D F8                  MOV     R0,A                     ;LOAD PNTR FROM R4
056E E6                  MOV     A,@R0                    ;GET NEXT THROW NUMBER
056F 120000    F         CALL    BIN_TO_DEC               ;CONVERT TO PACKED BCD
0572 F557                MOV     A,DART_SCORE             ;GET CONVER FROM DART_SCORE
0574 F56F                MOV     TEMP_SCORE_L,A
0576 120000    F         CALL    DISPLAY_TEMP             ;DISPLAY THE NUMBER
0579 208C13              %PLAY(BEEP_BEEP)
                         %WAIT(TWO_SEC)
059B 208C13              %PLAY(NEXT_TONE)
05AF 120000    F         CALL    CLEAR_TEMP               ;CLEAR TEMP SCORE
                   ;
05B2 5364DF              ANL     BANK2_REG,#NOT(GAME_ROUND_LAMP)
05B5 436502              ORL     BANK1_REG,#THROW_DARTS_LAMP
05B8 436401              ORL     BANK2_REG,#DARTS_THROWN_LAMP
                   ;
05BB 7D03                MOV     R5,#3            ;RESET THE DART COUNT
                   ;
                         %SCAN            ;START SCANNING THE DART BOARD
                   ;
05CF ED            SHANG_H70:    MOV     A,R5
05D0 120000    F         CALL    DISPLAY_DARTS_OR_ROUND
                   ;
05D3 120000    F   SHANG_H80:    CALL    INPUT_SWITCHES
05D6 30E705                      JNB     PLAYER_CHANGE_BUTTON,SHANG_H90
05D9 D20C                        SETB    CHANGE_PLAYER
05DB 020000    F                 JMP     SHANG_H160
                   ;
05DF F559          SHANG_H90:    MOV     A,DART_BUFFER
05E0 60F1                        JZ      SHANG_H80
05E2 B4FF03                      CJNE    A,#0FFH,SHANG_H100
05E5 120000    F                 CALL    STUCK
                   ;
05E8 FF            SHANG_H100:   MOV     R6,A     ;TEMP STORE THE DART CODE
05E9 1D                          DEC     R5       ;DECREMENT THE DART COUNT
05EA 755900                      MOV     DART_BUFFER,#0  ;CLEAR THE DART BUFFER
                   ;
05ED EC                          MOV     A,R4     ;CHECK IF HIT IS RIGHT SECTOR
05EE F8                          MOV     R0,A
05EF EF                          MOV     A,R6     ;GET THE DART CODE
05F0 541F                        ANL     A,#1FH   ;MASK ALL BUT SECTOR NUMBER
05F2 66                          XRL     A,@R0    ;DOES IT MATCH
05F3 704E                        JNZ     SHANG_H145       ;JUMP IF FALSE
05F5 06                          INC     @R0      ;INCREMENT THE NEXT THROW REG
                   ;
05F6 208C13                      %PLAY(HIT_TONE)
                   ;
```

```
060D EE                 SHANG_H110:     MOV     A,R6    ;GET THE DART CODE
                                        ;
060E 30E508                             JNB     TPL_DART,SHANG_H120     ;CHECK IF DOUBLE
0611 75F002                             MOV     B,#2
0614 D217                               SETB    DOUBLE
0616 020000     F                       JMP     SHANG_H180
                                        ;
0619 30E608             SHANG_H120:     JNB     TPL_DART,SHANG_H130
061C 75F003                             MOV     B,#3
061F D218                               SETB    TRIPLE
0621 020000     F                       JMP     SHANG_H180
                                        ;
0624 541F               SHANG_H130:     ANL     A,#1FH
0626 F557                               MOV     DART_SCORE,A
0628 D216                               SETB    SINGLE
                                        ;
062A E557               SHANG_H140:     MOV     A,DART_SCORE    ;CONVERT DART SCORE TO BCD
062C 120000     F                       CALL    BIN_TO_DEC
                                        ;
062F 7957                               MOV     R1,#DART_SCORE  ;ADD DART SCORE TO TEMP SCORE
0631 786F                               MOV     R0,#TEMP_SCORE_L
0633 120000     F                       CALL    BCD_ADD
0636 120000     F                       CALL    DISPLAY_TEMP
                                        ;
0639 EB                                 MOV     A,R3
063A F8                                 MOV     R0,A
063B 7957                               MOV     R1,#DART_SCORE
063D 120000     F                       CALL    BCD_ADD
0640 120000     F                       CALL    DISPLAY_SCORE
                                        ;
0643 ED                 SHANG_H145:     MOV     A,R5
0644 6002                               JZ      SHANG_H150
0646 8087                               JMP     SHANG_H70
                                        ;
0648 30160F             SHANG_H150:     JNB     SINGLE,SHANG_H155               ;CHECK FOR A SHANG-HAI
064B 30170C                             JNB     DOUBLE,SHANG_H155
064E 301809                             JNB     TRIPLE,SHANG_H155
0651 7D00                               MOV     R5,#0
0653 120000     F                       CALL    SET_WIN_LAMP
0656 ED                                 MOV     A,R5
0657 020000     F                       JMP     END_GAME80
                                        ;
065A ED                 SHANG_H155:     MOV     A,R5
065B 120000     F                       CALL    DISPLAY_DARTS_OR_ROUND
065E 208C13                             %PLAY(END_TONE)
0675 C216                               CLR     SINGLE
0677 C217                               CLR     DOUBLE
0679 C218                               CLR     TRIPLE
                                        ;
```

```
                    1367    SHANG_H160:     %STOP_SCAN
0688 DF15           1377                    DJNZ    R7,SHANG_H190   ;DEC PLAYER AND CHECK FOR LAST
068A 054D           1378                    INC     ROUND_COUNT
068C F54D           1379                    MOV     A,ROUND_COUNT
068E B40803         1380                    CJNE    A,#8,SHANG_H170 ;CHECK FOR LAST ROUND
                    1381    ;
0691 020000    F    1382                    JMP     END_GAME        ;JMP FOR LAST ROUND
                    1383    ;
0694 020000    F    1384    SHANG_H170:     JMP     SHANG_H20       ;LOOP FOR NEXT ROUND
                    1385    ;
0697 EE             1386    SHANG_H180:     MOV     A,R6            ;GET THE DART CODE
0698 541F           1387                    ANL     A,#1FH          ;MASK ALL BUT SCORE
069A A4             1388                    MUL     AB
069B F557           1389                    MOV     DART_SCORE,A
069D 808B           1390                    JMP     SHANG_H140
                    1391    ;
069F 1B             1392    SHANG_H190:     DEC     R3      ;DEC TO NEXT PLAYER SCORE POINTER
06A0 1B             1393                    DEC     R3
                    1394    ;
06A1 1C             1395                    DEC     R4      ;INC THE NEXT THROW POINTER
                    1396    ;
06A2 0556           1397                    INC     LAMP_PNTR       ;INC THE PLAYER LAMP POINTER
06A4 020000    F    1398                    JMP     SHANG_H30       ;LOOP FOR NEXT PLAYER
                    1399    ;
                    1400    ;*****************************************************************************
                    1401    $EJECT
```

```
MCS-51 MACRO ASSEMBLER    DRTOS2
5
LOC  OBJ            LINE    SOURCE
                     549    ;
0157 D201            550    SEL_GM54D:      SETB    DBL_OUT_FLAG
0159 020000    F     551                    JMP     SEL_GM56
                     552    ;
015C D200            553    SEL_GM55:       SETB    DBL_IN_FLAG
015E EF              554    SEL_GM56:       MOV     A,R7
015F 20E42A          555                    JB      SCRAM_BUTTON,SEL_GM61
0162 E562            556                    MOV     A,COIN_COUNT
0164 B40203          557                    CJNE    A,#2,SEL_GM57
0167 020000    F     558                    JMP     SEL_GM61
                     559    ;
016A 4363C0          560    SEL_GM57:       ORL     BANK3_REG,#(DBL_IN_LAMP OR DBL_OUT_LAMP)
016D E520            561                    MOV     A,20H   ;CHECK FOR BOTH DBL_IN AND DBL_OUT
016F F4              562                    CPL     A
0170 5403            563                    ANL     A,#03H
0172 7006            564                    JNZ     SEL_GM58        ;JUMP IF NOT BOTH
                     565    ;
```

```
0174 436301          566                    ORL     BANK3_REG,#TWENTYFIVE_CENTS_LAMP
0177 020000    F     567                    JMP     SEL_GM70
                     568     ;
017A 300005          569     SEI_GM58:      JNB     DBL_IN_FLAG,SEL_GM59
017D 7180            570                    MOV     R5,#DBL_OUT_LAMP
017F 020000    F     571                    JMP     SEL_GM60
                     572     ;
0182 7140            573     SEI_GM59:      MOV     R5,#DBL_IN_LAMP
                     574     ;
0184 53633F          575     SEI_GM60:      ANI     BANK3_REG,#NOT(TWENTYFIVE_CENTS_LAMP)
0187 436440          576                    ORL     BANK2_REG,#FIFTY_CENTS_LAMP
018A 808D            577                    JMP     SEL_GM40
                     578     ;
018C 53633F          579     SEI_GM61:      ANI     BANK3_REG,#NOT(DBL_IN_LAMP OR DBL_OUT_LAMP)
018F 53633F          580                    ANI     BANK3_REG,#NOT(TWENTYFIVE_CENTS_LAMP)
0192 436440          581                    ORL     BANK2_REG,#FIFTY_CENTS_LAMP
0195 300006          582                    JNB     DBL_IN_FLAG,SEL_GM61A
0198 436340          583                    ORL     BANK3_REG,#DBL_IN_LAMP
019B 020000    F     584                    JMP     SEL_GM70
                     585     ;
019E 436380          586     SEI_GM61A:     ORL     BANK3_REG,#DBL_OUT_LAMP
                     587     ;
01A1 120000    F     588     SEI_GM70:      CALL    INPUT_SWITCHES
01A4 60FE            589                    JZ      SEL_GM70
01A6 5473            590                    ANI     A,#GAME_SELECT_MASK
01A8 6002            591                    JZ      SEL_GM75
01AA 8080            592                    JMP     NEW_GAME
                     593     ;
01AC EA              594     SEI_GM75:      MOV     A,R2
01AD 30E7F1          595                    JNB     PLAYER_CHANGE_BUTTON,SEL_GM70
                     596     ;
01B0 200006          597     SEI_GM80:      JB      DBL_IN_FLAG,SEL_GM81
01B3 200103          598                    JB      DBL_OUT_FLAG,SEL_GM81
01B6 53633F          599                    ANL     BANK3_REG,#NOT(DBL_IN_LAMP OR DBL_OUT_LAMP)
                     600     ;
01B9 53657F          601     SEL_GM81:      ANI     BANK1_REG,#NOT PLYR_CHANGE_LAMP
01BC 120000    F     602                    CALL    CLEAR_DISPLAY
01BF EF              603                    MOV     A,R7
                     604     ;
01C0 20E60F          605                    JB      X301_BUTTON,GAME1
01C3 20E00F          606                    JB      X501_BUTTON,GAME2
01C6 20E111          607                    JB      COUNTUP_BUTTON,GAME3
01C9 20E511          608                    JB      SHANG_HAI_BUTTON,GAME4
01CC 20E411          609                    JB      SCRAM_BUTTON,GAME5
01CF 020000    F     610                    JMP     SELECT_GAME
                     611     ;
01D2 020000    F     612     GAME1:         JMP     GAME_301
01D5 D206            613     GAME2:         SETB    FLG501
01D7 020000    F     614                    JMP     GAME_301
```

```
01DA 020000   F     GAME3:          JMP     GAME_COUNTUP
01DD 020000   F     GAME4:          JMP     GAME_SHANG_HAI
01E0 020000   F     GAME5:          JMP     GAME_SCRAM
                    ;
                    ;
01E3 10             GAME_LAMP_TABLE:        DB      X301_LAMP
01E4 08                                     DB      X501_LAMP
01E5 02                                     DB      SCRAM_LAMP
01E6 20                                     DB      SHANG_HAI_LAMP
01E7 04                                     DB      COUNTUP_LAMP
                    ;
                    ;
                    $EJECT
                    ;*****************************************************************
                    ;
01E8 D210           FLASHEM:        SETB    GAME_START
01EA 75650F                         MOV     BANK1_REG,#0FH
01ED 755FFF                         MOV     BANK1_FLASH_REG,#0FFH
                                    %WAIT(TWO_SEC)
01F8 755F00                         MOV     BANK1_FLASH_REG,#0
01FB 756500                         MOV     BANK1_REG,#0
01FE 436540                         ORL     BANK1_REG,#GAME_OVER_LAMP
                    ;
0201 75640F                         MOV     BANK2_REG,#0FH
0204 755FFF                         MOV     BANK2_FLASH_REG,#0FFH
                                    %WAIT(TWO_SEC)
020F 755F00                         MOV     BANK2_FLASH_REG,#0
0212 756400                         MOV     BANK2_REG,#0
0215 436410                         ORL     BANK2_REG,#OVER_HEAD_LAMP
                    ;
0218 75630F                         MOV     BANK3_REG,#0FH
021B 755DFF                         MOV     BANK3_FLASH_REG,#0FFH
                                    %WAIT(TWO_SEC)
0226 755D00                         MOV     BANK3_FLASH_REG,#0
0229 536300                         ANL     BANK3_REG,#0
022C C211                           CLR     FLASHEM_FLAG
022E C210                           CLR     GAME_START
0230 22                             RET
                    ;*****************************************************************
                    ;
0231 E545           NUMBERS:        MOV     A,COUNT_REG     ;CHECK IF LAST COUNT
0233 B40A03                         CJNE    A,#0AH,NUM0     ;JUMP IF FALSE
0236 754500                         MOV     COUNT_REG,#0    ;RESET THE COUNT
                    ;
0239 900000   F     NUM0:           MOV     DPTR,#DECODE_TABLE      ;DISPLAY COUNT ON DISPLAYS
023C E545                           MOV     A,COUNT_REG
023E 93                             MOVC    A,@A+DPTR
023F 787F                           MOV     R0,#PLYR1_100_BUFR
                    ;
```

```
0241 F6                 NUM1:           MOV     @R0,A
0242 18                                 DEC     R0
0243 B6FFB                              CJNE    R0,#ROUND_DART_BUFR-1,NUM1
0246 0545                               INC     COUNT_REG
0248 22                                 RET
                        ;
                        ;*****************************************************************
                        ;
                        ;       ROUTINE TO FLASH THE GAME SELECT LAMPS
                        ;
0249 E561               FLASH_GAME_LAMPS:       MOV     A,FLASH_TIMER
024B 702A                                       JNZ     FLASH_RET
024D 75613F                                     MOV     FLASH_TIMER,#FLASH_COUNT
0250 E560                                       MOV     A,FLASH_PTR
0252 7002                                       JNZ     FLASH_GAME10
0254 C202                                       CLR     FLASH_FLAG
0256 B40402             FLASH_GAME10:           CJNE    A,#FLASH_PTR_END,FLASH_GAME20
0259 D202                                       SETB    FLASH_FLAG
025B 900000     F       FLASH_GAME20:           MOV     DPTR,#FLASH_LAMP_TABLE
025E E560                                       MOV     A,FLASH_PTR
0260 93                                         MOVC    A,@A+DPTR
0261 5363C1                                     ANL     BANK3_REG,#(NOT GAME_LAMPS)
0264 4263                                       ORL     BANK3_REG,A
0266 E563                                       MOV     A,BANK3_REG
0268 7801                                       MOV     R0,#LAMP_BANK3
026A F2                                         MOVX    @R0,A
026B 7860                                       MOV     R0,#FLASH_PTR
026D 200205                                     JB      FLASH_FLAG,FLASH_GAME30
0270 0560                                       INC     FLASH_PTR
0272 020000     F                               JMP     FLASH_RET
0275 1560               FLASH_GAME30:           DEC     FLASH_PTR
0277 22                 FLASH_RET:              RET
                        ;
                        ;
0278 04                 FLASH_LAMP_TABLE:       DB      COUNTUP_LAMP
0279 0E                                         DB      X501_LAMP
027A 10                                         DB      X301_LAMP
027B 20                                         DB      SHANG_HAI_LAMP
027C 02                                         DB      SCRAM_LAMP
                        ;
                        ;
                        $EJECT
                        ;*****************************************************************
                        ;
027D C0E0               COIN_IN:        PUSH    ACC
027F C0D0                               PUSH    PSW
                                        %SELRB2
0286 7F05                               MOV     R7,#5
0288 74FF               COIN_IN0:       MOV     A,#0FFH
```

```
028A D5E0FD          COIN_IN10:     DJNZ    ACC,COIN_IN10
028D DFF9                           DJNZ    R7,COIN_IN0
028F 20B22C                         JB      COIN_DROP,COIN_IN80
0292 0562                           INC     COIN_COUNT
0294 D20A                           SETB    COIN_UP
0296 7F05            COIN_IN50:     MOV     R7,#5
0298 74FF            COIN_IN60:     MOV     A,#0FFH
029A D5E0FD          COIN_IN70:     DJNZ    ACC,COIN_IN70
029D DFF9                           DJNZ    R7,COIN_IN60
029F 30B2F4                         JNB     COIN_DROP,COIN_IN50
02A2 208C13                         %PLAY(COIN_TONE)
02F9 301002                         JNB     GAME_START,COIN_IN80
02FC D21C                           SETB    EXIT
02FE D0D0            COIN_IN80:     POP     PSW
02C0 D0E0                           POP     ACC
02C2 32                             RETI
                     ;
                     ;*****************************************************************
                     ;
                     ;       TIMER INTERRUPT ROUTINE
                     ;       -----------------------
                     ;
02C3 C0E0            TIMER_INTR:    PUSH    ACC
02C5 C0D0                           PUSH    PSW
02C7 C083                           PUSH    DPH
02C9 C082                           PUSH    DPL
                     ;
                                    %SELRB1         ;SELECT INTR REGISTER BANK
02D0 758DFE                         MOV     TH1,#0FEH       ;RESET TIMER
02D3 758B0C                         MOV     TL1,#0CH
                     ;
                     ;
02D6 201F2C                         JB      ATTRACT_FLAG,TIMER_INTR10
02D9 D54812                         DJNZ    ATTRACT_REG1,TIMER_INTR5
02DC 7548FF                         MOV     ATTRACT_REG1,#0FFH
02DF D5470C                         DJNZ    ATTRACT_REG2,TIMER_INTR5
02F2 7547FF                         MOV     ATTRACT_REG2,#0FFH
02F5 D54606                         DJNZ    ATTRACT_REG3,TIMER_INTR5
02F8 754605                         MOV     ATTRACT_REG3,#5
02FB 120000    F                    CALL    ATTRACT
                     ;
02FE 300F14          TIMER_INTR5:   JNB     TOUCH_FLAG,TIMER_INTR10   ;JUMP IF NO TOUCH
02F1 5364EF                         ANL     BANK2_REG,#NOT OVER HEAD_LAMP
02F4 D5440F                         DJNZ    TOUCH_REG1,TIMER_INTR10
02F7 7544FF                         MOV     TOUCH_REG1,#0FFH
02FA D54308                         DJNZ    TOUCH_REG2,TIMER_INTR10
02FD 7543FF                         MOV     TOUCH_REG2,#0FFH
0300 436410                         ORL     BANK2_REG,#OVER_HEAD_LAMP
0303 C20E                           CLR     TOUCH_FLAG
                     ;
```

```
0305 53900F          TIMER_INTR10:  ANL   P1,#0FH          ;CLEAR THE PREVIOUS DIGIT STROBE
0308 7A04                           MOV   R2,#4
030A 900000    F                    MOV   DPTR,#EXTERNAL_LATCH_TABLE
030D 7E00                           MOV   R6,#0
030F EE              TIMER_INTR20:  MOV   A,R6
0310 93                             MOVC  A,@A+DPTR
0311 F9                             MOV   R1,A
0312 E6                             MOV   A,@R0            ;GET DIGIT DATA
0313 F3                             MOVX  @R1,A            ;WRITE DATA TO DISPLAY LATCH
0314 18                             DEC   R0               ;INC THE POINTERS
0315 0E                             INC   R6
0316 DAF7                           DJNZ  R2,TIMER_INTR20 ;LOOP FOR 4 ROWS OF DISGITS
                     ;
                     ;
0318 EB                             MOV   A,R3             ;STROBE THE DIGIT COLUMN
0319 4290                           ORL   P1,A
                     ;
031B 309707                         JNB   P1.7,TIMER_INTR22
031E 787F                           MOV   R0,#PLYR1_100_BUFR
0320 7B10                           MOV   R3,#10H
0322 020000    F                    JMP   TIMER_INTR24
                     ;
0325 EB              TIMER_INTR22:  MOV   A,R3
0326 23                             RL    A
0327 FB                             MOV   R3,A
                     ;
0328 DC0E            TIMER_INTR24:  DJNZ  R4,TIMER_INTR25
032A 7CFF                           MOV   R4,#0FFH
032C E55F                           MOV   A,BANK1_FLASH_REG
032E 6265                           XRL   BANK1_REG,A
0330 E55E                           MOV   A,BANK2_FLASH_REG
0332 6264                           XRL   BANK2_REG,A
0334 E55D                           MOV   A,BANK3_FLASH_REG
0336 6263                           XRL   BANK3_REG,A
                     ;
0338 200409          TIMER_INTR25:  JB    TIMER_FLAG,TIMER_INTR26 ;JUMP IF TIMER NOT RUNNING
033B DD07                           DJNZ  R5,TIMER_INTR26        ;100 MSEC LOOP
033D 7D64                           MOV   R5,#TIMER_COUNT
033F D55B02                         DJNZ  TIMER_REG,TIMER_INTR26  ;1 COUNT PER 100 MSEC
0342 D204                           SETB  TIMER_FLAG
                     ;
0344 200709          TIMER_INTR26:  JB    TONE_FLAG,TIMER_INTR27  ;JUMP IF NO TONES
0347 DF07                           DJNZ  R7,TIMER_INTR27
0349 7F64                           MOV   R7,#TIMER_COUNT
034B D54F02                         DJNZ  TONE_LENGTH,TIMER_INTR27
034E D207                           SETB  TONE_FLAG
                     ;
0350 208C5A          TIMER_INTR27:  JB    TR0,TIMER_INTR30
0353 30131C                         JNB   BULL_FLAG,TIMER_INTR28
```

```
0356 C213                 CLR     BULL_FLAG
0358 208C13               %PLAY(BULL_TONE)
036F 020000    F          JMP     TIMER_INTR30
                    ;
0372 30141C         TIMER_INTR28:  JNB     BUST_FLAG,TIMER_INTR29
0375 C214                 CLR     BUST_FLAG
0377 208C13               %PLAY(BUST)
038E 020000    F          JMP     TIMER_INTR30
                    ;
0391 301519         TIMER_INTR29:  JNB     WIN_FLAG,TIMER_INTR30
0394 C215                 CLR     WIN_FLAG
0396 208C13               %PLAY(WIN)
                    ;
03AD FE             TIMER_INTR30:  MOV     A,R6            ;GET EXT ADDR PNTR
03AE 93                   MOVC    A,@A+DPTR       ;GET EXT ADDR
03AF F9                   MOV     R1,A            ;       INTO R1
03B0 F565                 MOV     A,BANK1_REG     ;GET LAMP DATA
03B2 F3                   MOVX    @R1,A           ;WRITE DATA TO EXT LATCH
03B3 0E                   INC     R6              ;INC EXT ADDR PNTR
                    ;
03B4 FE                   MOV     A,R6
03B5 93                   MOVC    A,@A+DPTR
03B6 F9                   MOV     R1,A
03B7 F564                 MOV     A,BANK2_REG
03B9 F3                   MOVX    @R1,A
03BA 0E                   INC     R6
                    ;
03BB FE                   MOV     A,R6
03BC 93                   MOVC    A,@A+DPTR
03BD F9                   MOV     R1,A
03BE F563                 MOV     A,BANK3_REG
03C0 F3                   MOVX    @R1,A
                    ;
03C1 F561                 MOV     A,FLASH_TIMER
03C3 6002                 JZ      TIMER_INTR40
03C5 1561                 DEC     FLASH_TIMER
                    ;
03C7 F54E           TIMER_INTR40:  MOV     A,DELAY_REG
03C9 6002                 JZ      TIMER_INTR50
03CB 154E                 DEC     DELAY_REG
                    ;
03CD 300F03         TIMER_INTR50:  JNB     SWITCH_ENABLE,TIMER_INTR60      ;JUMP IF NOT READING SW
03D0 120000    F          CALL    SWITCH
                    ;
03D3 300A28         TIMER_INTR60:  JNB     COIN_UP,TIMER_INTR70    ;JUMP IF NO COIN DROPPED IN
03D6 201F25                JB      CLEAR_FLAG,TIMER_INTR70 ;WAIT TO CLEAR DISPLAY
03D9 C20A                  CLR     COIN_UP                 ;CLEAR THE NEW COIN FLAG
03DB 900000    F           MOV     DPTR,#DECODE_TABLE      ;DISPLAY THE NUMBER OF COINS
03DE F562                  MOV     A,COIN_COUNT            ;CHECK IF COUNT GREATER THAN 12
```

```
03E0 B40D04          CJNE    A,#13,TIMER_INTR65
03E3 740C            MOV     A,#12                       ;DEFAULT TO 12 IF TRUE
03E5 F562            MOV     COIN_COUNT,A
03E7 120000    F     CALL    BIN_TO_DEC                  ;CONVER COIN COUNT TO BCD
03EA E557            MOV     A,DART_SCORE                ;DART SCORE USED TO PASS BCD
03EC 540F            ANL     A,#0FH                      ;GET ONE'S DIGIT
03EE 93              MOVC    A,@A+DPTR                   ;LOOK UP 7-SEG CODE
03EF F572            MOV     TEMP_1_BUFR,A               ;PUT CODE IN DISPLAY BUFFER
03F1 E557            MOV     A,DART_SCORE
03F3 54F0            ANL     A,#0F0H                     ;GET THE TEN'S DIGIT
03F5 6007            JZ      TIMER_INTR70
03F7 C4              SWAP    A
03F8 93              MOVC    A,@A+DPTR                   ;LOOK UP 7-SEG CODE
03F9 F571            MOV     TEMP_10_BUFR,A              ;PUT CODE IN DISPLAY BUFFER
03FB 755700          MOV     DART_SCORE,#0               ;CLEAR THE SCORE REGISTER
                ;
03FE 301C1C          JNB     EXIT,TIMER_INTR80
                     %SELRB0
0404 53A80F          ANL     IE,#0FH
0407 787F            MOV     R0,#127
0409 E4              CLR     A
040A F86201          CJNE    R0,#COIN_COUNT,TIMER_INTR73
040D 18              DEC     R0
040E F6              MOV     @R0,A
040F D8F9            DJNZ    R0,TIMER_INTR72
0411 D20A            SETB    COIN_UP
0413 D21F            SETB    CLEAR_FLAG
0415 900000    F     MOV     DPTR,#INIT20
0418 C082            PUSH    DPL
041A C083            PUSH    DPH
041C 32              RETI
                ;
041D D082            POP     DPL
041F D083            POP     DPH
0421 D0D0            POP     PSW
0423 D0E0            POP     ACC
0425 32              RETI
                ;
0426 02         EXTERNAL_LATCH_TABLE:  DB      DIGIT_ROW3
0427 10                                DB      DIGIT_ROW2
0428 04                                DB      DIGIT_ROW1
0429 20                                DB      DIGIT_ROW0
042A 40                                DB      LAMP_BANK1
042B 80                                DB      LAMP_BANK2
042C 01                                DB      LAMP_BANK3
                ;
                $EJECT
                ;*****************************************************************
                ;
```

```
042D 200E0B     970   INPUT_SWITCHES: JB      SWITCH_DOWN,IN_SW_RET
0430 D20F       971                   SETB    SWITCH_ENABLE
0432 E54C       972                   MOV     A,SWITCH_BUFFER
0434 6005       973                   JZ      IN_SW_RET
0436 FA         974                   MOV     R2,A
0437 754C00     975                   MOV     SWITCH_BUFFER,#0
043A 22         976                   RET
043B E4         977   IN_SW_RET:      CLR     A
043C 22         978                   RET
                979   ;
                980   ;*****************************************************************************
                981   ;
043D E54B       982   SWITCH:         MOV     A,DEBOUNCE_TIMER
043F 6003       983                   JZ      SWITCH10
0441 154B       984                   DEC     DEBOUNCE_TIMER
0443 22         985                   RET
                986   ;
0444 300D0D     987   SWITCH10:       JNB     SWITCH_RELEASE,SWITCH30
                988                   %READ_SWITCH
0449 6004       992                   JZ      SWITCH20
044B 754B0A     993                   MOV     DEBOUNCE_TIMER,#DBNC_TIME
044E 22         994                   RET
                995   ;
044F C20D       996   SWITCH20:       CLR     SWITCH_RELEASE
0451 C20F       997                   CLR     SWITCH_ENABLE
0453 22         998                   RET
                999   ;
0454 300E14     1000  SWITCH30:       JNB     SWITCH_DOWN,SWITCH50
                1001                  %READ_SWITCH
0459 B54A0A     1005                  CJNE    A,SWITCH_TEMP,SWITCH40
045C C20E       1006                  CLR     SWITCH_DOWN
045E D20D       1007                  SETB    SWITCH_RELEASE
0460 754B0A     1008                  MOV     DEBOUNCE_TIMER,#DBNC_TIME
0463 F54C       1009                  MOV     SWITCH_BUFFER,A
0465 22         1010                  RET
                1011  ;
0466 C20E       1012  SWITCH40:       CLR     SWITCH_DOWN
0468 C20D       1013                  CLR     SWITCH_RELEASE
046A 22         1014                  RET
                1015  ;
                1016  SWITCH50:       %READ_SWITCH
046D F54A       1020                  MOV     SWITCH_TEMP,A
046F 7003       1021                  JNZ     SWITCH60
0471 C20F       1022                  CLR     SWITCH_ENABLE
0473 22         1023                  RET
                1024  ;
0474 D20E       1025  SWITCH60:       SETB    SWITCH_DOWN
0476 754B0A     1026                  MOV     DEBOUNCE_TIMER,#DBNC_TIME
0479 22         1027                  RET
```

```
                1028    ;
                1029    ;*****************************************************************************
                1030    ;
047A C0E0       1031    DART_HIT:       PUSH    ACC
047C C0D0       1032                    PUSH    PSW
                1033                    %SELRB2
                1037    ;
0483 7E05       1038                    MOV     R6,#5           ;DEBOUNCE THE INTERRUPT
0485 74FF       1039    DART_HIT1:      MOV     A,#0FFH
0487 D5E0FD     1040    DART_HIT2:      DJNZ    ACC,DART_HIT2
048A DFF9       1041                    DJNZ    R6,DART_HIT1
048C 20B31E     1042                    JB      DATA_RDY,DART_BIT40
                1043    ;
048F C2B1       1044                    CLR     DATA_REC        ;TAKE DATA_REC LOW
                1045    ;
0491 E590       1046                    MOV     A,P1    ;GET THE FIRST NIBBLE
0493 540F       1047                    ANI     A,#0FH
                1048    ;
0495 D2B1       1049                    SETB    DATA_REC        ;TAKE THE DATA REC'D LINE HIGH
                1050    ;
0497 F59A       1051                    MOV     DART_BUFFER,A   ;TEMP STORE THE FIRST NIBBLE
                1052    ;
0499 30B3FD     1053    DART_HIT10:     JNB     DATA_RDY,DART_HIT10  ;LOOP TILL DATA_RDY GOES HIGH
                1054    ;
049C 20B3FD     1055    DART_HIT20:     JB      DATA_RDY,DART_HIT20  ;LOOP TILL DATA_RDY GOES LOW
                1056    ;
049F C2B1       1057                    CLR     DATA_REC        ;TAKE DATA_REC LOW
                1058    ;
04A1 E590       1059                    MOV     A,P1            ;GET THE SECOND NIBBLE
04A3 540F       1060                    ANI     A,#0FH          ;MASK THE DATA
                1061    ;
04A5 D2B1       1062                    SETB    DATA_REC        ;TAKE DATA_REC HIGH
                1063    ;
04A7 C4         1064                    SWAP    A               ;GET DATA TO HIGH NIBBLE
04A8 425A       1065                    ORL     DART_BUFFER,A   ;COMBINE LOW AND HIGH NIBBLE
                1066    ;
04AA 30B3FD     1067    DART_HIT30:     JNB     DATA_RDY,DART_HIT30  ;LOOP TILL DATA_RDY GOES HIGH
                1068    ;
04AD D0D0       1069    DART_HIT40:     POP     PSW
04AF D0E0       1070                    POP     ACC
04B1 32         1071                    RETI
                1072    ;
                1073    ;*****************************************************************************
                1074    ;
                1075    ;       PLAYER LAMPS DRIVE FROM LAMP BANK1
                1076    ;
04B2 04         1077    PLAYER_LAMP_TABLE:      DB      PLAYER1_LAMP
04B3 20         1078                            DB      PLAYER2_LAMP
04B4 08         1079                            DB      PLAYER3_LAMP
```

```
04B5 10                 1080                        DB      PLAYER4_LAMP
                        1081      ;
                        1082      ;*****************************************************************************
                        1083      ;
                        1084      TEST:   %SELRB3
04BC 5365BF             1088              ANI     BANK1_REG,#NOT(GAME_OVER_LAMP)
04BF D21E               1089              SETB    ATTRACT_FLAG
04C1 120000     F       1090              CALL    CLEAR_DISPLAY
04C4 757000             1091              MOV     ROUND_DART_BUFR,#0
04C7 30B5FD             1092      TEST_A: JNB     TEST_MODE,TEST_A
                        1093              %DELAY(TEN_MSEC)
04D1 30B5F3             1098              JNB     TEST_MODE,TEST_A
                        1099      ;
04D4 7871               1100      TEST0:  MOV     R0,#TEMP_10_BUFR
04D6 76DA               1101              MOV     @R0,#S
04D8 08                 1102              INC     R0
04D9 76F0               1103              MOV     @R0,#TT
04DB 08                 1104              INC     R0
04DC 76F0               1105              MOV     @R0,#TT
04DE 7B00               1106              MOV     R3,#0
                        1107      ;
04E0 120000     F       1108      TEST1:  CALL    INPUT_SWITCHES
04E3 20E12E             1109              JB      COUNTUP_BUTTON,DISPLAY_TEST
04E6 20E052             1110              JB      X501_BUTTON,LAMP_TEST
04E9 20E619             1111              JB      X301_BUTTON,DART_JMP
04EC 20E519             1112              JB      SHANG_HAI_BUTTON,SND_JMP
04EF 20E71C             1113              JB      PLAYER_CHANGE_BUTTON,EXIT_TEST
04F2 20E416             1114              JB      SCRAM_BUTTON,PS_JMP
04F5 20B5E8             1115              JB      TEST_MODE,TEST1
                        1116              %DELAY(TEN_MSEC)
04FF 20B5DE             1121              JB      TEST_MODE,TEST1
0502 020000     F       1122              JMP     SWITCH_TEST
0505 020000     F       1123      DART_JMP:       JMP     DART_TEST
0508 020000     F       1124      SND_JMP:        JMP     TONE_TEST
050B 020000     F       1125      PS_JMP:         JMP     PS_TEST
                        1126      ;
                        1127      EXIT_TEST:      %SELRB0
0511 020000     F       1130                      JMP     INITIALIZE_SYSTEM
                        1131      ;
                        1132      ;
0514 120000     F       1133      DISPLAY_TEST:   CALL    CLEAR_DISPLAY
0517 900000     F       1134                      MOV     DPTR,#DISPLAY_TEST_TABLE
051A 7C01               1135      DIS_TEST0:      MOV     R4,#01
051C EB                 1136                      MOV     A,R3
051D 93                 1137                      MOVC    A,@A+DPTR
051E F8                 1138                      MOV     R0,A
051F EC                 1139                      MOV     A,R4
                        1140      ;
0520 F6                 1141      DIS_TEST10:     MOV     @R0,A
```

```
                        %WAIT(HALF_SEC)
                ;
0529 C3                 CLR     C
052A EC                 MOV     A,R4
052B 33                 RLC     A
052C FC                 MOV     R4,A
052D 50F1               JNC     DIS_TEST10
052F BE7004             CJNE    R0,#ROUND_DART_BUFR,DIS_TEST20
0532 7600               MOV     @R0,#0
0534 809E               JMP     TEST0
                ;
0536 7600       DIS_TEST20:     MOV     @R0,#0
0538 0E                 INC     R3
0539 80DF               JMP     DIS_TEST0
                ;
                ;
053B 120000   F LAMP_TEST:      CALL    CLEAR_DISPLAY
053E 900000   F                 MOV     DPTR,#LAMP_TEST_TABLE
0541 EB         LAMP_TEST0:     MOV     A,R3
0542 93                 MOVC    A,@A+DPTR
0543 B46502             CJNE    A,#BANK1_REG,LAMP_TEST10
0546 8008               SJMP    LAMP_TEST30
0548 B46402     LAMP_TEST10:    CJNE    A,#BANK2_REG,LAMP_TEST20
054B 8003               SJMP    LAMP_TEST30
054D B46306     LAMP_TEST20:    CJNE    A,#BANK3_REG,LAMP_TEST40
                ;
0550 7600       LAMP_TEST30:    MOV     @R0,#0
0552 F6                 MOV     R0,A
0553 0B                 INC     R3
0554 80EB               JMP     LAMP_TEST0
                ;
0556 F6         LAMP_TEST40:    MOV     @R0,A
                        %WAIT(HALF_SEC)
055F B86508             CJNE    R0,#BANK1_REG,LAMP_TEST50
0562 B68005             CJNE    @R0,#PLYR_CHANGE_LAMP,LAMP_TEST50
0565 7600               MOV     @R0,#0
0567 020000   F         JMP     TEST0
                ;
056A 0B         LAMP_TEST50:    INC     R3
056B 80D4               JMP     LAMP_TEST0
                ;
056D 30B5FD     JUMP1:          JNB     TEST_MODE,JUMP1
                        %DELAY(TEN_MSEC)
0577 30B5F3             JNB     TEST_MODE,JUMP1
057A 020000   F         JMP     TEST0
                ;
057D 30B5FD     SWITCH_TEST:    JNB     TEST_MODE,SWITCH_TEST
                        %DELAY(TEN_MSEC)
0587 30B5F3             JNB     TEST_MODE,SWITCH_TEST
```

```
058A 120000   F   1207                    CALL    CLEAR_DISPLAY
058D 900000   F   1208   SW_TEST0:        MOV     DPTR,#SWITCH_TEST_TABLE
0590 7C01         1209   SW_TEST1:        MOV     R4,#01
0592 7B00         1210                    MOV     R3,#0
0594 7A00         1211                    MOV     R2,#0
                  1212   ;
0596 20B50A       1213                    JB      TEST_MODE,SW_TEST10
                  1214                    %DELAY(TEN_MSEC)
05A0 30B5CA       1219                    JNB     TEST_MODE,JUMP1
05A3 120000   F   1220   SW_TEST10:       CALL    INPUT_SWITCHES
05A6 5C           1221   SW_TEST20:       ANI     A,R4
05A7 700D         1222                    JNZ     SW_TEST30
05A9 EC           1223                    MOV     A,R4
05AA C3           1224                    CLR     C
05AB 33           1225                    RLC     A
05AC 40F2         1226                    JC      SW_TEST1
05AE FC           1227                    MOV     R4,A
05AF EB           1228                    MOV     A,R3
05B0 2403         1229                    ADD     A,#3
05B2 FB           1230                    MOV     R3,A
05B3 EA           1231                    MOV     A,R2
05B4 80F0         1232                    JMP     SW_TEST20
                  1233   ;
05B6 7871         1234   SW_TEST30:       MOV     R0,#TEMP_10_BUFR
05B8 EB           1235   SW_TEST40:       MOV     A,R3
05B9 93           1236                    MOVC    A,@A+DPTR
05BA F6           1237                    MOV     @R0,A
05BB 0B           1238                    INC     R3
05BC 08           1239                    INC     R0
05BD B874B8       1240                    CJNE    R0,#TEMP_100_BUFR+1,SW_TEST40
05C0 80CB         1241                    JMP     SW_TEST10
                  1242   ;
                  1243   ;
                  1244   JMP_TEST0:       %STOP_SCAN
05CF 020000   F   1254                    JMP     TEST0
                  1255   ;
05D2 120000   F   1256   DART_TEST:       CALL    CLEAR_DISPLAY
                  1257   DT_A:            %SCAN
05E7 120000   F   1269   DT0:             CALL    INPUT_SWITCHES
05EA 20B5D5       1270                    JB      SHANG_HAI_BUTTON,JMP_TEST0
05ED E559         1271                    MOV     A,DART_BUFFER
05EF 60F6         1272                    JZ      DT0
05F1 B4FF03       1273                    CJNE    A,#0FFH,DT10
05F4 120000   F   1274                    CALL    STUCK
                  1275   ;
05F7 C0E0         1276   DT10:            PUSH    ACC
05F9 120000   F   1277                    CALL    CLEAR_DISPLAY
05FC D0E0         1278                    POP     ACC
05FE 20E72A       1279                    JB      BULLS_EYE,DT20
```

```
0601 20E632          1280                    JB      TPL_DART,DT30
0604 20E534          1281                    JB      IBL_DART,DT40
                     1282     ;
0607 900000    F     1283     DT15:          MOV     DPTR,#IECODE_TABLE
060A 541F            1284                    ANL     A,#1FH
060C 120000    F     1285                    CALL    BIN_TO_DEC
060F 7871            1286                    MOV     R0,#TEMP_10_BUFR
0611 E557            1287                    MOV     A,DART_SCORE
0613 54F0            1288                    ANL     A,#0F0H
0615 C4              1289                    SWAP    A
0616 7005            1290                    JNZ     IT18
0618 7600            1291                    MOV     @R0,#0
061A 020000    F     1292                    JMP     DT19
061D 93              1293     DT18:          MOVC    A,@A+DPTR
061E F6              1294                    MOV     @R0,A
061F 08              1295     DT19:          INC     R0
0620 E557            1296                    MOV     A,DART_SCORE
0622 540F            1297                    ANI     A,#0FH
0624 93              1298                    MOVC    A,@A+DPTR
0625 F6              1299                    MOV     @R0,A
0626 755900          1300                    MOV     DART_BUFFER,#0
0629 80BC            1301                    JMP     DT0
                     1302     ;
062B 7571F8          1303     DT20:          MOV     TEMP_10_BUFR,#BB
062E 7572F2          1304                    MOV     TEMP_1_BUFR,#E
0631 755900          1305                    MOV     DART_BUFFER,#0
0634 80B1            1306                    JMP     DT0
                     1307     ;
0636 7573F0          1308     DT30:          MOV     TEMP_100_BUFR,#TT
0639 80CC            1309                    JMP     DT15
                     1310     ;
063B 7573BC          1311     DT40:          MOV     TEMP_100_BUFR,#SD
063E 80C7            1312                    JMP     DT15
                     1313     ;
                     1314     ;
0640 D21D            1315     TONE_TEST:     SETB    TEST_TONE
0642 758C61          1316                    MOV     TH0,#TG
0645 755302          1317                    MOV     DV,#2
0648 D28C            1318                    SETB    TR0
064A 120000    F     1319     TONE_TEST10:   CALL    INPUT_SWITCHES
064D 30E5FA          1320                    JNB     SHANG_HAI_BUTTON,TONE_TEST10
0650 C28C            1321                    CLR     TR0
0652 D2B4            1322                    SETB    TONE_OUT
0654 C21D            1323                    CLR     TEST_TONE
0656 020000    F     1324                    JMP     TEST0
                     1325     ;
0659 C2D5            1326     PS_TEST:       CLR     F0
065B 74FF            1327                    MOV     A,#0FFH
065D 787F            1328     PS_TEST10:     MOV     R0,#PLYR1_100_BUFR
```

```
065F F6                 PS_TEST15:      MOV     @R0,A
0660 18                                 DEC     R0
0661 B86FFF                             CJNE    R0,#ROUND_DART_BUFR-1,PS_TEST15
0664 F565                               MOV     BANK1_REG,A
0666 F564                               MOV     BANK2_REG,A
0668 F563                               MOV     BANK3_REG,A
                                        %WAIT(HALF_SEC)
0672 20D5F4                             JB      F0,PS_TEST
0675 F4                                 CLR     A
0676 D2D5                               SETB    F0
0678 120000     F                       CALL    INPUT_SWITCHES
067B 30E4DF                             JNB     SCRAM_BUTTON,PS_TEST10
067E 120000     F                       CALL    ALL_LAMPS_OFF
0681 120000     F                       CALL    CLEAR_DISPLAY
0684 757000                             MOV     ROUND_DART_BUFR,#0
0687 020000     F                       JMP     TEST0
                        ;
068A 73                 DISPLAY_TEST_TABLE:     DB      TEMP_100_BUFR
068B 71                                         DB      TEMP_10_BUFR
068C 72                                         DB      TEMP_1_BUFR
068D 7F                                         DB      PLYR1_100_BUFR
068E 7F                                         DB      PLYR1_10_BUFR
068F 77                                         DB      PLYR1_1_BUFR
0690 7F                                         DB      PLYR2_100_BUFR
0691 7A                                         DB      PLYR2_10_BUFR
0692 76                                         DB      PLYR2_1_BUFR
0693 7D                                         DB      PLYR3_100_BUFR
0694 79                                         DB      PLYR3_10_BUFR
0695 75                                         DB      PLYR3_1_BUFR
0696 7C                                         DB      PLYR4_100_BUFR
0697 78                                         DB      PLYR4_10_BUFR
0698 74                                         DB      PLYR4_1_BUFR
0699 70                                         DB      ROUND_DART_BUFR
                        ;
069A 63                 LAMP_TEST_TABLE:        DB      BANK3_REG
069B 01                                         DB      TWENTYFIVE_CENTS_LAMP
069C 40                                         DB      DBI_IN_LAMP
069D 04                                         DB      COUNTUP_LAMP
069E 08                                         DB      X501_LAMP
069F 10                                         DB      X301_LAMP
06A0 20                                         DB      SHANG_HAI_LAMP
06A1 02                                         DB      SCRAM_LAMP
06A2 80                                         DB      DBL_OUT_LAMP
                        ;
06A3 64                                         DB      BANK2_REG
06A4 40                                         DB      FIFTY_CENTS_LAMP
06A5 80                                         DB      REMOVE_DARTS_LAMP
06A6 02                                         DB      BUST_LAMP
                        ;
```

```
06A7 65                 1382                                DB      BANK1_REG
06A8 01                 1383                                DB      TEMP_SCORE_LAMP
06A9 04                 1384                                DB      PLAYER1_LAMP
06AA 20                 1385                                DB      PLAYER2_LAMP
06AB 08                 1386                                DB      PLAYER3_LAMP
06AC 10                 1387                                DB      PLAYER4_LAMP
                        1388        ;
06AD 64                 1389                                DB      BANK2_REG
06AE 01                 1390                                DB      DARTS_THROWN_LAMP
06AF 20                 1391                                DB      GAME_ROUND_LAMP
                        1392        ;
06B0 65                 1393                                DB      BANK1_REG
06B1 02                 1394                                DB      THROW_DARTS_LAMP
06B2 40                 1395                                DB      GAME_OVER_LAMP
06B3 80                 1396                                DB      PLYR_CHANGE_LAMP
                        1397        ;
                        1398        ;
06B4 7E                 1399        SWITCH_TEST_TABLE:      DB      ZERO,ONE,FIVE
06B5 0C
06B6 DA
06B7 7C                 1400                                DB      U,PP,LC
06B8 E6
06B9 72
06BA 08                 1401                                DB      I,N,SD
06BB A8
06BC FC
06BD B8                 1402                                DB      O,TT,SD
06BE F0
06BF BC
06C0 F0                 1403                                DB      CC,R,S
06C1 A0
06C2 DA
06C3 EC                 1404                                DB      H,ONE,S
06C4 0C
06C5 DA
06C6 7E                 1405                                DB      ZERO,ONE,THREE
06C7 0C
06C8 9E
06C9 70                 1406                                DB      L,IC,PP
06CA 72
06CB E6
                        1407        ;
                        1408        ;
                        1409        ;*****************************************************************************
06CC D211               1410        ATTRACT:        SETB    FLASHEM_FLAG
06CE 300305             1411                        JNB     USER_FLAG,ATTRACT10
06D1 754900             1412                        MOV     PLAY_PNTR,#0
06D4 C203               1413                        CLR     USER_FLAG
06D6 900000     F       1414        ATTRACT10:      MOV     DPTR,#PLAY_TABLE
```

```
06D9 E549          1415                    MOV     A,PLAY_PNTR
06DB 93            1416                    MOVC    A,@A+DPTR
06DC F550          1417                    MOV     TUNE_H,A
06DE 0549          1418                    INC     PLAY_PNTR
06E0 E549          1419                    MOV     A,PLAY_PNTR
06E2 93            1420                    MOVC    A,@A+DPTR
06E3 F551          1421                    MOV     TUNE_L,A
06E5 D28C          1422                    SETB    TR0
06E7 0549          1423                    INC     PLAY_PNTR
06E9 E549          1424                    MOV     A,PLAY_PNTR
06EB B40C02        1425                    CJNE    A,#12,ATTRACT_RET
06EE D203          1426                    SETB    USER_FLAG
06F0 22            1427     ATTRACT_RET:   RET
                   1428     ;
06F1 0000     F    1429     PLAY_TABLE:    DW      BUST
06F3 0000     F    1430                    DW      BULL_TONE
06F5 0000     F    1431                    DW      NEXT_TONE
06F7 0000     F    1432                    DW      END_TONE
06F9 0000     F    1433                    DW      BEEP_BEEP
06FB 0000     F    1434                    DW      WIN
                   1435     ;
                   1436     ;
                   1437     ;*****************************************************************
                   1438                    END
```

SYMBOL TABLE LISTING
------ ----- -------

| N A M E | T Y P E | V A L U E | | A T T R I B U T E S |
|---|---|---|---|---|
| AA. . . . . | NUMB | 00EEH | A | |
| ACC . . . . . | D ADDR | 00E0H | A | |
| ALL_LAMPS_OFF . . . . | C ADDR | ---- | EXT | |
| ATTRACT_FLAG. . . . . | B ADDR | 0023H.6 | A | |
| ATTRACT_REG1. . . . . | D ADDR | 0048H | A | |
| ATTRACT_REG2. . . . . | D ADDR | 0047H | A | |
| ATTRACT_REG3. . . . . | D ADDR | 0046H | A | |
| ATTRACT_RET . . . . . | C ADDR | 06F0H | R | SEG=SYSTEM_ROUTINES |
| ATTRACT . . . . . | C ADDR | 06CCH | R | SEG=SYSTEM_ROUTINES |
| ATTRACT10 . . . . . | C ADDR | 06D6H | R | SEG=SYSTEM_ROUTINES |
| B3_REG3 . . . . . | NUMB | 001BH | A | |
| B3_REG4 . . . . . | NUMB | 001CH | A | |
| BANK1_FLASH_REG . . . | D ADDR | 005FH | A | |
| BANK1_REG . . . . . | D ADDR | 0065H | A | |
| BANK2_FLASH_REG . . . | D ADDR | 005EH | A | |
| BANK2_REG . . . . . | D ADDR | 0064H | A | |
| BANK3_FLASH_REG . . . | D ADDR | 005DH | A | |

```
BANK3_REG . . . . . . . D ADDR    0063H    A
BB. . . . . . . . . . .   NUMB    00F8H    A
BEEP_BEEP . . . . . . . C ADDR    ----       EXT
BIN_TO_DEC. . . . . . . C ADDR    ----       EXT
BLANK . . . . . . . . . B ADDR    0021H.1  A
BULL_FLAG . . . . . . . B ADDR    0022H.3  A
BULL_TONE . . . . . . . C ADDR    ----       EXT
BULLS_EYE . . . . . . . B ADDR    00E0H.7  A
BUST_FLAG . . . . . . . B ADDR    0022H.4  A
BUST_LAMP . . . . . . .   NUMB    0002H    A
BUST. . . . . . . . . . C ADDR    ----       EXT
CC. . . . . . . . . . .   NUMB    00B0H    A
CHANGE_PLAYER . . . . . B ADDR    0021H.4  A
CLEAR_DISPLAY . . . . . C ADDR    ----       EXT
CLEAR_FLAG. . . . . . . B ADDR    0023H.7  A
COIN_COUNT. . . . . . . D ADDR    0062H    A
COIN_DEBOUNCE . . . . .   NUMB    00FFH    A
COIN_DROP . . . . . . . B ADDR    00B0H.2  A
COIN_IN . . . . . . . . C ADDR    027DH    R        SEG=SYSTEM_ROUTINES
COIN_IN0. . . . . . . . C ADDR    0288H    R        SEG=SYSTEM_ROUTINES
COIN_IN10 . . . . . . . C ADDR    028AH    R        SEG=SYSTEM_ROUTINES
COIN_IN50 . . . . . . . C ADDR    0296H    R        SEG=SYSTEM_ROUTINES
COIN_IN60 . . . . . . . C ADDR    0298H    R        SEG=SYSTEM_ROUTINES
COIN_IN70 . . . . . . . C ADDR    029AH    R        SEG=SYSTEM_ROUTINES
COIN_IN80 . . . . . . . C ADDR    02BEH    R        SEG=SYSTEM_ROUTINES
COIN_TONE . . . . . . . C ADDR    ----       EXT
COIN_UP . . . . . . . . B ADDR    0021H.2  A
COUNT_REG . . . . . . . D ADDR    0045H    A
COUNTUP_BUTTON. . . . . B ADDR    00E0H.1  A
COUNTUP_LAMP. . . . . .   NUMB    0004H    A
DART_BUFFER . . . . . . D ADDR    0059H    A
DART_BIT. . . . . . . . C ADDR    047AH    R        SEG=SYSTEM_ROUTINES
DART_BIT1 . . . . . . . C ADDR    0485H    R        SEG=SYSTEM_ROUTINES
DART_BIT10. . . . . . . C ADDR    0499H    R        SEG=SYSTEM_ROUTINES
DART_BIT2 . . . . . . . C ADDR    0487H    R        SEG=SYSTEM_ROUTINES
DART_BIT20. . . . . . . C ADDR    049CH    R        SEG=SYSTEM_ROUTINES
DART_BIT30. . . . . . . C ADDR    04AAH    R        SEG=SYSTEM_ROUTINES
DART_BIT40. . . . . . . C ADDR    04ADH    R        SEG=SYSTEM_ROUTINES
DART_JMP. . . . . . . . C ADDR    0505H    R        SEG=SYSTEM_ROUTINES
DART_SCAN . . . . . . . B ADDR    00B0H.0  A
DART_SCORE. . . . . . . D ADDR    0057H    A
DART_TEST . . . . . . . C ADDR    05D2H    R        SEG=SYSTEM_ROUTINES
DARTS_THROWN_LAMP . .   NUMB    0001H    A
DATA_RDY. . . . . . . . B ADDR    00B0H.3  A
DATA_REC. . . . . . . . B ADDR    00B0H.1  A
DBL_DART. . . . . . . . B ADDR    00E0H.5  A
DBL_IN_BUTTON . . . . . B ADDR    00E0H.2  A
DBL_IN_FLAG . . . . . . B ADDR    0020H.0  A
DBL_IN_LAMP . . . . . .   NUMB    0040H    A
```

```
DBL_CUT_BUTTON. . . .  B ADDR    00E0H.3 A
DBI_CUT_FLAG. . . . .  B ADDR    0020H.1 A
DBI_CUT_LAMP. . . . .    NUMB    0080H   A
DBNC_TIME . . . . . .    NUMB    000AH   A
DEBOUNCE_TIMER. . . .  D ADDR    004BH   A
DECODE_TABLE. . . . .  C ADDR    ----      EXT
DELAY_REG . . . . . .  D ADDR    004EH   A
DIGIT_COL0. . . . . .  B ADDR    0090H.4 A
DIGIT_COL1. . . . . .  B ADDR    0090H.5 A
DIGIT_COL2. . . . . .  B ADDR    0090H.6 A
DIGIT_COL3. . . . . .  B ADDR    0090H.7 A
DIGIT_ROW0. . . . . .  X ADDR    0020H   A
DIGIT_ROW1. . . . . .  X ADDR    0004H   A
DIGIT_ROW2. . . . . .  X ADDR    0010H   A
DIGIT_ROW3. . . . . .  X ADDR    0002H   A
DIS_TEST0 . . . . . .  C ADDR    051AH   R        SEG=SYSTEM_ROUTINES
DIS_TEST10. . . . . .  C ADDR    0520H   R        SEG=SYSTEM_ROUTINES
DIS_TEST20. . . . . .  C ADDR    0536H   R        SEG=SYSTEM_ROUTINES
DISPLAY_TEST_TABLE. .  C ADDR    068AH   R        SEG=SYSTEM_ROUTINES
DISPLAY_TEST. . . . .  C ADDR    0514H   R        SEG=SYSTEM_ROUTINES
DOUBLE_BYTE . . . . .  B ADDR    0021H.0 A
DOUBLE_FLAG . . . . .  D ADDR    0058H   A
DOUBLE. . . . . . . .  B ADDR    0022H.7 A
DP. . . . . . . . . .    NUMB    0001H   A
DPH . . . . . . . . .  D ADDR    0083H   A
DPL . . . . . . . . .  D ADDR    0082H   A
DT_A. . . . . . . . .  C ADDR    05D5H   R        SEG=SYSTEM_ROUTINES
DT0 . . . . . . . . .  C ADDR    05E7H   R        SEG=SYSTEM_ROUTINES
DT10. . . . . . . . .  C ADDR    05F7H   R        SEG=SYSTEM_ROUTINES
DT15. . . . . . . . .  C ADDR    0607H   R        SEG=SYSTEM_ROUTINES
DT18. . . . . . . . .  C ADDR    061DH   R        SEG=SYSTEM_ROUTINES
DT19. . . . . . . . .  C ADDR    061FH   R        SEG=SYSTEM_ROUTINES
DT20. . . . . . . . .  C ADDR    062BH   R        SEG=SYSTEM_ROUTINES
DT30. . . . . . . . .  C ADDR    0636H   R        SEG=SYSTEM_ROUTINES
DT40. . . . . . . . .  C ADDR    063EH   R        SEG=SYSTEM_ROUTINES
DV. . . . . . . . . .  D ADDR    0053H   A
E . . . . . . . . . .    NUMB    00F2H   A
EIGHT . . . . . . . .    NUMB    00FFH   A
END_TONE. . . . . . .  C ADDR    ----      EXT
EXIT_TEST . . . . . .  C ADDR    050EH   R        SEG=SYSTEM_ROUTINES
EXIT. . . . . . . . .  B ADDR    0023H.4 A
EXTERNAL_LATCH_TABLE.  C ADDR    0426H   R        SEG=SYSTEM_ROUTINES
F0. . . . . . . . . .  B ADDR    00D0H.5 A
FIFTEEN_SEC . . . . .    NUMB    0096H   A
FIFTY_CENTS_LAMP. . .    NUMB    0040H   A
FIRST_TIME. . . . . .  B ADDR    0021H.3 A
FIVE_MSEC . . . . . .    NUMB    0005H   A
FIVE. . . . . . . . .    NUMB    00DAH   A
FLASH_COUNT . . . . .    NUMB    003FH   A
```

```
FLASH_FLAG. . . . . .  B ADDR    0020H.2 A
FLASH_GAME_LAMPS. . .  C ADDR    0249H   R        SEG=SYSTEM_ROUTINES
FLASH_GAME10. . . . .  C ADDR    0256H   R        SEG=SYSTEM_ROUTINES
FLASH_GAME20. . . . .  C ADDR    025BH   R        SEG=SYSTEM_ROUTINES
FLASH_GAME30. . . . .  C ADDR    0275H   R        SEG=SYSTEM_ROUTINES
FLASH_LAMP_TABLE. . .  C ADDR    0278H   R        SEG=SYSTEM_ROUTINES
FLASH_PTR_END . . . .    NUMB    0004H   A
FLASH_PTR . . . . . .  D ADDR    0060H   A
FLASH_RET . . . . . .  C ADDR    0277H   R        SEG=SYSTEM_ROUTINES
FLASH_TIMER . . . . .  D ADDR    0061H   A
FLASHEM_FLAG. . . . .  B ADDR    0022H.1 A
FLASHEM . . . . . . .  C ADDR    01E8H   R        SEG=SYSTEM_ROUTINES
FLG501. . . . . . . .  B ADDR    0020H.6 A
FOUR. . . . . . . . .    NUMB    00CCH   A
GAME_301. . . . . . .  C ADDR    ----      EXT
GAME_COUNTUP. . . . .  C ADDR    ----      EXT
GAME_LAMP_TABLE . . .  C ADDR    01E3H   R        SEG=SYSTEM_ROUTINES
GAME_LAMPS. . . . . .    NUMB    003EH   A
GAME_OVER_LAMP. . . .    NUMB    0040H   A
GAME_ROUND_LAMP . . .    NUMB    0020H   A
GAME_SCRAM. . . . . .  C ADDR    ----      EXT
GAME_SELECT_MASK. . .    NUMB    0073H   A
GAME_SHANG_HAI. . . .  C ADDR    ----      EXT
GAME_START. . . . . .  B ADDR    0022H.0 A
GAME1 . . . . . . . .  C ADDR    01D2H   R        SEG=SYSTEM_ROUTINES
GAME2 . . . . . . . .  C ADDR    01D5H   R        SEG=SYSTEM_ROUTINES
GAME3 . . . . . . . .  C ADDR    01DAH   R        SEG=SYSTEM_ROUTINES
GAME4 . . . . . . . .  C ADDR    01DDH   R        SEG=SYSTEM_ROUTINES
GAME5 . . . . . . . .  C ADDR    01E0H   R        SEG=SYSTEM_ROUTINES
GEN2. . . . . . . . .  B ADDR    0023H.2 A
H . . . . . . . . . .    NUMB    001CH   A
HALF_SEC. . . . . . .    NUMB    0005H   A
I . . . . . . . . . .    NUMB    0008H   A
IE. . . . . . . . . .  D ADDR    00A8H   A
IN_SW_RET . . . . . .  C ADDR    043BH   R        SEG=SYSTEM_ROUTINES
INIT10. . . . . . . .  C ADDR    0003H   R        SEG=SYSTEM_ROUTINES
INIT20. . . . . . . .  C ADDR    0006H   R        SEG=SYSTEM_ROUTINES
INITIALIZE_SYSTEM . .  C ADDR    0000H   R PUB    SEG=SYSTEM_ROUTINES
INPUT_SWITCHES. . . .  C ADDR    042DH   R PUB    SEG=SYSTEM_ROUTINES
IP. . . . . . . . . .  D ADDR    00B8H   A
JMP_TEST0 . . . . . .  C ADDR    05C2H   R        SEG=SYSTEM_ROUTINES
JUMP1 . . . . . . . .  C ADDR    056DH   R        SEG=SYSTEM_ROUTINES
L . . . . . . . . . .    NUMB    0070H   A
LAMP_BANK1. . . . . .  X ADDR    0040H   A
LAMP_BANK2. . . . . .  X ADDR    0080H   A
LAMP_BANK3. . . . . .  X ADDR    0001H   A
LAMP_PNTR . . . . . .  D ADDR    0056H   A
LAMP_TEST_TABLE . . .  C ADDR    069AH   R        SEG=SYSTEM_ROUTINES
LAMP_TEST . . . . . .  C ADDR    053BH   R        SEG=SYSTEM_ROUTINES
```

```
LAMP_TEST0. . . . . .  C ADDR    0541H    R        SEG=SYSTEM_ROUTINES
LAMP_TEST10 . . . . .  C ADDR    0548H    R        SEG=SYSTEM_ROUTINES
LAMP_TEST20 . . . . .  C ADDR    054DH    R        SEG=SYSTEM_ROUTINES
LAMP_TEST30 . . . . .  C ADDR    0550H    R        SEG=SYSTEM_ROUTINES
LAMP_TEST40 . . . . .  C ADDR    0556H    R        SEG=SYSTEM_ROUTINES
LAMP_TEST50 . . . . .  C ADDR    056AH    R        SEG=SYSTEM_ROUTINES
LAST_CHECK. . . . . .    NUMB    0015H    A
LC. . . . . . . . . .    NUMB    0072H    A
LOAD. . . . . . . . .  B ADDR    0023H.1  A
MSG_PNTR. . . . . . .  D ADDR    005CH    A
N . . . . . . . . . .    NUMB    00A8H    A
NEW_GAME. . . . . . .  C ADDR    012CH    R        SEG=SYSTEM_ROUTINES
NEXT_TONE . . . . . .  C ADDR    ----       EXT
NINE. . . . . . . . .    NUMB    00CEH    A
NUM0. . . . . . . . .  C ADDR    0239H    R        SEG=SYSTEM_ROUTINES
NUM1. . . . . . . . .  C ADDR    0241H    R        SEG=SYSTEM_ROUTINES
NUMBERS . . . . . . .  C ADDR    0231H    R        SEG=SYSTEM_ROUTINES
O . . . . . . . . . .    NUMB    00B8H    A
ODD_COIN. . . . . . .  B ADDR    00E0H.0  A
ONE_SEC . . . . . . .    NUMB    000AH    A
ONE . . . . . . . . .    NUMB    000CH    A
OUTPUT1_LAMP. . . . .    NUMB    0004H    A
OUTPUT2_LAMP. . . . .    NUMB    0008H    A
OVER_HEAD_LAMP. . . .    NUMB    0010H    A
P1. . . . . . . . . .  D ADDR    0090H    A
P3. . . . . . . . . .  D ADDR    00B0H    A
PAUSE_FLAG. . . . . .  B ADDR    0020H.5  A
PLAY_PNTR . . . . . .  D ADDR    004SH    A
PLAY_TABLE. . . . . .  C ADDR    06F1H    R        SEG=SYSTEM_ROUTINES
PLAYER_CHANGE_BUTTON.  B ADDR    00E0H.7  A
PLAYER_COUNT. . . . .  D ADDR    005AH    A
PLAYER_LAMP_TABLE . .  C ADDR    04B2H    R        SEG=SYSTEM_ROUTINES
PLAYER_LAMPS_OFF. . .    NUMB    00C3H    A
PLAYER_LAMPS. . . . .    NUMB    003CH    A
PLAYER1_LAMP. . . . .    NUMB    0004H    A
PLAYER2_LAMP. . . . .    NUMB    0020H    A
PLAYER3_LAMP. . . . .    NUMB    0008H    A
PLAYER4_LAMP. . . . .    NUMB    0010H    A
PLYR_CHANGE_LAMP. . .    NUMB    0080H    A
PLYR1_1_BUFR. . . . .  D ADDR    0077H    A
PLYR1_10_BUFR . . . .  D ADDR    007BH    A
PLYR1_100_BUFR. . . .  D ADDR    007FH    A
PLYR1_NEXT. . . . . .  D ADDR    004SH    A
PLYR1_SCORE_H . . . .  D ADDR    006CH    A
PLYR1_SCORE_L . . . .  D ADDR    006DH    A
PLYR2_1_BUFR. . . . .  D ADDR    0076H    A
PLYR2_10_BUFR . . . .  D ADDR    007AH    A
PLYR2_100_BUFR. . . .  D ADDR    007EH    A
PLYR2_NEXT. . . . . .  D ADDR    0048H    A
```

```
PLYR2_SCORE_H . . . . .  D ADDR    006AH    A
PLYR2_SCORE_L . . . . .  D ADDR    006BH    A
PLYR3_1_BUFR. . . . . .  D ADDR    0075H    A
PLYR3_10_BUFR . . . . .  D ADDR    0079H    A
PLYR3_100_BUFR. . . . .  D ADDR    007DH    A
PLYR3_NEXT. . . . . . .  D ADDR    0047H    A
PLYR3_SCORE_H . . . . .  D ADDR    0068H    A
PLYR3_SCORE_L . . . . .  D ADDR    0069H    A
PLYR4_1_BUFR. . . . . .  D ADDR    0074H    A
PLYR4_10_BUFR . . . . .  D ADDR    0078H    A
PLYR4_100_BUFR. . . . .  D ADDR    007CH    A
PLYR4_NEXT. . . . . . .  D ADDR    0046H    A
PLYR4_SCORE_H . . . . .  D ADDR    0066H    A
PLYR4_SCORE_L . . . . .  D ADDR    0067H    A
PP. . . . . . . . . . .    NUMB    00E6H    A
PS_JMP. . . . . . . . .  C ADDR    050BH    R        SEG=SYSTEM_ROUTINES
PS_TEST . . . . . . . .  C ADDR    0659H    R        SEG=SYSTEM_ROUTINES
PS_TEST10 . . . . . . .  C ADDR    065DH    R        SEG=SYSTEM_ROUTINES
PS_TEST15 . . . . . . .  C ADDR    065FH    R        SEG=SYSTEM_ROUTINES
PS. . . . . . . . . . .  D ADDR    00D0H    A
R . . . . . . . . . . .    NUMB    00A0H    A
REG2. . . . . . . . . .    NUMB    0002H    A
REMOVE_DARTS_LAMP . . .    NUMB    0080H    A
ROUND_COUNT . . . . . .  D ADDR    004DH    A
ROUND_DART_BUFR . . . .  D ADDR    0070H    A
S . . . . . . . . . . .    NUMB    00DAH    A
SCORE_FLAG. . . . . . .  B ADDR    0022H.7  A
SCRAM_BUTTON. . . . . .  B ADDR    00E0H.4  A
SCRAM_LAMP. . . . . . .    NUMB    0002H    A
SD. . . . . . . . . . .    NUMB    00BCH    A
SEL_GM00. . . . . . . .  C ADDR    00B3H    R        SEG=SYSTEM_ROUTINES
SEL_GM10. . . . . . . .  C ADDR    00BFH    R        SEG=SYSTEM_ROUTINES
SEL_GM20. . . . . . . .  C ADDR    00C8H    R        SEG=SYSTEM_ROUTINES
SEL_GM21. . . . . . . .  C ADDR    00DAH    R        SEG=SYSTEM_ROUTINES
SEL_GM22. . . . . . . .  C ADDR    00DFH    R        SEG=SYSTEM_ROUTINES
SEL_GM25. . . . . . . .  C ADDR    00E2H    R        SEG=SYSTEM_ROUTINES
SEL_GM30. . . . . . . .  C ADDR    00E7H    R        SEG=SYSTEM_ROUTINES
SEL_GM30A . . . . . . .  C ADDR    00FBH    R        SEG=SYSTEM_ROUTINES
SEL_GM31. . . . . . . .  C ADDR    0108H    R        SEG=SYSTEM_ROUTINES
SEL_GM32. . . . . . . .  C ADDR    010EH    R        SEG=SYSTEM_ROUTINES
SEL_GM32A . . . . . . .  C ADDR    0114H    R        SEG=SYSTEM_ROUTINES
SEL_GM33. . . . . . . .  C ADDR    0117H    R        SEG=SYSTEM_ROUTINES
SEL_GM40. . . . . . . .  C ADDR    0119H    R        SEG=SYSTEM_ROUTINES
SEL_GM50. . . . . . . .  C ADDR    0123H    R        SEG=SYSTEM_ROUTINES
SEL_GM54. . . . . . . .  C ADDR    0135H    R        SEG=SYSTEM_ROUTINES
SEL_GM54A . . . . . . .  C ADDR    0145H    R        SEG=SYSTEM_ROUTINES
SEL_GM54B . . . . . . .  C ADDR    014BH    R        SEG=SYSTEM_ROUTINES
SEL_GM54C . . . . . . .  C ADDR    014EH    R        SEG=SYSTEM_ROUTINES
SEL_GM54D . . . . . . .  C ADDR    0157H    R        SEG=SYSTEM_ROUTINES
```

```
SEL_GM55. . . . . .  C ADDR    015CH   R       SEG=SYSTEM_ROUTINES
SEL_GM56. . . . . .  C ADDR    015EH   R       SEG=SYSTEM_ROUTINES
SEL_GM57. . . . . .  C ADDR    016AH   R       SEG=SYSTEM_ROUTINES
SEL_GM58. . . . . .  C ADDR    017AH   R       SEG=SYSTEM_ROUTINES
SEL_GM59. . . . . .  C ADDR    0182H   R       SEG=SYSTEM_ROUTINES
SEL_GM60. . . . . .  C ADDR    0184H   R       SEG=SYSTEM_ROUTINES
SEL_GM61. . . . . .  C ADDR    018CH   R       SEG=SYSTEM_ROUTINES
SEL_GM61A . . . . .  C ADDR    019FH   R       SEG=SYSTEM_ROUTINES
SEL_GM70. . . . . .  C ADDR    01A1H   R       SEG=SYSTEM_ROUTINES


MCS-51 MACRO ASSEMBLER    DRTOS2
3


LOC  OBJ            LINE     SOURCE

                    81      ;       EQUATES FOR TONE GENERATION
                    82      ;       --------------------------
0072                83      TA      EQU     72H
007A                84      TAS     EQU     7AH
0003                85      TB      EQU     03H
0011                86      TC      EQU     11H
0001                87      TCS     EQU     01H
002E                88      TD      EQU     2EH
0037                89      TDS     EQU     37H
0043                90      TE      EQU     43H
004D                91      TF      EQU     4DH
0057                92      TFS     EQU     57H
0061                93      TG      EQU     61H
0065                94      TGS     EQU     65H
00FF                95      X       EQU     0FFH
                    96      ;
                    97      $EJECT
                    98      ;       INTERNAL RAM EQUATES FOR GAME SCORING
                    99      ;       -------------------------------------
006F                100     TEMP_SCORE_L    DATA    111
006E                101     TEMP_SCORE_H    DATA    110
006D                102     PLYR1_SCORE_L   DATA    109
006C                103     PLYR1_SCORE_H   DATA    108
006B                104     PLYR2_SCORE_L   DATA    107
006A                105     PLYR2_SCORE_H   DATA    106
0069                106     PLYR3_SCORE_L   DATA    105
0068                107     PLYR3_SCORE_H   DATA    104
0067                108     PLYR4_SCORE_L   DATA    103
0066                109     PLYR4_SCORE_H   DATA    102
                    110     ;
                    111     ;       INTERNAL RAM ADDRESS FOR LAMP BANK REGISTERS
                    112     ;       ---------------------------------------------
```

```
0065   BANK1_REG        DATA   101
0064   BANK2_REG        DATA   100
0063   BANK3_REG        DATA   99
005F   BANK1_FLASH_REG  DATA   95
005E   BANK2_FLASH_REG  DATA   94
005D   BANK3_FLASH_REG  DATA   93
       ;
       ;       INTERNAL RAM EQUATES (GENERAL PURPOSE REGISTERS)
       ;       ------------------------------------------------
0062   COIN_COUNT       DATA   98      ;BIT SET FOR EACH COIN DROP
0061   FLASH_TIMER      DATA   97      ;USED TO TIME FLASHING LAMPS
0060   FLASH_PTR        DATA   96      ;POINTER USED TO ACCESS LAMP TABLES
005C   MSG_PNTR         DATA   92      ;USED FOR POINTER TO MESSAGE
005B   TIMER_REG        DATA   91      ;USED FOR 100 MSEC BASE TIMER
005A   PLAYER_COUNT     DATA   90      ;NUMBER OF PLAYERS PLAYING
0059   DART_BUFFER      DATA   89      ;HOLDS CODE FOR DART THROWN
0058   DOUBLE_FLAG      DATA   88      ;USED FOR DOUBLE IN GAMES
0057   DART_SCORE       DATA   87      ;BCD OF DART VALUE
0056   LAMP_PNTR        DATA   86      ;USED TO DISPLAY PLAYER LAMPS
0055   TEMP_L           DATA   85      ;TEMP STORE FOR PLAYERS SCORE LOW BYTE
0054   TEMP_H           DATA   84      ;    "     "     "     "      HIGH  "
0053   DV               DATA   83
0052   TONE_PTR         DATA   82      ;USED FOR TONE GENERATION (TABLE PNTR)
0051   TUNE_L           DATA   81
0050   TUNE_H           DATA   80
004F   TONE_LENGTH      DATA   79      ;USED FOR LENGTH OF TONE TIMER
004E   DELAY_REG        DATA   78      ;USED IN 1 MSEC BASED DELAY ROUTINE
004D   ROUND_COUNT      DATA   77      ;USED FOR COUNTING ROUNDS DURING GAME
004C   SWITCH_BUFFER    DATA   76      ;USED FOR READING SWITCHES
004B   DEBOUNCE_TIMER   DATA   75
004A   SWITCH_TEMP      DATA   74
0049   PLYR1_NEXT       DATA   73      ;USED IN SHANG HAI
0048   PLYR2_NEXT       DATA   72      ;  "    "    "    "
0047   PLYR3_NEXT       DATA   71      ;  "    "    "    "
0046   PLYR4_NEXT       DATA   70      ;
0049   STOP_PNTR        DATA   73      ;USED IN SCRAM FOR STOP REG PNTR
0048   STOP_REG1A       DATA   72      ;THREE LOCATIONS FOR STOP REG 1ST TEAM
0047   STOP_REG1B       DATA   71
0046   STOP_REG1C       DATA   70
0045   STOP_REG2A       DATA   69      ;THREE LOCATIONS FOR STOP REG 2ND TEAM
0044   STOP_REG2B       DATA   68
0043   STOP_REG2C       DATA   67
0042   STOP_REG3A       DATA   66
0041   STOP_REG3B       DATA   65
0040   STOP_REG3C       DATA   64
003F   STOP_REG4A       DATA   63
003E   STOP_REG4B       DATA   62
003D   STOP_REG4C       DATA   61
0049   PLAY_PNTR        DATA   73
```

```
0048    ATTRACT_REG1     DATA    72
0047    ATTRACT_REG2     DATA    71
0046    ATTRACT_REG3     DATA    70
0045    COUNT_REG        DATA    69
0044    TOUCH_REG1       DATA    68
0043    TOUCH_REG2       DATA    67
        ;
        ;        EXTERNAL RAM ADDRESS FOR DISPLAY ROW DATA BUFFERS
        ;        ------------------------------------------------
        ;
0020    DIGIT_ROW0       XDATA   20H
0004    DIGIT_ROW1       XDATA   04H
0010    DIGIT_ROW2       XDATA   10H
0002    DIGIT_ROW3       XDATA   02H
        ;
        ;        EXTERNAL RAM ADDRESS FOR LAMP DRIVER BUFFERS
        ;        --------------------------------------------
0040    LAMP_BANK1       XDATA   40H
0080    LAMP_BANK2       XDATA   80H
0001    LAMP_BANK3       XDATA   01H
        ;
        ;        EXTERNAL RAM LOCATION FOR SPEECH BOARD COMMUNICATION
        ;        ----------------------------------------------------
00E0    SPEECH_PORT      XDATA   80H
        ;
        ;        DISPLAY STROBE PORT LOCATIONS
        ;        -----------------------------
0094    DIGIT_COL0       BIT     P1.4
0095    DIGIT_COL1       BIT     P1.5
0096    DIGIT_COL2       BIT     P1.6
0097    DIGIT_COL3       BIT     P1.7
        ;
        ;        SYMBOL EQUATES FOR CONTROL CONSTANTS
        ;        ------------------------------------
0025    STK_NUM                  EQU     37
00FF    COIN_DEBOUNCE            EQU     0FFH
00FF    SWITCH_DEBOUNCE          EQU     0FFH
0073    GAME_SELECT_MASK         EQU     01110011B
0002    REG2                     EQU     02H
0004    FLASH_PTR_END            EQU     04H
003E    GAME_LAMPS               EQU     00111110B
003F    FLASH_COUNT              EQU     03FH
0064    TIMER_COUNT              EQU     100
0064    TEN_SEC                  EQU     100
001E    THREE_SEC                EQU     30
0014    TWO_SEC                  EQU     20
000A    ONE_SEC                  EQU     10
0005    HALF_SEC                 EQU     5
00C3    PLAYER_LAMPS_OFF         EQU     11000011B
```

```
003C    PLAYER_LAMPS            EQU     00111100B
0096    FIFTEEN_SEC             EQU     150
000A    TEN_MSEC                EQU     10
0005    FIVE_MSEC               EQU     05
000A    DBNC_TIME               EQU     10
0015    LAST_CHECK              EQU     21
001B    B3_REG3                 EQU     27
001C    B3_REG4                 EQU     28
        ;
        ;               LAMP BANK1 EQUATES
        ;               ------------------
0001    TEMP_SCORE_LAMP         EQU     01H
0002    THROW_DARTS_LAMP        EQU     02H
0004    PLAYER1_LAMP            EQU     04H
0008    PLAYER3_LAMP            EQU     08H
0010    PLAYER4_LAMP            EQU     10H
0020    PLAYER2_LAMP            EQU     20H
0040    GAME_OVER_LAMP          EQU     40H
0080    PLYR_CHANGE_LAMP        EQU     80H
        ;
        ;               LAMP BANK2 EQUATES
        ;               ------------------
0001    DARTS_THROWN_LAMP       EQU     01H
0002    BUST_LAMP               EQU     02H
0004    OUTPUT1_LAMP            EQU     04H
0008    OUTPUT2_LAMP            EQU     08H
0010    OVER_HEAD_LAMP          EQU     10H
0020    GAME_ROUND_LAMP         EQU     20H
0040    FIFTY_CENTS_LAMP        EQU     40H
0080    REMOVE_DARTS_LAMP       EQU     80H
        ;
        ;               LAMP BANK3 EQUATES
        ;               ------------------
0001    TWENTYFIVE_CENTS_LAMP   EQU     01H
0004    COUNTUP_LAMP            EQU     04H
0002    SCRAM_LAMP              EQU     02H
0008    X501_LAMP               EQU     08H
0010    X301_LAMP               EQU     10H
0020    SHANG_HAI_LAMP          EQU     20H
0040    DBL_IN_LAMP             EQU     40H
0080    DBL_OUT_LAMP            EQU     80H
        ;
        ;       BIT EQUATES FOR SOFTWARE FLAGS
        ;       ------------------------------
0000    DBL_IN_FLAG     BIT     00      ;SET WHEN DOUBLE IN BUTTON PUSHED
0001    DBL_OUT_FLAG    BIT     01      ;SET WHEN DOUBLE OUT BUTTON PUSHED
0002    FLASH_FLAG      BIT     02      ;USED WHEN FLASHING GAME SELECT LAMPS
0003    USER_FLAG       BIT     03      ;USED FOR THE ATTRACT MODE
0004    TIMER_FLAG      BIT     04      ;SET WHEN 100 MSEC BASE TIMER TIMES OUT
```

```
0005    PAUSE_FLAG       BIT    05     ;USED FOR TONE GENERATION PAUSES
0006    FLG501           BIT    06     ;SET WHEN PLAYING 501
0007    TONE_FLAG        BIT    07     ;SET WHEN PLAYING TONES
        ;
0008    DOUBLE_BYTE      BIT    08     ;SET WHEN ADDING DOUBLE BYTE NUMBERS
0009    BLANK            BIT    09     ;SET WHEN HUNDS DIGIT IS BLANK
000A    COIN_UP          BIT    10     ;SET WHEN GAME STARTS
000B    FIRST_TIME       BIT    11     ;SET WHEN FIRST ENTERING GAME ROUTINE
000B    TOUCH_FLAG       BIT    11     ;SET WHEN BOARD IS TOUCHED WHEN NO GAME
000C    CHANGE_PLAYER    BIT    12     ;SET WHEN PLAYER CHANGE PUSHED
000D    SWITCH_RELEASE   BIT    13     ;SET WHEN WAITING FOR SWITCH TO RELEASE
000E    SWITCH_DOWN      BIT    14     ;SET WHEN SWITCH PUSHED
000F    SWITCH_ENABLE    BIT    15     ;SET WHEN READING SWITCHES
        ;
0010    GAME_START       BIT    16     ;SET WHEN COIN DROPS, CLEARED AFTER GAME
0011    FLASHEM_FLAG     BIT    17     ;USED DURING ATTRACT TO FLASH LAMPS
0012    TEMP_CY          BIT    18     ;USED TO TEMP STORE THE CARRY BIT
0013    BULL_FLAG        BIT    19     ;SET TO PLAY BULLS EYE TONE
0014    BUST_FLAG        BIT    20     ;  "   "   "    BUST TONE
0015    WIN_FLAG         BIT    21     ;  "   "   "    WIN SONG
0016    SINGLE           BIT    22     ;USED DURING SHANG HAI GAME
0017    DOUBLE           BIT    23     ;  "    "    "    "
0016    SWAP_FLAG        BIT    22     ;USED FOR SCRAM
0017    SCORE_FLAG       BIT    23     ;  "    "    "
        ;
0018    TRIPLE           BIT    24     ;  "    "    "    "    "
0018    STOP_FLAG        BIT    24     ;  "    "    "
0019    LOAD             BIT    25
001A    GEN2             BIT    26
001B    ZERO_FLAG        BIT    27     ;USED IN BCD MATH
001C    EXIT             BIT    28
001D    TEST_TONE        BIT    29
001E    ATTRACT_FLAG     BIT    30
001F    CLEAR_FLAG       BIT    31
        ;
        ;       BIT EQUATES FOR SWITCHES
        ;       ------------------------
00F6    X301_BUTTON              BIT    ACC.6
00F0    X501_BUTTON              BIT    ACC.0
00F1    COUNTUP_BUTTON           BIT    ACC.1
00F5    SHANG_HAI_BUTTON         BIT    ACC.5
00F4    SCRAM_BUTTON             BIT    ACC.4
00F2    DBL_IN_BUTTON            BIT    ACC.2
00F3    DBL_OUT_BUTTON           BIT    ACC.3
00F7    PLAYER_CHANGE_BUTTON     BIT    ACC.7
        ;
        ;       BIT EQUATES FOR DART CODE
        ;       -------------------------
00F5    DBL_DART         BIT    ACC.5
```

```
00E6        TPI_DART        BIT     ACC.6
00E7        BULLS_EYE       BIT     ACC.7
            ;
00E0        ODD_COIN        BIT     ACC.0
            ;
            ;       PORT 3 BIT ASSIGNMENTS
            ;       -----------------------
00B0        DART_SCAN               BIT     P3.0
00B1        DATA_REC                BIT     P3.1
00B2        COIN_DROP               BIT     P3.2
00B3        DATA_RDY                BIT     P3.3
00B4        TONE_OUT                BIT     P3.4
00B5        TEST_MODE               BIT     P3.5
            ;
            $EJECT
            ;*********************************************************************
            ;       MACRO DEFINITIONS
            ;       -----------------
            ;
            %*DEFINE(SELRB0)(
                    ANL     PSW,#0E7H
            )
            ;
            %*DEFINE(SELRB1)(
                    ANL     PSW,#0E7H
                    SETB    PSW.3
            )
            ;
            %*DEFINE(SELRB2)(
                    ANL     PSW,#0E7H
                    SETB    PSW.4
            )
            ;
            %*DEFINE(SELRB3)(
                    ANL     PSW,#0E7H
                    ORL     PSW,#18H
            )
            ;
            %*DEFINE(READ_SWITCH)(
                    MOVX    A,@R0
                    CPL     A
            )
            ;
            %*DEFINE(PLAY(TUN))LOCAL SKIP
            (       JB      TR0,%SKIP
                    PUSH    DPH
                    PUSH    DPL
                    MOV     DPTR,#%TUN
                    MOV     TUNE_L,DPL
```

```
                                MOV     TUNE_H,DPH
                                POP     DPL
                                POP     DPH
                                SETB    TRØ
                        %SKIP:  NOP
                )
339     ;
340             %*DEFINE(DELAY(TIME))(
                                MOV     DELAY_REG,#%TIME
                                MOV     A,DELAY_REG
                                JNZ     $-2
                )
341     ;
342             %*DEFINE(WAIT(TIME2))(
                                MOV     TIMER_REG,#%TIME2
                                CLR     TIMER_FLAG
                                JNE     TIMER_FLAG,$
                )
343     ;
344             %*DEFINE(SCAN)(
                                MOV     DART_BUFFER,#Ø
                                SETB    DART_SCAN
                                CLR     DATA_REC
                                %DELAY(FIVE_MSEC)
                                CLR     DART_SCAN
                                SETB    DATA_REC
                )
345     ;
346             %*DEFINE(STOP_SCAN)(
                                SETB    DART_SCAN
                                CLR     DATA_REC
                                %DELAY(FIVE_MSEC)
                                CLR     DART_SCAN
                )
347     ;
348     $EJECT
349     ;*************************************************************************
350     ;
351     ;       START OF PROGRAM
352     ;       ----------------
----    353     CSEG
0000    354             ORG     Ø
        355     ;
        356     ;               < INTERRUPT VECTOR JUMPS >
        357     ;
0000 020000  F  358                     JMP     INITIALIZE_SYSTEM
0003            359                     ORG     ØØH             ;SET VECTOR FOR INTRØ
0003 020000  F  360                     JMP     COIN_IN
000B            361                     ORG     ØBH             ;SET VECTOR FOR TONE INT.
```

```
000B 020000   F      362                    JMP     SOUND_GEN
0013                 363                    ORG     13H             ;SET VECTOR FOR INTR1
0013 020000   F      364                    JMP     DART_HIT
001B                 365                    ORG     1BH             ;SET VECTOR FOR TIMER INTR1
001B 020000   F      366                    JMP     TIMER_INTR
                     367     ;
                     368     ;*****************************************************************
                     369     SYSTEM_ROUTINES SEGMENT CODE
----                 370             RSEG    SYSTEM_ROUTINES
                     371     ;
0000 E4              372     INITIALIZE_SYSTEM:      CLR     A       ;CLEAR ALL RAM LOCATIONS
0001 787F            373                             MOV     R0,#127
0003 F6              374             INIT10:         MOV     @R0,A
0004 D8FD            375                             DJNZ    R0,INIT10
                     376     ;
0006 758125          377             INIT20:         MOV     SP,#STK_NUM     ;INITIALIZE THE STACK
                     378     ;
                     379                             %SELRB1         ;INITIALIZE THE DISPLAY POINTERS
000E 787F            383                             MOV     R0,#PLYR1_100_BUFR
0010 7F10            384                             MOV     R3,#10H
                     385     ;
                     386                             %SELRB3
0018 7F80            390                             MOV     R3,#80H
                     391                             %SELRB0
                     394     ;
001D 75A8BF          395                             MOV     IE,#10001111B   ;SET INTERRUPTS
0020 75B803          396                             MOV     IP,#00000011B   ;SET INTERRUPT PRIORITIES
0023 758912          397                             MOV     TMOD,#00010010B ;SET TIMER MODE
0026 758800          398                             MOV     TCON,#00000000B ;START TIMER, SET LEVEL INTR.
0029 758DFF          399                             MOV     TH1,#0FEH       ;SET TIMER FOR 1 MSEC
002C 758B0C          400                             MOV     TL1,#0CH
                     401     ;
002F D203            402                             SETB    USER_FLAG
0031 7547FF          403                             MOV     ATTRACT_REG2,#0FFH
0034 754605          404                             MOV     ATTRACT_REG3,#5
0037 436540          405                             ORL     BANK1_REG,#GAME_OVER_LAMP
003A D204            406                             SETB    TIMER_FLAG      ;KEEP TIMER OFF
003C D207            407                             SETB    TONE_FLAG
003E D28E            408                             SETB    TR1             ;START TIMER INTR1
0040 D21F            409                             SETB    CLEAR_FLAG
                     410                             %SCAN                   ;SCAN THE DART BOARD
0054 436410          422                             ORL     BANK2_REG,#OVER_HEAD_LAMP
0057 020000   F      423                             JMP     START
                     424     ;
                     425     $EJECT
                     426     ;*****************************************************************
                     427     ;
005A 20B50D          428     START:          JB      TEST_MODE,START10
                     429                     %DELAY(TEN_MSEC)
```

```
0064 20B503          434                 JB      TEST_MODE,START10
0067 020000    F     435                 JMP     TEST
006A 301103          436     START10:    JNB     FLASHEM_FLAG,START11
006D 120000    F     437                 CALL    FLASHEM
0070 300408          438     START11:    JNB     TIMER_FLAG,START20
0073 755B0A          439                 MOV     TIMER_REG,#ONE_SEC
0076 C204            440                 CLR     TIMER_FLAG
0078 120000    F     441                 CALL    NUMBERS
007B E562            442     START20:    MOV     A,COIN_COUNT     ;CHECK FOR ANY COINS
007D 700B            443                 JNZ     START30
007F E559            444                 MOV     A,DART_BUFFER    ;CHECK IF DART BOARD WAS TOUCHED
0081 60D7            445                 JZ      START            ;LOOP IF NOT
0083 D20B            446                 SETB    TOUCH_FLAG
0085 755900          447                 MOV     DART_BUFFER,#0
0088 80D0            448                 JMP     START
                     449     ;
                     450     START30:    %STOP_SCAN               ;STOP THE DART BOARD SCAN
008A D21E            460                 SETB    ATTRACT_FLAG
008D 754800          461                 MOV     ATTRACT_REG1,#0
0090 754700          462                 MOV     ATTRACT_REG2,#0
0093 754600          463                 MOV     ATTRACT_REG3,#0
0096 754900          464                 MOV     PLAY_PNTR,#0
0099 120000    F     465                 CALL    CLEAR_DISPLAY
009C C21F            466                 CLR     CLEAR_FLAG
009E 757000          467                 MOV     ROUND_DART_BUFR,#0
00A1 436410          468                 ORL     BANK2_REG,#OVER_HEAD_LAMP
                     469     ;
00A4 120000    F     470     SELECT_GAME:CALL    ALL_LAMPS_OFF
00A7 120000    F     471     SEL_GM00:   CALL    FLASH_GAME_LAMPS         ;LOOP TILL GAME SWITCH ENTERED
00AA 120000    F     472                 CALL    INPUT_SWITCHES
00AD 60FB            473                 JZ      SEL_GM00
00AF 5473            474                 ANI     A,#GAME_SELECT_MASK
00B1 60F4            475                 JZ      SEL_GM00
                     476     ;
00B3 D210            477     SEL_GM10:   SETB    GAME_START
00B5 EA              478                 MOV     A,R2
00B6 FF              479                 MOV     R7,A
00B7 900000    F     480                 MOV     DPTR,#GAME_LAMP_TABLE
00BA 7B00            481                 MOV     R3,#0
                     482     ;
00BC 20E61C          483     SEL_GM20:   JB      X301_BUTTON,SEL_GM30
00BF 0B              484                 INC     R3
00C0 20E018          485                 JB      X501_BUTTON,SEL_GM30
00C3 0B              486                 INC     R3
00C4 30E40F          487                 JNB     SCRAM_BUTTON,SEL_GM25
00C7 E562            488                 MOV     A,COIN_COUNT
00C9 B40102          489                 CJNE    A,#1,SEL_GM21
00CC 80D6            490                 JMP     SELECT_GAME
00CE B40302          491     SEL_GM21:   CJNE    A,#3,SEL_GM22
```

```
00DD 80D1                JMP     SELECT_GAME
00DF 020000    F         JMP     SEL_GM22:     SEL_GM30
00E2 0E                  INC     R3
00E3 20E501              JB      SHANG_HAI_BUTTON,SEL_GM30
00E6 0E                  INC     R3
                         ;
00E7 EE                  MOV     A,R3
00E8 93                  MOVC    A,@A+DPTR
00E9 5363C1              ANL     BANK3_REG,#(NOT GAME_LAMPS)
00EC 4401                ORL     A,#TWENTYFIVE_CENTS_LAMP
00EE 4263                ORL     BANK3_REG,A
00F0 435F80              ORL     BANK1_FLASH_REG,#PLYR_CHANGE_LAMP
00F3 F562                MOV     A,COIN_COUNT
00F5 B40103              CJNE    A,#1,SEL_GM30A
00F8 020000    F         JMP     SEL_GM70
00FB EA                  MOV     A,R2
00FC 20E609              JB      X301_BUTTON,SEL_GM31
00FF 20E00C              JB      X501_BUTTON,SEL_GM32
0102 20E40F              JB      SCRAM_BUTTON,SEL_GM32A
0105 020000    F         JMP     SEL_GM70
                         ;
0108 436350              ORL     BANK3_REG,#(X301_LAMP OR DBL_IN_LAMP)
010B 020000    F         JMP     SEL_GM33
010E 436348              ORL     BANK3_REG,#(X501_LAMP OR DBL_IN_LAMP)
0111 020000    F         JMP     SEL_GM33
0114 436342              ORL     BANK3_REG,#(SCRAM_LAMP OR DBL_IN_LAMP)
0117 7DC0                MOV     R5,#(DBL_IN_LAMP OR DBL_OUT_LAMP)
                         ;
0119 F561                MOV     A,FLASH_TIMER
011B 7006                JNZ     SEL_GM50
011D ED                  MOV     A,R5
011E 6263                XRL     BANK3_REG,A
0120 75613F              MOV     FLASH_TIMER,#3FH
                         ;
0123 120000    F         CALL    INPUT_SWITCHES          ;READ THE SWITCHES
0126 60F1                JZ      SEL_GM40                ;LOOP FOR NO SWITCH
0128 5473                ANL     A,#GAME_SELECT_MASK     ;MASK ONLY GAME SWITCHES
012A 6009                JZ      SEL_GM54                ;JUMP IF NOT GAME SWITCH
                         ;
012C 120000    F         CALL    ALL_LAMPS_OFF
012F C200                CLR     DBL_IN_FLAG     ;CLEAR ALL FOR NEW GAME SWITCH ENTERED
0131 C201                CLR     DBL_OUT_FLAG
0133 808A                JMP     SEL_GM10        ;LOOP FOR NEW GAME
                         ;
0135 EA                  MOV     A,R2
0136 20E223              JB      DBL_IN_BUTTON,SEL_GM55
0139 20F31B              JB      DBL_OUT_BUTTON,SEL_GM54D
013C 200006              JB      DBL_IN_FLAG,SEL_GM54A
013F 20010C              JB      DBL_OUT_FLAG,SEL_GM54C
```

```
0142 536C3F        541        ANI    BANK3_REG,#NOT(IEL_IN_LAMP OR DBL_OUT_LAMP)
0145 200103        542        JB     DBL_OUT_FLAG,SEI_GM54B
0148 536C7F        543        ANI    BANK3_REG,#NOT(DBL_OUT_LAMP)
014B 020000  F     544        JMP    SEL_GM00
                   545        ;
014E 2000FA        546        JB     DEL_IN_FLAG,SEL_GM54B
0151 536CBF        547        ANI    BANK2_REG,#NOT(IEI_IN_LAMP)
0154 020000  F     54C        JMP    SEI_GM00
```

We claim as our invention:

1. A dart game comprising a segmented dart target, a switch matrix associated with said segmented dart target, a first microcomputer connected to said switch marix and continuously scanning said matrix, a second microcomputer connected to said first microcomputer, a scoring indicator connected to said second microcomputer, means within said second microcomputer for controlling said first and second microcomputers so that they can operate together, including a game selector switch connected to said second microcomputer, including a plurality of indicator lights connected to said second microcomputer, and wherein said segmented dart target is formed with segments with holes for receiving darts and feet attached to said segments and moveable to close selected ones of said matrix switches when a dart strikes a segment, wherein said continuous scanning of said matrix by said first microprocessor prevents any double scoring.

2. A dart game according to claim 1 wherein said switch matrix can be removed from said segmented dart target so that broken tips of darts can be removed from said segments.

3. A dart game according to claim 1 wherein said segmented dart target comprises a frame in which said segments are moveably mounted.

4. A dart game according to claim 3 including guide ribs mounted between said frame and said segments.

5. A dart game according to claim 3 wherein if a dart strikes a dart in said target and is deflected to a second segment said first microcomputer will score a hit in said second segment.

6. A dart game according to claim 3 wherein a dart which engages one of said segments will cause only a single score to be recorded, even if the dart becomes disengaged after hitting the segment.

7. A dart game according to claim 1 including a coin receiver connected to said microcomputer.

* * * * *